US007600402B2

(12) United States Patent
Shin et al.

(10) Patent No.: US 7,600,402 B2
(45) Date of Patent: Oct. 13, 2009

(54) WASHING APPARATUS AND CONTROL METHOD THEREOF

(75) Inventors: Soo Hee Shin, Busan (KR); Seok Kyu Park, Changwon-si (KR); Byung Hwan Ahn, Changwon-si (KR)

(73) Assignee: LG Electronics Inc., Seoul (KR)

( * ) Notice: Subject to any disclaimer, the term of this patent is extended or adjusted under 35 U.S.C. 154(b) by 431 days.

(21) Appl. No.: 10/979,883

(22) Filed: Nov. 3, 2004

(65) Prior Publication Data

US 2005/0092035 A1 May 5, 2005

(30) Foreign Application Priority Data

| | | |
|---|---|---|
| Nov. 4, 2003 | (KR) | 10-2003-0077592 |
| Nov. 4, 2003 | (KR) | 10-2003-0077593 |
| Nov. 4, 2003 | (KR) | 10-2003-0077594 |
| Nov. 4, 2003 | (KR) | 10-2003-0077595 |
| Nov. 4, 2003 | (KR) | 10-2003-0077596 |
| Nov. 4, 2003 | (KR) | 10-2003-0077597 |
| Nov. 17, 2003 | (KR) | 10-2003-0081084 |
| Nov. 17, 2003 | (KR) | 10-2003-0081085 |

(51) Int. Cl.
*D06F 33/02* (2006.01)

(52) U.S. Cl. ..... 68/5 C

(58) Field of Classification Search ..... 68/5 C, 68/12.21

See application file for complete search history.

(56) References Cited

U.S. PATENT DOCUMENTS

| | | | |
|---|---|---|---|
| 1,487,907 | A | 3/1924 | Yates |
| 1,501,746 | A | 7/1924 | Carter |
| 1,536,230 | A | 5/1925 | McCue |
| 1,570,552 | A | 1/1926 | Bowerbank |
| 1,646,299 | A | 10/1927 | Leo |
| 1,755,101 | A | 4/1930 | Fording et al. |
| 1,755,746 | A | 4/1930 | Clark et al. |
| 1,852,179 | A | 4/1932 | McDonald |
| 1,947,752 | A | 2/1934 | Benesh |
| 2,277,291 | A | 3/1942 | Blair |
| 2,355,882 | A | 8/1944 | Malsbary et al. |
| 2,404,450 | A | 7/1946 | Meyer |
| 2,431,246 | A | 11/1947 | Hallanan |
| 2,516,282 | A | 7/1950 | Wuktib |

(Continued)

FOREIGN PATENT DOCUMENTS

| | | | |
|---|---|---|---|
| CN | 2154278 | Y | 1/1994 |

(Continued)

OTHER PUBLICATIONS

Electronic translation of JP 2003019382A.*

(Continued)

*Primary Examiner*—Joseph L Perrin
(74) *Attorney, Agent, or Firm*—McKenna Long & Aldridge LLP

(57) ABSTRACT

The present invention provides a washing apparatus and control method thereof, by which laundry can be dry-cleaned through the loaded configurations of the wet pad cloth, the filth transfer cloth, the steam providing unit, the fragrance spraying unit, and the detergent supplying unit using either the wet pad cloth or the filth transfer cloth or without using both of the wet pad cloth and the filth transfer cloth.

33 Claims, 37 Drawing Sheets

U.S. PATENT DOCUMENTS 2,547,098 A 11/1951 Pasco
2,574,098 A 11/1951 Fraraccio
2,574,900 A 11/1951 Williams et al.
2,585,608 A 2/1952 Wieghart
2,664,094 A 12/1953 Spragins
2,861,838 A * 11/1958 Wyatt et. al. ..... 239/137
2,880,300 A 3/1959 Reimers et al.
2,925,223 A 2/1960 Reddick et al.
3,025,381 A 3/1962 Pickering
3,203,013 A 8/1965 Alvin
3,347,066 A 10/1967 Klausner
3,402,576 A 9/1968 Krupsky
3,410,986 A 11/1968 Groom
3,443,406 A 5/1969 Hornback et al.
3,473,175 A 10/1969 Sieber
3,583,181 A 6/1971 Brillet
3,611,456 A 10/1971 Hildebrandt
3,615,822 A 10/1971 Molinari
3,672,188 A 6/1972 Geschka et al.
3,705,602 A 12/1972 Nordin et al.
3,730,682 A 5/1973 Brubaker et al.
3,776,471 A 12/1973 Meyer et al.
3,890,987 A 6/1975 Marcussen et al.
3,935,719 A 2/1976 Henderson
4,187,138 A 2/1980 Thwaites et al.
4,204,339 A 5/1980 Muller
4,287,407 A 9/1981 Treiber et al.
4,311,160 A 1/1982 Charland
4,471,792 A 9/1984 Koblenzer
4,527,343 A 7/1985 Danneberg
4,582,025 A * 4/1986 Grasso ..... 122/32
4,643,775 A 2/1987 Reba et al.
4,941,333 A 7/1990 Blessing
5,130,078 A 7/1992 Dillman
5,161,394 A 11/1992 Felzer et al.
5,180,438 A * 1/1993 Hockh et al. ..... 134/21
5,180,483 A 1/1993 Braams et al.
5,219,371 A 6/1993 Shim et al.
5,255,840 A 10/1993 Nowotarski
5,313,811 A 5/1994 Wasinger et al.
5,361,322 A 11/1994 Glucksman et al.
5,368,008 A * 11/1994 Oslin ..... 126/20.2
5,390,385 A 2/1995 Beldham
5,392,738 A 2/1995 Tsutsumi et al.
5,425,255 A 6/1995 Pick
5,439,655 A 8/1995 Fedegari
5,491,857 A 2/1996 Love et al.
5,723,847 A 3/1998 Boldt
5,827,329 A 10/1998 Champeau
5,953,939 A 9/1999 Guerrero-Parra et al.
5,962,288 A 10/1999 Aksenov et al.
5,989,203 A 11/1999 Wang et al.
6,006,398 A 12/1999 Larson et al.
6,161,306 A 12/2000 Clodic et al.
6,299,076 B1 10/2001 Sloan et al.
6,311,527 B1 11/2001 Monteiro et al.
6,397,874 B1 6/2002 Featheringill et al.
6,477,868 B2 11/2002 Chang et al.
6,585,781 B1 7/2003 Roseen
6,622,529 B1 9/2003 Crane
6,691,536 B2 * 2/2004 Severns et al. ..... 68/12.27
6,811,811 B2 11/2004 France et al.
6,854,300 B2 2/2005 Monteiro et al.
6,889,399 B2 * 5/2005 Steiner et al. ..... 8/159
6,898,951 B2 * 5/2005 Severns et al. ..... 68/5 C
7,021,087 B2 4/2006 France et al.
7,275,400 B2 * 10/2007 Severns et al. ..... 68/18 F
2003/0061841 A1 4/2003 Nakamura et al.
2004/0187529 A1 9/2004 Kim et al.
2004/0261824 A1 12/2004 Eiermann
2005/0034248 A1 2/2005 Oh et al.
2005/0144734 A1 7/2005 Yang et al.

FOREIGN PATENT DOCUMENTS

CN 1444676 9/2003
CN 1702225 A 11/2005
DE 483793 10/1929
DE 604415 10/1934
DE 19546967 6/1997
DE 197 43 508 A1 8/1999
EP 0299343 1/1989
EP 0365500 4/1990
EP 0816550 7/1998
EP 1 087 051 3/2001
EP 1275767 1/2003
EP 1 441 059 A1 7/2004
EP 1489217 A1 12/2004
EP 1 507 031 A1 2/2005
EP 1 507 038 A1 2/2005
EP 1507032 A1 2/2005
EP 1 600 545 11/2005
GB 21286 6/1898
GB 21286 A 6/1898
GB 10423 11/1909
GB 10423 A 11/1909
GB 21024 2/1910
GB 21024 A 2/1910
GB 799788 8/1958
GB 799788 A 8/1958
GB 1222227 2/1971
GB 1222227 A 2/1971
GB 21286 A 6/1998
GB 2348213 9/2000
GB 2348213 A 9/2000
GB 2 366 809 3/2002
GB 2366809 3/2002
JP 59-108592 6/1984
JP 61-128995 6/1986
JP 61-128995 A 6/1986
JP 63-166182 10/1988
JP 2-198595 8/1990
JP 02-198595 8/1990
JP 2-239894 A 9/1990
JP 239894 9/1990
JP 04-158896 1/1992
JP 04-158896 A 1/1992
JP 5-23493 2/1993
JP 5-23493 A 2/1993
JP 10-235088 9/1998
JP 11-115033 4/1999
JP 1999-226290 8/1999
JP 2000-093697 4/2000
JP 2000-176192 6/2000
JP 2000-176192 A 6/2000
JP 20000176192 6/2000
JP 2002181306 A * 6/2002
JP 2003-019382 1/2003
JP 2003-19382 A 1/2003
JP 2003019382 A * 1/2003
JP 2003-093775 4/2003
JP 2003-93775 A2 4/2003
JP 2003-0311084 A 11/2003
JP 311084 A 11/2003
JP 2003311084 11/2003
KR 93-19820 9/1993
KR 10-19960014251 10/1996
KR 10-1997-0070295 A 11/1997
KR 10-1998-0026340 7/1998
KR 10-0172877 B1 5/1999
KR 10-2002-0057119 7/2002
KR 10-2003-0020940 3/2003
KR 2003-043011 6/2003
KR 10-2004-0088884 A 10/2004

| | | | |
|---|---|---|---|
| KR | 10-2005-0015758 | A | 2/2005 |
| KR | 10-2005-0017489 | A | 2/2005 |
| KR | 10-2005-0017490 | A | 2/2005 |
| KR | 10-2005-0042127 | A | 5/2005 |
| KR | 10-2005-0045968 | A | 5/2005 |
| SU | 1669724 | | 8/1991 |
| WO | WO 97/15709 | A1 | 5/1997 |
| WO | WO 97/20493 | | 6/1997 |
| WO | WO 97/20493 | A1 | 6/1997 |
| WO | WO 03-012185 | | 2/2003 |
| WO | WO 03-0125185 | A2 | 2/2003 |
| WO | WO 03/055373 | | 7/2003 |
| WO | WO 03-055373 | A1 | 7/2003 |
| WO | WO 03055373 | | 7/2003 |

OTHER PUBLICATIONS

Electronic translation of JP 2002-181306.*

* cited by examiner

WASHING APPARATUS AND CONTROL METHOD THEREOF

This application claims the benefit of the Korean Application Nos. P2003-77592 filed in Korea on Nov. 04, 2003, and P2003-77593 filed in Korea on Nov. 04, 2003, and P2003-77594 filed in Korea on Nov. 04, 2003, and P2003-77595 filed in Korea on Nov. 04, 2003, and P2003-77596 filed in Korea on Nov. 04, 2003, and P2003-77597 filed in Korea on Nov. 04, 2003, and P2003-81084 filed in Korea on Nov. 17, 2003, and P2003-81085 filed in Korea on Nov. 17, 2003, which are hereby incorporated by reference.

BACKGROUND OF THE INVENTION

1. Field of the Invention

The present invention relates to a washing apparatus, and more particularly, to a washing apparatus and control method thereof, by which laundry can be dry-cleaned.

2. Discussion of the Related Art

Generally, washing apparatuses include a washing machine, a laundry dryer, and a washer/dryer.

The washing machine is to perform washing on various kinds of laundries. The laundry dryer is to perform drying on a washing-completed wet laundry. And, the washer/dryer is to perform both of the washing and the drying.

Yet, the washing apparatuses such as the washing machine, laundry dryer, washer/dryer, and the like carries out the general washing and/or drying on the laundry.

Namely, a general washing apparatus as a home appliance is unable to perform such a special washing as dry cleaning.

Recently, a separate dry-cleaning kit is provided to enable a general laundry dryer to carry out laundry dry cleaning, thereby enabling home dry cleaning.

The dry-cleaning kit is provided with a wet pad cloth diffusing a prescribed amount of steam and fragrance in case of being heated, a package bag packing a prescribed amount of laundry and the wet pad cloth, a filth remover for removing filth of laundry manually, and a filth-absorbing pad.

A process of carrying out dry cleaning using the dry-cleaning kit is explained as follows.

First of all, the filth-absorbing pad is put beneath a filth-adhering portion of a laundry. And, the filth remover is coated on the filth-adhering portion of the laundry.

In doing so, the filth adhering to the laundry migrates into the filth-absorbing pad to perform the filth removal of the laundry.

Subsequently, the filth-removed laundry is put within the package bag together with the wet pad cloth. Having been sealed up, the package bag is put in a laundry dryer.

The laundry dryer is then operated to provide hot air or heat to a drum.

In doing so, the hot air evaporates the water and fragrance involved in the wet pad cloth within the package bag to refresh the laundry within the package bag.

However, the related art laundry dry-cleaning process should be provided with the dry-cleaning kit.

Namely, it is impossible for the laundry dryer itself to perform dry cleaning without the dry-cleaning kit.

Moreover, the package bag configuring the dry-cleaning kit has a very small capacity enabling to hold 3~4 suits therein for dry cleaning.

Hence, the dry-cleaning kit can save a little cost for dry cleaning.

And, a material forming the package bag of the dry-cleaning kit should be carefully selected.

For instance, if the package back is perforated, it is unable to use the package bag. And, the material forming the package bag should be heat-resistant not to be melted at high temperature.

Moreover, the wet pad cloth of the dry-cleaning kit is put in a specific area within the package bag together with the laundry, thereby being sectionally contacted with the laundry.

Namely, since the position of the wet pad cloth is not changed despite the rotation of the drum, dry cleaning is carried out on a sectional portion of the laundry, where the wet pad cloth was initially inputted, only.

Besides, a drum type washing machine unnecessarily wastes water in washing a small amount of laundry or a less filthy laundry. In doing so, the drum type washing machine needs the same operational time of a general washing process, thereby wasting power consumption as well.

SUMMARY OF THE INVENTION

Accordingly, the present invention is directed to a washing apparatus and control method thereof that substantially obviate one or more problems due to limitations and disadvantages of the related art.

An object of the present invention is to provide a washing apparatus and control method thereof, by which laundry can be dry-cleaned and by which dry cleaning can be simultaneously performed on a great quantity of laundry.

Another object of the present invention is to provide a washing apparatus and control method thereof, by which water and power consumptions are reduced to the minimum extent.

Another object of the present invention is to provide a washing apparatus and control method thereof, by which a laundry is prevented from being wetted by water provided for dry cleaning as possible as it can be.

A further object of the present invention is to provide a washing apparatus and control method thereof, by which dry cleaning can be carried out on a great quantity of laundries without using a separate dry-cleaning kit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing apparatus according to the present invention includes a body forming an exterior of the washing apparatus, a drum rotatably provided within the body, and at least one or more wet pad cloths loaded within the drum to diffuse prescribed quantities of moisture and fragrance in case of receiving heat of high temperature.

In another aspect of the present invention, a method of controlling a washing apparatus includes a wet pad cloth providing step of providing at least one or more wet pad cloths including prescribed amounts of moisture and fragrance with a drum and a dry-cleaning step of providing heat of high temperature to the at least one or more wet pad cloths and rotating the drum in case of a control occurrence for dry cleaning.

In another aspect of the present invention, a washing apparatus includes a body forming an exterior of the washing apparatus, a drum rotatably provided within the body, and at least one steam providing unit for diffusing steam into the drum.

In another aspect of the present invention, a method of controlling a washing apparatus includes a steam generating step of generating steam by heating water in a steam providing unit, a steam spray step of spraying the generated steam into a drum, and a steam discharge step of discharging the steam reaming in the drum outside the drum after completion of dry cleaning.

In another aspect of the present invention, a washing apparatus includes a body forming an exterior of the washing apparatus, an outer tub provided within the body, a drum rotatably provided within the outer tub, a water supply pipe for supplying water to the outer tub, and a detergent supplying unit for spraying a dry-cleaning detergent into the drum.

In another aspect of the present invention, a method of controlling a washing apparatus includes a detergent spray step of spraying a dry-cleaning detergent over a laundry inputted to a drum to separate filth from the laundry, a water spray step of spraying a small amount of water into the drum to remove the filth separated from the laundry, and a laundry drying step of providing hot and dry air to the drum to dry the laundry.

In another aspect of the present invention, a washing apparatus includes a body forming an exterior of the washing apparatus, an outer tub provided within the body, a drum rotatably provided within the outer tub and having a multitude of perforated holes on a circumference, a water heater provided to a bottom part within the outer tub, and a water supply pipe connected to a portion in the vicinity of a space having the water heater provided thereto within the outer tub to guide a water supply flow of water.

In another aspect of the present invention, a method of controlling a washing apparatus includes a water supply step of supplying water to a bottom space within an outer tub via a water supply pipe in case of executing an operation for dry cleaning, a temperature sensing step of sensing a temperature variation via a temperature sensor, and a heat generation control step of stopping supplying the water and driving a water heater to generate heat if a value of the sensed temperature variation exceeds a reference value.

In another aspect of the present invention, a washing apparatus includes a body forming an exterior of the washing apparatus, an outer tub provided within the body, a drum rotatably provided within the outer tub and having a multitude of perforated holes on a circumference, a water heater provided to a bottom part within the outer tub, a water supply pipe for guiding a water supply flow of water, a sensing unit provided between the water heater and the drum to be short-circuited if a level of the water exceeds a predefined water level, and a controller for controlling a water supply according to whether the sensing unit is short-circuited.

In another aspect of the present invention, a method of controlling a washing apparatus includes a water supply step of supplying water to a bottom space within an outer tub via a water supply pipe in case of executing an operation for dry cleaning, a short circuit check step of checking whether a short circuit of an electrode sensor occurs by the supplied water, and a heat generation control step of stopping supplying the water and driving a water heater to generate heat if short circuit of an electrode sensor occurs.

In another aspect of the present invention, a washing apparatus includes a body forming an exterior of the washing apparatus, an outer tub provided within the body, a drum rotatably provided within the outer tub and having a multitude of perforated holes on a circumference, a water heater provided to a bottom part within the outer tub, a water supply pipe connected to a circumference of the bottom part of the outer tub to guide a water supply flow of water, a drying duct having one end connected to the circumference of the bottom part of the outer tub and the other end connected to an upper circumference of the outer tub to supply hot air to the outer tub, a drying heater provided within the drying duct, and a cooling water supply pipe connected to a pipe path of the drying duct to provide a small amount of cooling water.

In another aspect of the present invention, a method of controlling a washing apparatus includes a water supply step of supplying water to a bottom space within an outer tub via a water supply pipe in case of executing an operation for dry cleaning, a cooling water supply step of if a level of the supplied water reaches a predefined first water level, stopping supplying the water via the water supply pipe and supplying a small amount of cooling water via a cooling water supply pipe, a water supply stop step of if the level of the supplied water reaches a predefined second water level, stopping supplying the cooling water via the cooling water supply pipe, and a steam generation step of driving a water heater to generate steam in case of completion of either the cooling water supply step or the water supply stop step.

In another aspect of the present invention, a washing apparatus includes a body forming an exterior of the washing apparatus, an outer tub provided within the body, a drum rotatably provided within the outer tub and having a multitude of perforated holes on a circumference, and at least one steam providing unit for providing a prescribed amount of steam to an inside of the drum.

In another aspect of the present invention, a method of controlling a washing apparatus includes a detergent spray step of spraying a dry-cleaning detergent over a laundry inputted to a drum and a steam providing sep of providing steam to an inside of a drum by operating a steam providing unit.

In another aspect of the present invention, a washing apparatus includes a body forming an exterior of the washing apparatus, a drum rotatably provided within the body, a steam providing unit for providing a prescribed amount of steam toward an inside of the drum, and a laundry rack detachably provided to the inside of the drum to place a laundry thereon.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
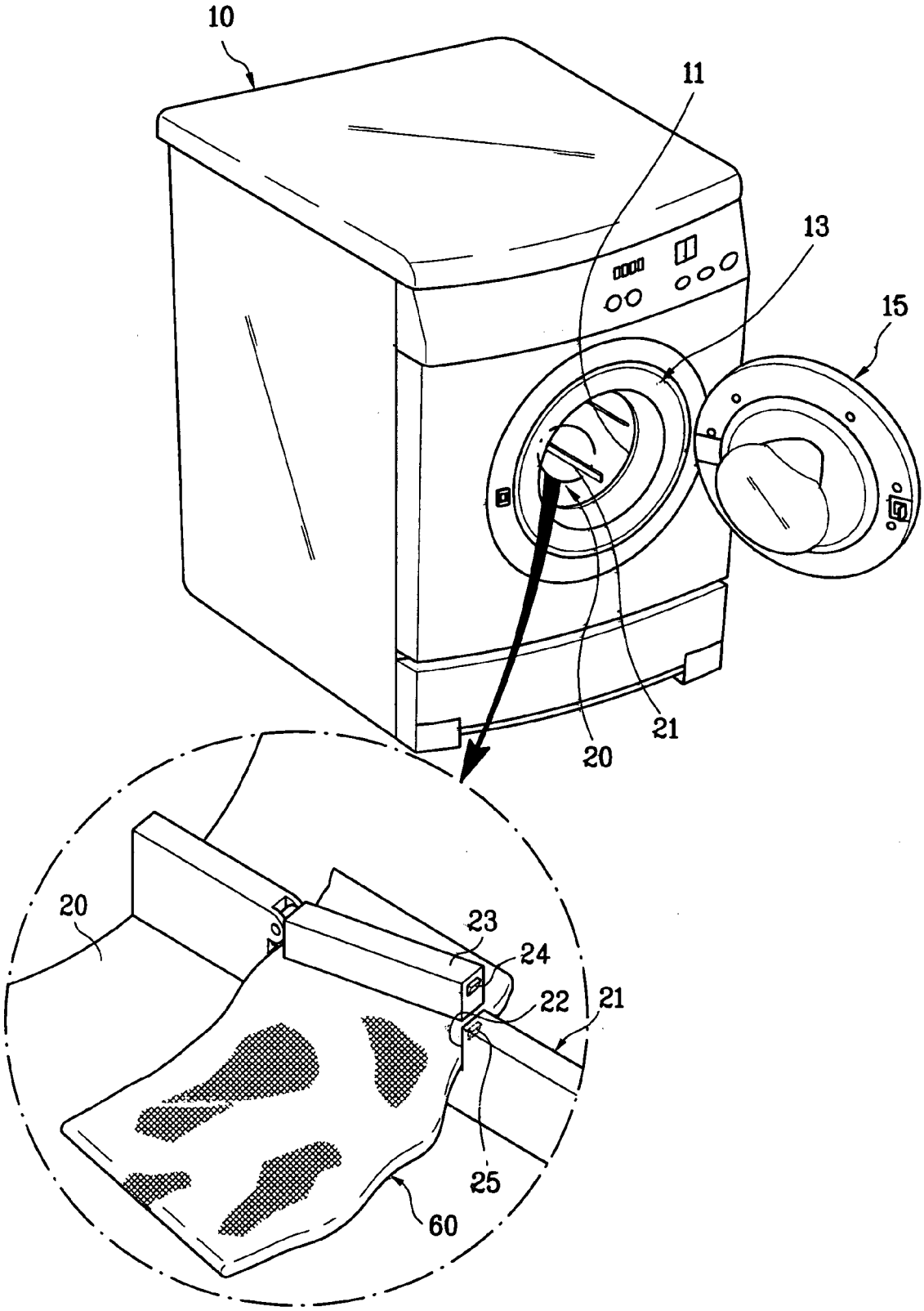
FIG. 1 is a perspective diagram of a washing apparatus according to a first embodiment of the present invention.

Reference will now be made in detail to the preferred embodiments of the present invention, examples of which are illustrated in the accompanying drawings. Wherever possible, the same reference numbers will be used throughout the drawings to refer to the same or like parts.

First of all, a washing apparatus according to a first embodiment of the present invention is to collectively carry out dry cleaning on a great quantity of laundries using a wet pad cloth of a dry-cleaning kit only.

In this case, the washing apparatus according to the present invention includes a general washing machine, a washer/dryer, or a laundry dryer. In the first embodiment of the present invention, the washing apparatus includes the laundry dryer for example.

FIGS. 1 to 5 show a washing apparatus according to a first embodiment of the present invention.

Referring to FIGS. 1 to 5, a washing apparatus according to a first embodiment of the present invention includes a body 10, a drum 20, and a wet pad cloth 60.

The body 10 forms an exterior of the washing apparatus. An entrance 11 for laundry input/output is provided to a front side of the body 10. And, a rim 13 is provided to the entrance 11.

The entrance 11 is open/closed by a door 15.

Figure 2:
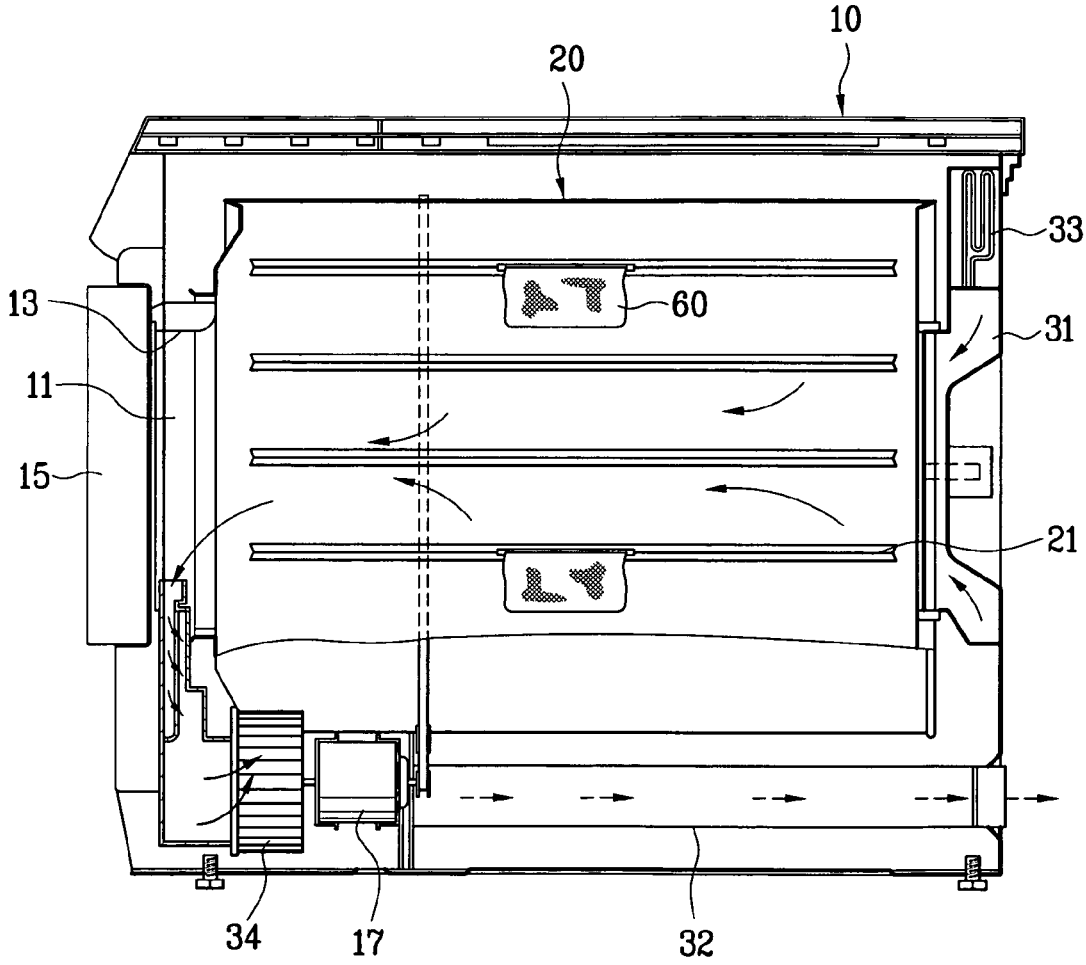
FIG. 2 is a cross-sectional diagram of a washing apparatus according to a first embodiment of the present invention.
Figure 3:
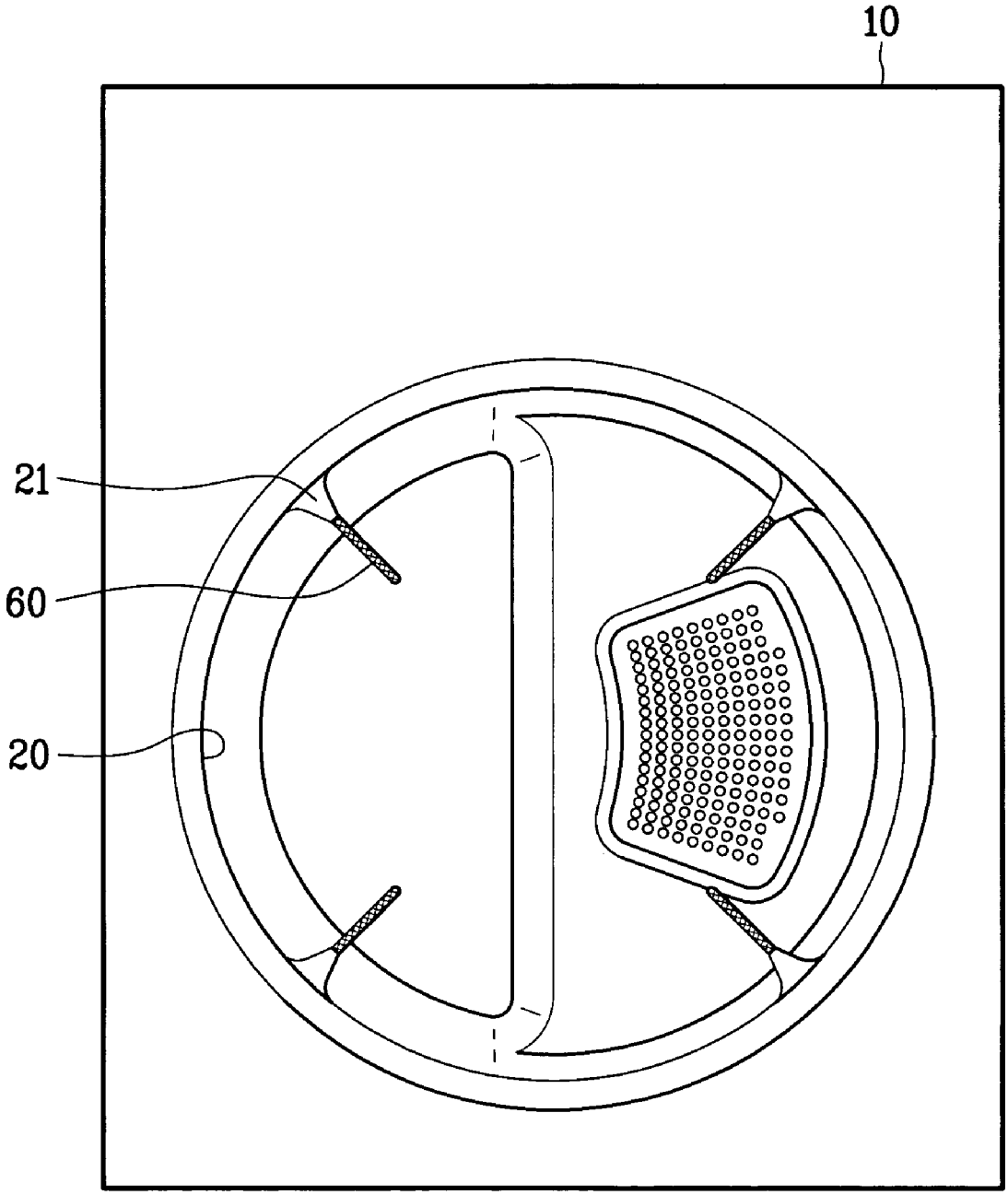
FIG. 3 is a front diagram of an interior of a washing apparatus according to a first embodiment of the present invention.

A motor 17 for rotating the drum 20, as shown in FIG. 2, is provided to an inside bottom part of the body 10.

A hot air supply pipe 31 for a hot air flow and a hot air discharge pipe 32 for discharging a hot air flowing in the drum 20 are provided within the body 10.

A drying heater 33 is provided to the hot air supply pipe 31, and a blower fan 34 is provided to the hot air discharge pipe 32.

The drum 20 is rotatably provided within the body 10, and an opening for the laundry input/output is provided toward the entrance 11.

At least one agitation piece 21 is provided to an inner wall of the drum 20 to agitate a laundry for smooth drying.

The wet pad cloth 60 is provided within the drum 20.

The wet pad cloth 60 contains moisture and fragrance inside to diffuse them in case of being heated.

At least one or more wet pad cloths 60 are preferably provided.

Specifically, the wet pad cloth 60 is preferably formed of a material enabling various kinds of filth attached to the laundry to be smoothly transferred.

Preferably, the wet pad cloth 60 is detachably provided to the agitation piece 21.

For this, a loading part is provided to the agitation piece 21 to install the wet pad cloth 60. The loading part includes a loading recess 22 and a fixing holder 23.

The loading recess 22 having a prescribed height is recessed from a surface of the agitation piece 21 to allow one end of the wet pad cloth 60 to be fitted therein. And, the fixing holder 23 is assembled to the loading recess 22 to fix the wet pad cloth 60 thereto and to open/close the loading recess 22.

In doing so, one end of the fixing holder 23 is hinge-coupled to the loading recess 22 and a hook 24 is provided to the other end of the fixing holder 23 to be hooked in the loading recess 22.

A hanging recess 25 is provided to a corresponding portion of the loading recess 22 to catch the hook 24.

Alternatively, the hook may protrude from the loading recess 22 and the hanging recess can be provided to the fixing holder 23. Alternatively, hooks are provided to both ends of the fixing holder 23 and hanging recesses are formed to both sides of the loading recess 22 confronting the corresponding hooks, respectively.

Figure 4:
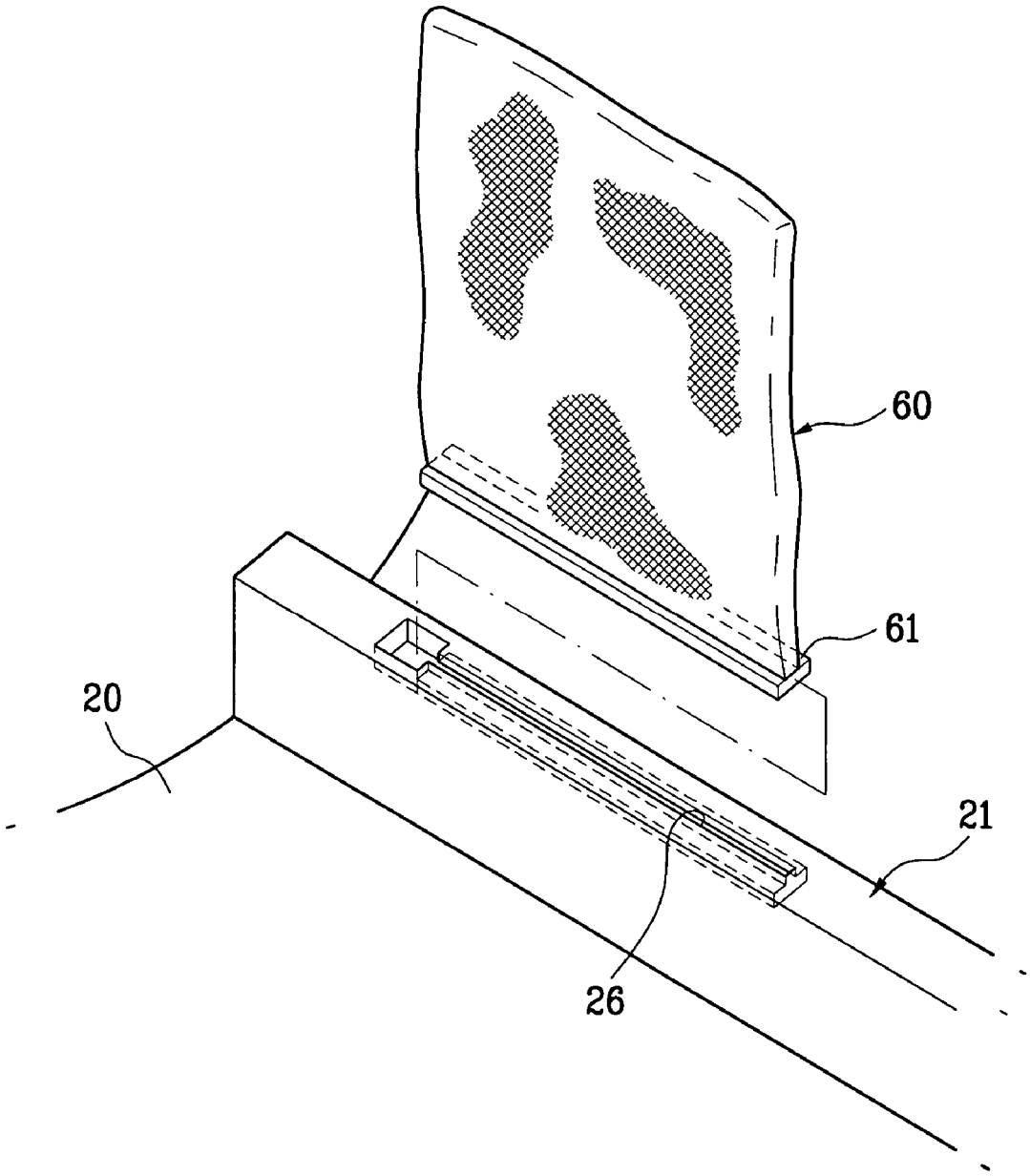
FIG. 4 is a projected perspective diagram of a wet cloth pad.

Alternatively, a guide 61, as shown in FIG. 4, is provided in one body to one end of the wet pad cloth 60 and a fitting recess 26 is provided to a topside of the agitation piece 21 so that the guide 61 can be fitted therein.

In the configuration of the washing apparatus according to the first embodiment of the present invention, the drum 20 is hermetically sealed from an external environment so that dry cleaning can be performed within an entire inner space of the drum 20.

Hence, it is able to collectively carry out dry cleaning on a great quantity of laundries.

The dry cleaning means a series of cycles for refreshing the laundries. Yet, the dry cleaning may include a series of cycles for removing various kinds of filth from the laundries.

Specifically, as the position of the wet pad cloth 60 is changed according to a rotation of the drum 20, the wet pad cloth 60 evenly comes into contact with the entire laundries to enhance a dry-cleaning effect.

This is because the filth of the laundries can be smoothly transferred to the wet pad cloth 60 frequently coming into contact with the laundries and because the steam and fragrance can be evenly provided to the laundries overall.

A process of controlling a washing apparatus according to the first embodiment of the present invention is explained as follows.

First of all, if a user intends to initiate an operation of dry cleaning, the wet pad cloth 60 is loaded in the loading recess 22 of each of the agitation pieces 21 within the drum 20.

In doing so, the number of the wet pad cloths 60 to be loaded preferably depends on a quantity of the laundry to be dry-cleaned.

For instance, in case of intending to dry-clean 3~4 suits, one wet pad cloth 60 is loaded. In case of intending to dry-clean 4~6 suits, two wet pad cloths 60 are loaded. In case of intending to dry-clean at least six suits, three wet pad cloths 60 are loaded. Preferably, the number of the wet pad cloths 60 to be loaded depends on the quantity of the laundry.

Preferably, in case of intending to load at least two wet pad cloths 60, the wet pad cloths 60 are symmetrically provided to confronting sites, top and bottom sites, or right and left sites within the drum 20 so that the steam and fragrance can be evenly diffused within the drum 20 overall.

Having been loaded in the loading recesses 22 of the agitation pieces 21, the wet pad cloths 60 are fixed thereto by the fixing holders 23, respectively. Thus, the wet pad cloths 60 can be prevented from being separated from the loading recesses 22 during rotation of the drum 20, respectively.

After the above-explained state has been set up, the laundry to be dry-cleaned is put in the drum 20 and the door 15 is closed. Once an operation mode for dry cleaning is selected, the drying heater 33 and the blower fan 34 are driven to supply hot air or heat to the drum 20.

Namely, an external air is introduced into the body 10 via the hot air supply pipe 31 while the blower fan 34 is rotated. In doing so, the introduced air is passed through the drying heater 33 generating heat to be heated at high temperature. Hence, the heated air, i.e., hot air, is forcibly sucked into the drum 20 via the hot air supply pipe 31.

In doing so, the hot air introduced in the drum 20 makes the respective wet pad cloths 60 diffuse the fragrance and steam. Specifically, as the drum 20 is being rotated, the fragrance and steam diffused from the respective wet pad cloths 60 can be evenly provided to the drum 20 overall.

Hence, the laundry within the drum 20 is provided with the fragrance and steam diffused from the respective wet pad cloths 60 to be dry-cleaned.

As the drum 20 is being rotated during the above process, the laundry within the drum 20 is repeatedly lifted to fall within the drum 20 by the rotation of the drum 20 and the friction with the respective agitation pieces 21.

In doing so, the laundry repeating to be lifted to fall comes into contact with the wet pad cloths 60 loaded on the agitation pieces 21, whereby various kinds of filth attached to the laundry are transferred to the respective wet pad cloths 60.

As the drum 20 stops operating after completion of a series of the above processes, the laundry is pulled out of the drum 20 and the used wet pad cloths 60 are unloaded from the agitation pieces 21, respectively. Thus, the dry cleaning is completed.

Of course, in case of intending to keep performing dry cleaning on another laundry, new wet pad cloths 60 are loaded on the corresponding agitation pieces 21, respectively to execute a series of the aforesaid processes.

Figure 5:
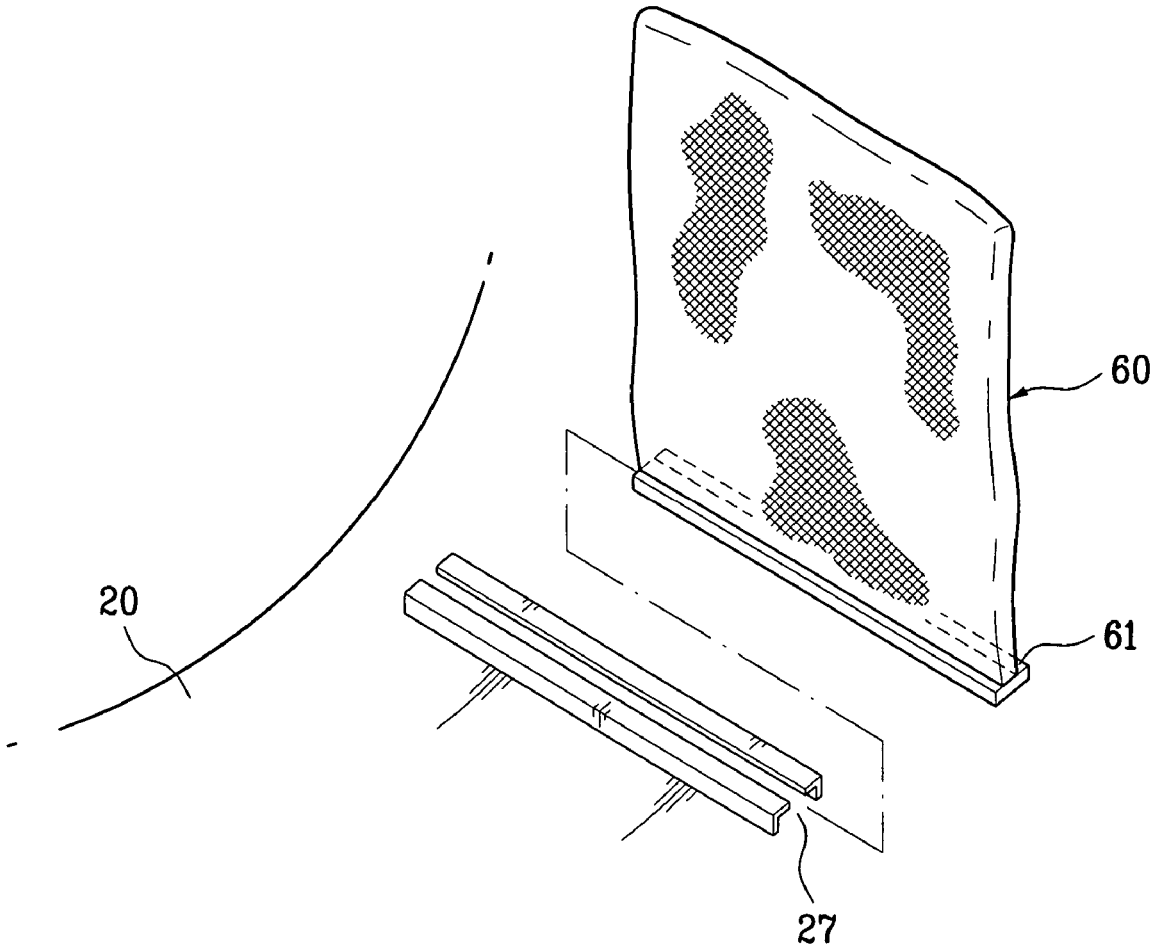
FIG. 5 is a projected perspective diagram of another wet cloth pad of a washing apparatus according to a first embodiment of the present invention.

Meanwhile, FIG. 5 is a projected perspective diagram of another wet cloth pad of a washing apparatus according to a first embodiment of the present invention.

Referring to FIG. 5, the wet pad cloth 60 is loaded on an inner wall of the drum 20 instead of the agitation piece 21.

For this, a loading part is provided to the inner wall of the drum 20 to make the wet pad cloth 60 detachable.

In doing so, the loading part may include the same loading recess 22 and fixing holder 23 of the first embodiment of the present invention. Yet, considering the drum 20 is made of metal, the loading part has difficulty in forming the loading recess 22.

Preferably, a guide 61 is provided in one body to one end of the wet pad cloth 60 and a receiving part 27 is provided to the inner wall of the drum 20.

In doing so, the receiving part 27 is formed in a manner of protruding from two portions of the inner wall to be bent, thereby having a rail shape.

Alternatively, although not shown in the drawing, a portion of the inner wall of the drum 20 is concavely bent to form a rail type receiving part 27.

Figure 6:
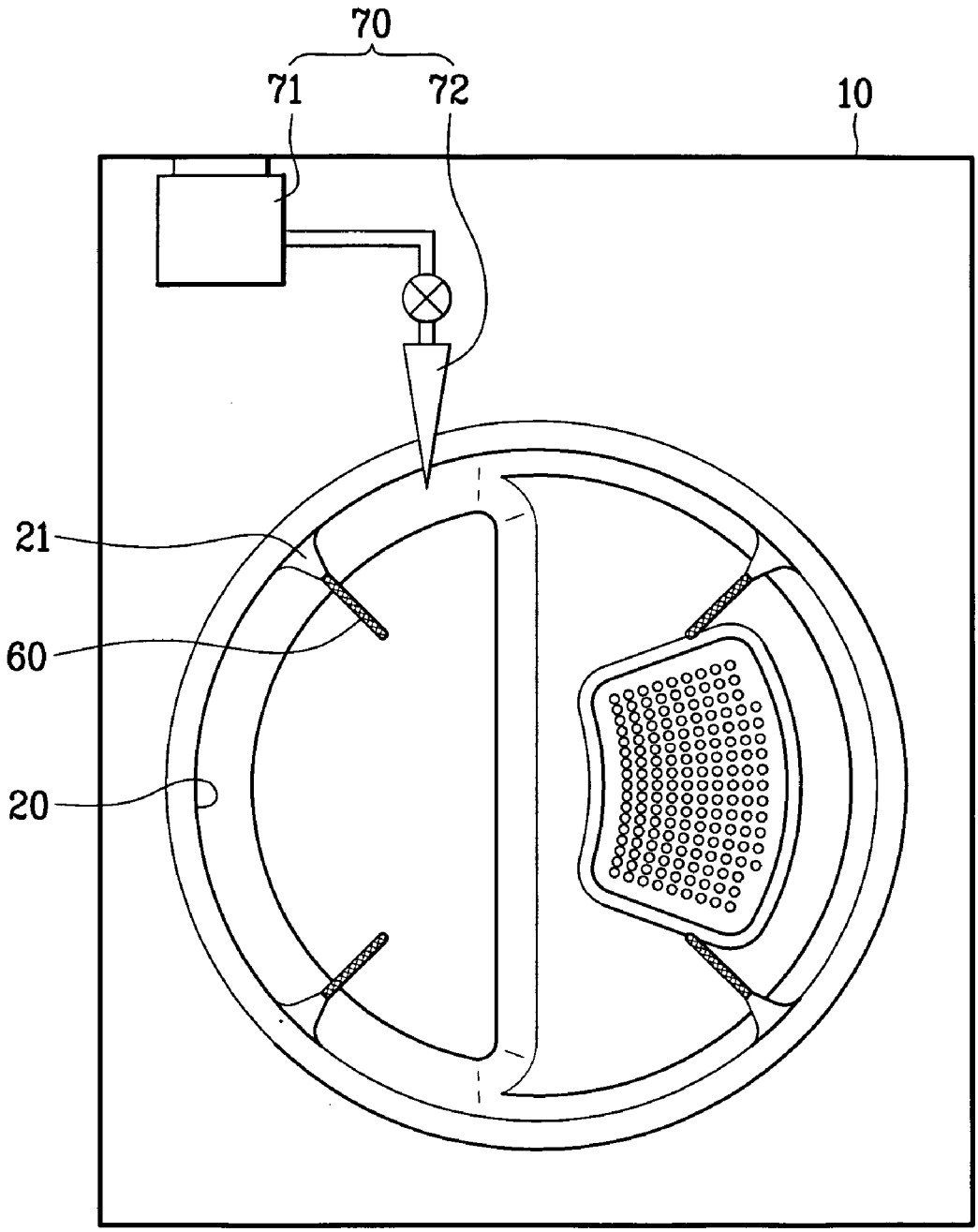
FIG. 6 is a front diagram of an interior of a washing apparatus according to a second embodiment of the present invention.

FIG. 6 is a front diagram of an interior of a washing apparatus according to a second embodiment of the present invention.

A second embodiment of the present invention includes the elements of the first embodiment of the present invention and further includes a separate fragrance spraying unit 70.

The fragrance spraying unit 70 enables to additionally provide fragrance for dry cleaning to the drum 20.

Even if the fragrance is diffused from the wet pad cloth 60, the diffused fragrance from the wet pad cloth 60 fails to be evenly diffused into the laundry overall but is discharged outside via the hot air discharge pipe 32. Hence, fragrance shortage takes place.

Hence, the fragrance spraying unit 70 is preferably provided in addition.

The fragrance spraying unit 70 includes a fragrance storage box 71 for storing fragrance therein and a nozzle type fragrance spray part 72 for spraying the fragrance stored in the fragrance storage box 71 into the drum 20.

The fragrance spray part 72 may be connected to a pump or the like to forcibly jet the fragrance stored in the fragrance storage box 71 into the drum 20. Instead, the fragrance spray part 72, as shown in FIG. 6, employs a simple valve configuration to spray the fragrance by turning on/off a pipe.

Hence, a user's satisfaction for the dry cleaning is enhanced since a prescribed amount of the fragrance is additionally provided to the drum 20 from the fragrance spraying unit 70 during the operation of the dry cleaning.

Figure 7:
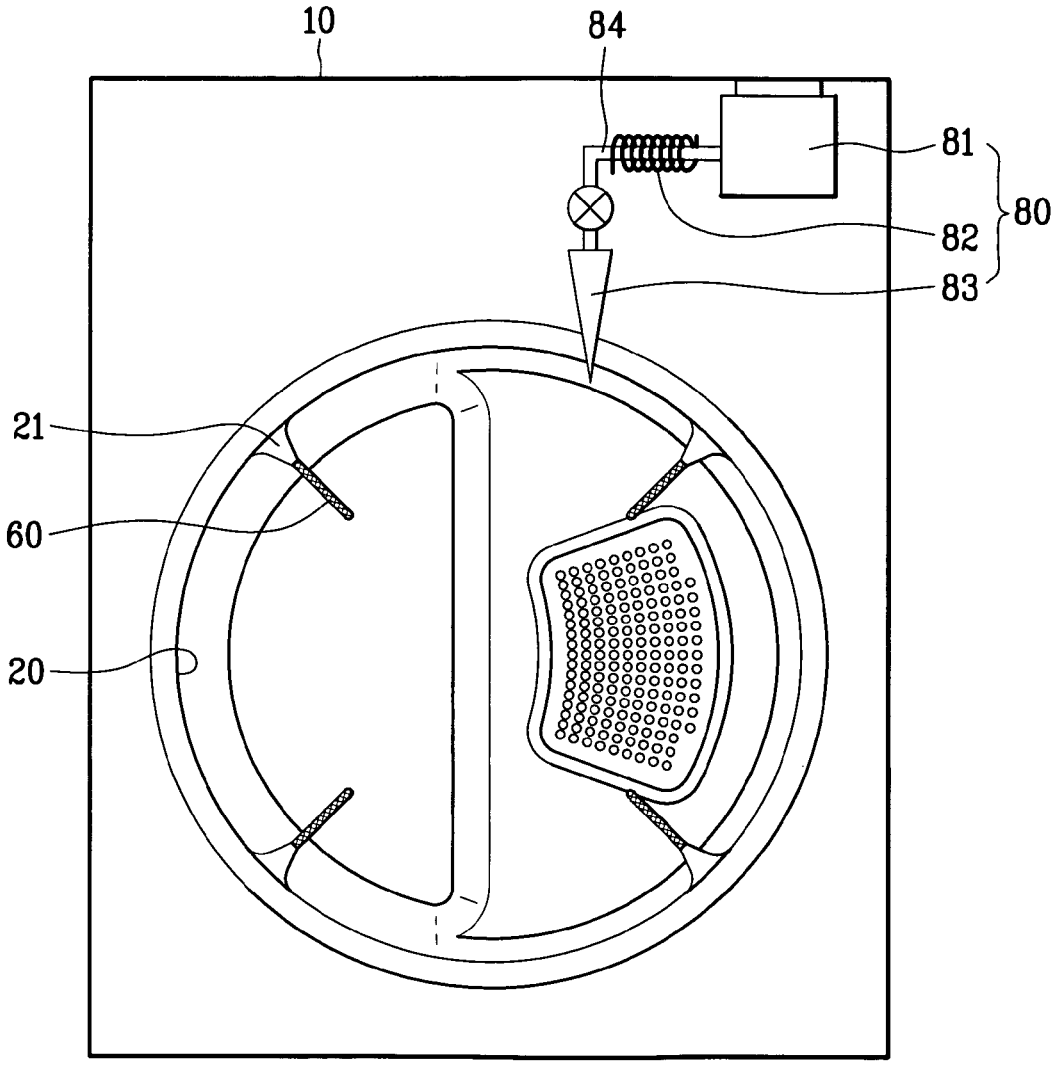
FIG. 7 is a front diagram of an interior of a washing apparatus according to a third embodiment of the present invention.
Figure 8:
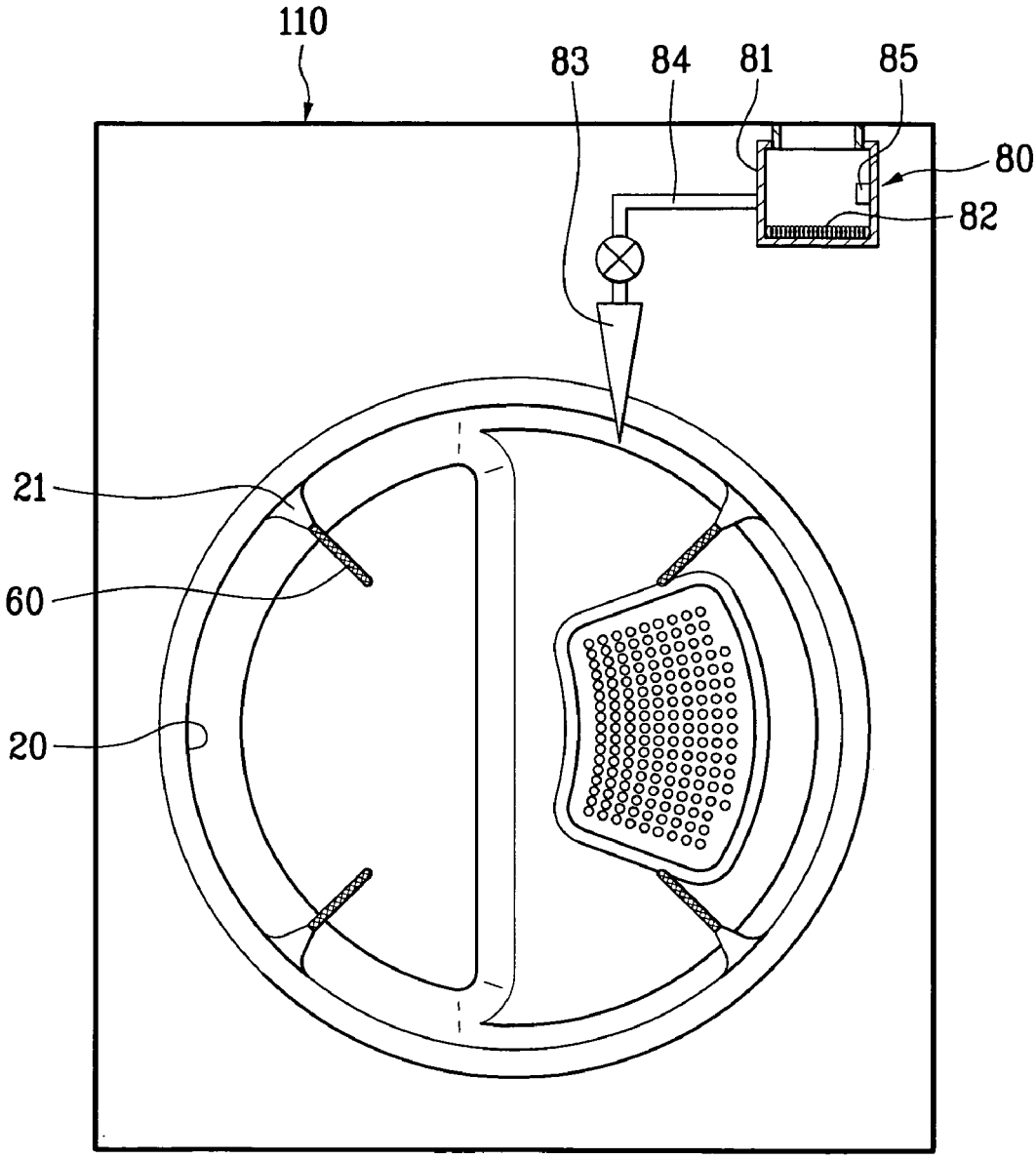
FIG. 8 is a front diagram of an interior of a washing apparatus according to a third embodiment of the present invention, in which another example of a location of a heating part is shown.

FIG. 7 and FIG. 8 schematically show an interior of a washing apparatus according to a third embodiment of the present invention.

A third embodiment of the present invention includes the elements of the first embodiment of the present invention and further includes a separate steam providing unit 80.

Even if the steam is diffused from the wet pad cloth 60, the diffused steam from the wet pad cloth 60 fails to be evenly diffused into the laundry overall but is discharged outside via the hot air discharge pipe 32. Hence, steam shortage takes place.

Hence, the steam providing unit 80 is preferably provided in addition.

The steam providing unit 80 includes a water storage part 81 for storing a prescribed amount of water therein, a heating part for generating steam by evaporating the water stored in the water storage part 81, and a nozzle type steam spray part 83 for spraying the generated steam into the drum 20.

The heating part 82 is a heater for generating heat by electricity impression. Alternatively, the drying heater 33 can be used as the heating part 82.

The heating part 82, as shown in FIG. 7, can have a configuration enabling to evaporate water flowing in a steam supply pipe 84 connecting the water storage part 81 and the steam spray part 83 by heating a portion of the steam supply part 84. Alternatively, the heating part 82, as shown in FIG. 8, can be provided within the water storage part 81.

In this case, the heating part 82 may be a coil or sheath heater.

The steam spray part 83 can be connected to a pump or the like to enable the steam, which is generated from evaporating the water flowing through the steam supply pipe 84, to be forcibly sprayed into the drum 20. Alternatively, the steam spray part 83 can employ a simple valve configuration to spray the steam by turning on/off a pipe as well.

Hence, a user's satisfaction for the dry cleaning is enhanced since a prescribed amount of the steam is additionally provided to the drum 20 from the steam providing unit 80 during the operation of the dry cleaning.

Meanwhile, if the washing apparatus is configured to enable the separate steam or fragrance supply like the second or third embodiment of the present invention, the wet pad cloths containing the steam and fragrance therein are unnecessary.

Yet, for the smooth dry cleaning of the laundry, a separate configuration enabling to remove the filth of the laundry is needed.

A washing apparatus according to a fourth embodiment of the present invention is characterized in carrying out dry cleaning smoothly without using a wet pad cloth.

This is explained with reference to FIGS. 9 to 12 as follows. In doing so, the same reference numbers will be used throughout the drawings to refer to the same or like configurations of the first to third embodiments of the present invention.

First of all, a washing apparatus according to a fourth embodiment of the present invention includes a body 10, a drum 20, and a steam providing unit 80.

The body 10 forms an exterior of the washing apparatus. An entrance 11 is provided to a front side of the body 10. And, the entrance 11 is open/closed by a door 15.

A rim 13 is provided to an inner circumference of the entrance 11 to seal up the door 15 and the entrance 11.

The drum 20 is rotatably provided within the body 10.

The steam providing unit 80 is configured to diffuse a prescribed amount of steam into the drum 20 for dry cleaning. And, at least one or more steam providing units 80 are provided.

The steam providing unit 80 includes a heating part 82 for generating steam from evaporating water by heat at high temperature, a steam supply pipe 84 for a flow of the steam, a steam spray part 83 for diffusing the steam flowing via the steam supply pipe 84 into the drum 20, and a water storage part 81 for storing a prescribed amount of water therein for generation of the steam.

The steam spray part 83 has a nozzle shape to enable smooth spray of the steam, and a steam outlet is provided within the drum 20.

Figure 9:
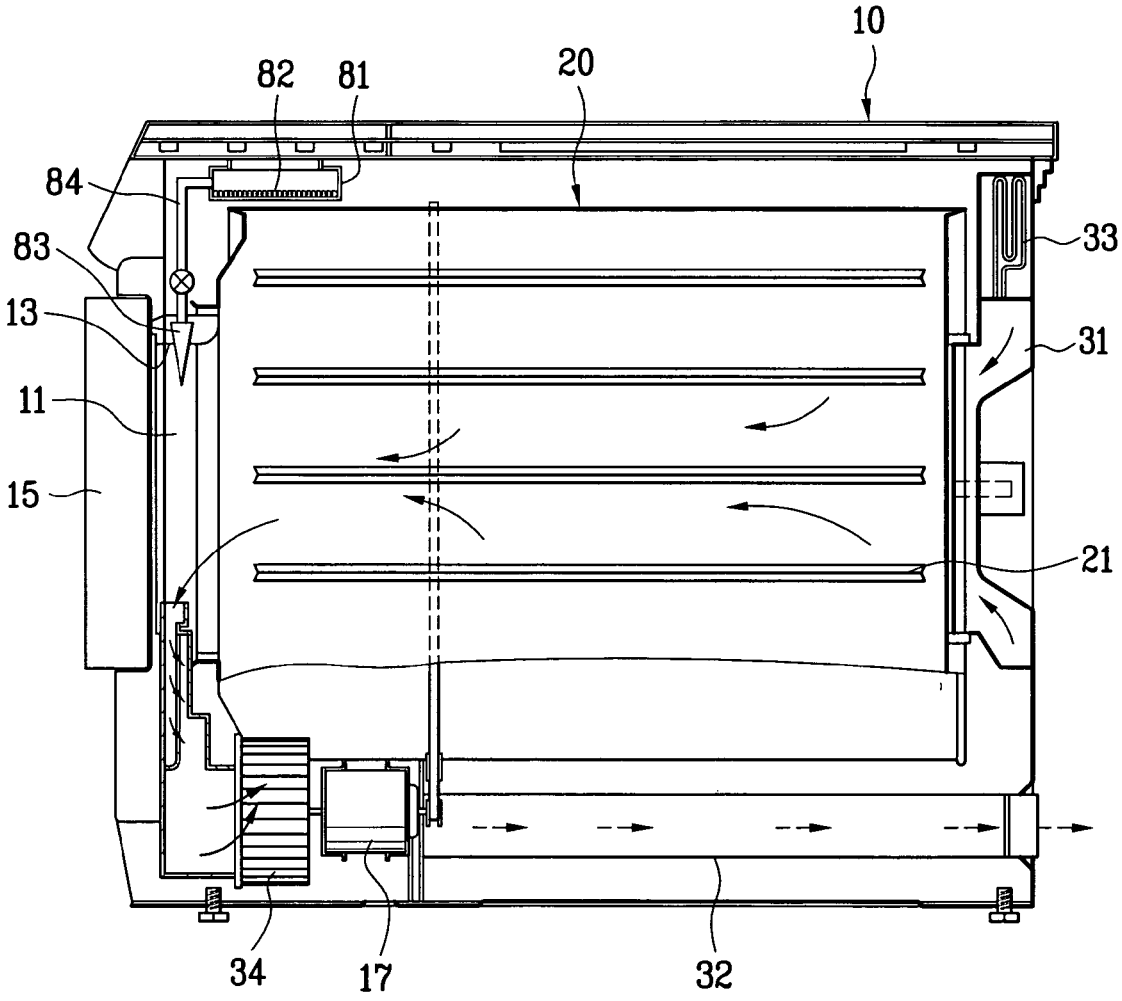
FIG. 9 is a cross-sectional diagram of a washing apparatus according to a fourth embodiment of the present invention.

Preferably, the steam outlet of the steam spray part 83, as shown in FIG. 9, is perforated into the rim 13 to be exposed to an inside of the drum 20.

The water storage part 81 is connected to a water supply valve 17 connected to a service pipe or the like to enable automatic water supply from outside.

The heating part 82 constructing the steam providing unit 80 may include a coil heater enclosing the steam supply pipe 84. Alternatively, the heating part 82, as shown in FIG. 8, is preferably provided within the water storage part 81.

Moreover, the heating part 82 preferably includes a sheath heater enabling to directly heat the water stored in the water storage part 81 for steam generation.

In case of providing the heating part 82 within the water storage part 81, it is preferable that the steam providing unit 80 further includes a water level sensor 85 for sensing a level of the water stored in the water storage part 81.

If the amount of the water stored in the water storage part 81 is insufficient, the heating part 82 may excessively generate the heat. If the amount of the water stored in the water storage part 81 is excessively sufficient, it takes a long time to evaporate the water for the steam generation. Hence, the water level sensor 85 enables to maintain a uniform level of the water stored in the water storage part 81. In this case, the uniform level is enough for the smooth steam generation.

Namely, if the water level measured by the water level sensor 85 is higher than a reference value, water supply to the water storage part 81 is cut off. If the water level measured by the water level sensor 85 is lower than the reference value, supplementary water supply to the water storage part 81 is enabled.

Figure 10:
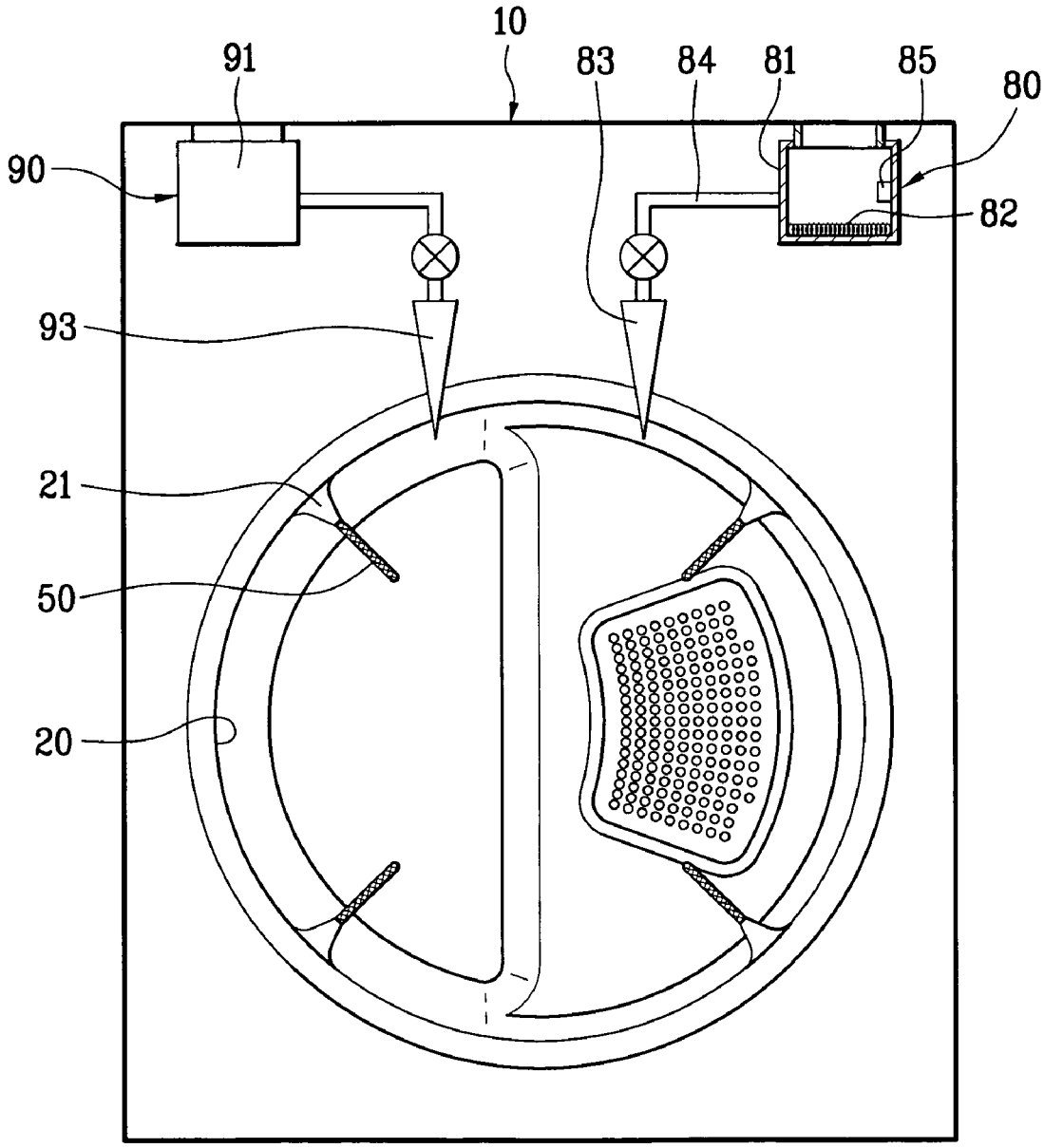
FIG. 10 is a front diagram of an interior of a washing apparatus according to a fourth embodiment of the present invention.

Preferably, the washing apparatus according to the fourth embodiment of the present invention, as shown in FIG. 10, further includes a detergent supplying unit 90 to enhance the dry cleaning effect.

Of course, the detergent supplying unit 90 is skippable. Yet, efficiency of dry cleaning without using a detergent is too low.

Hence, it is preferable that the detergent supplying unit 90 is further included to supply the detergent to the drum 20.

In doing so, the detergent is a solvent mixed with a petroleum solvent.

Preferably, fragrance is further added to the detergent to be given to the laundry to be dry-cleaned.

Namely, the dry cleaning not only refreshes the laundry but also provides the fragrance to the laundry, thereby enhancing user's satisfaction.

The detergent supplying unit 90 includes a detergent storage box 91 for storing the dry-cleaning detergent therein.

The detergent storage box 91 is provided within the body to enable detergent supplement.

And, the detergent supplying unit 90 includes a detergent spray part 93 for spraying the detergent stored in the detergent storage box 91 into the drum 20.

Preferably, a detergent outlet of the detergent spray part 93 is perforated into the rim 13 to be exposed to the inside of the drum 20 together with the steam spray part 83.

The detergent spray part 93 can be connected to a pump or the like to enable to forcibly spray the detergent into the drum 20. Alternatively, the detergent spray part 93, as shown in the drawing, can employ a simple valve configuration to spray the detergent by turning on/off a pipe as well.

Instead, the detergent provided via the detergent supplying unit 90 may include not the petroleum based solvent but the fragrance only.

Namely, although not shown in the drawing, at least one fragrance spraying unit 70 for providing the fragrance may be provided to the washing apparatus of the present invention instead of the detergent supplying unit 90.

Besides, although not shown in the drawing, the detergent supplying unit 90 and the fragrance spraying unit 70 can be separately provided to the washing apparatus of the present invention.

Figure 11:
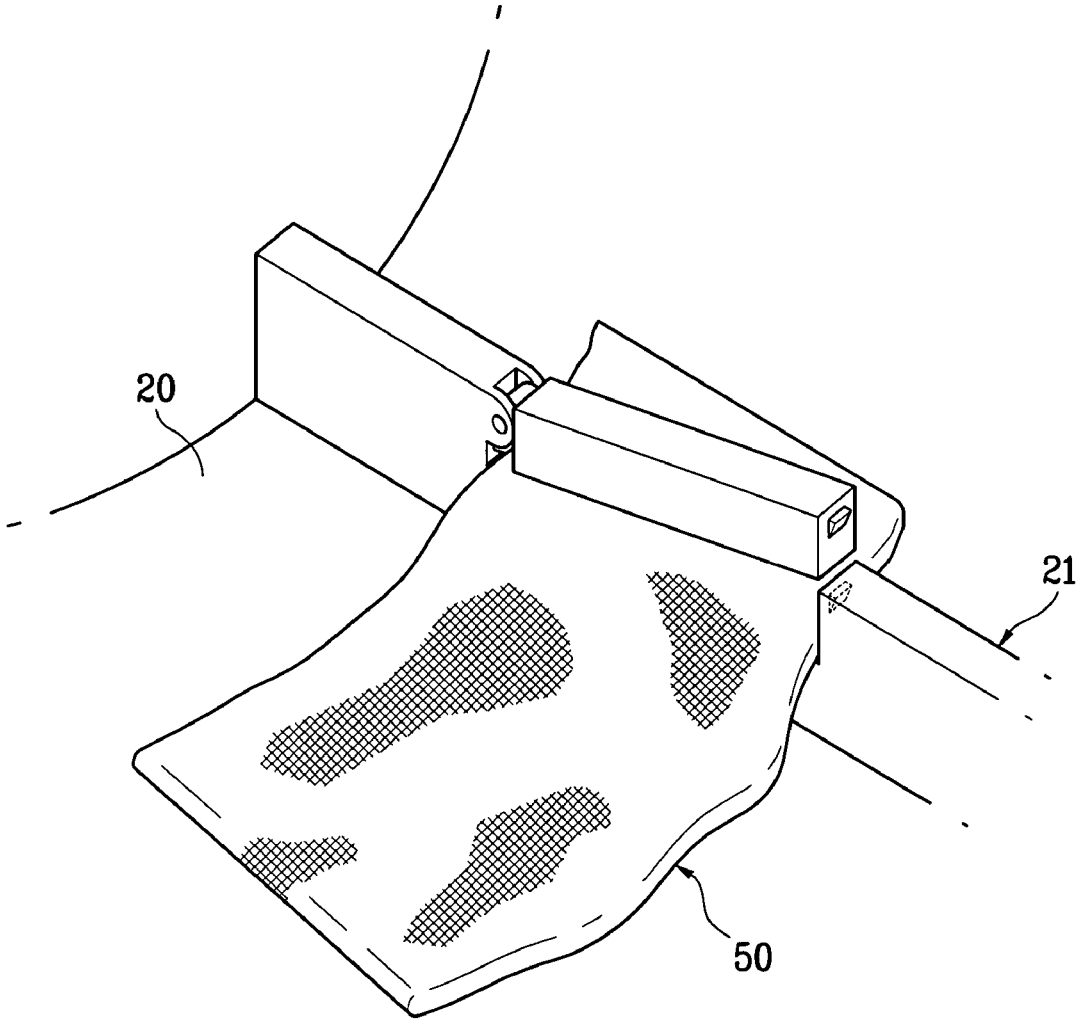
FIG. 11 is a perspective diagram of a filth transfer cloth.

Preferably, the washing apparatus according to the fourth embodiment of the present invention, as shown in FIG. 10 and FIG. 11, further includes a filth transfer cloth 50.

In this case, filth attached to the laundry to be dry-cleaned is transferred to the filth transfer cloth 50 to be removed from the laundry. Preferably, the filth transfer cloth 50 is formed of a fabric material more efficient in transferring the filth thereto than the laundry.

Specifically, the filth transfer cloth 50 may be inputted to the drum 20 operated for dry cleaning. Preferably, the filth transfer cloth 50 is detachably provided within the drum 20.

Namely, in case of being simply put in the drum 20, the filth transfer cloth 50 is raveled with the laundry in the course of the dry cleaning to play a role in transferring the filth out of a specific portion of the laundry only. Hence, in order to enable the filth transfer cloth 50 to come into contact with more portions of the laundry, it is preferable that the filth transfer cloth 50 and the laundry are separately moved.

Accordingly, the present invention is characterized in that the filth transfer cloth 50 is assembled to an inside of the drum 20.

In doing so, the filth transfer cloth 50, as proposed in the present embodiment, is loaded on the agitation piece 21 for smooth agitation of the laundry. Alternatively, the filth transfer cloth 50 can be loaded on the inner wall of the drum 20.

Figure 12:
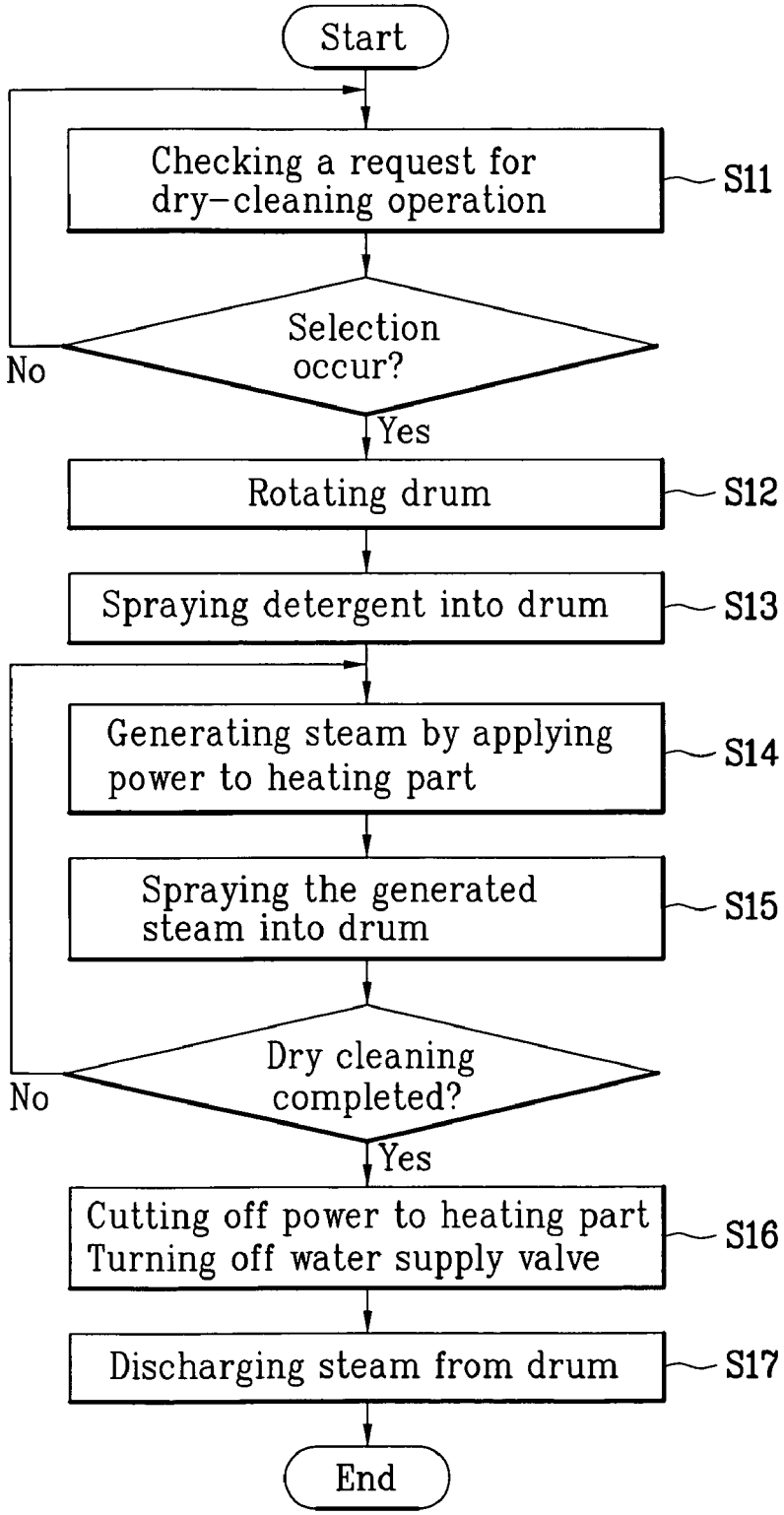
FIG. 12 is a flowchart of a method of controlling a washing apparatus according to a fourth embodiment of the present invention.

A method of controlling a washing apparatus according to the fourth embodiment of the present invention is explained with reference to a flowchart in FIG. 12 as follows.

First of all, a controller (not shown in the drawing) controlling an operation of a laundry dryer keeps checking a presence or non-presence of a request for a dry-cleaning operation (S11).

Namely, when an operation control of the laundry dryer is requested by a user, the controller decides whether the operation selected by the user is for the dry cleaning or a general laundry drying. Hence, the controller detects the presence of the request for dry cleaning.

In doing so, in case of the presence of the request for the dry-cleaning operation, the controller requests an input of the laundry to be dry-cleaned.

In such a case, the user inputs the laundry to be dry-cleaned to the drum 20, closes the door 15, and then selects a continuous execution of the dry-cleaning operation.

Preferably, in the course of inputting the laundry by the user, at least one or more filth transfer cloths 50 are loaded on the agitation pieces 21 within the drum 20, respectively.

Alternatively, after completion of loading the filth transfer cloth 50 and inputting the laundry, the user may request the dry-cleaning operation so that the controller can immediately control the various elements for the dry-cleaning operation.

Subsequently, once the dry cleaning is ready to be executed by a series of the aforesaid procedures, the drum is rotated (S13) and the detergent supplying unit 90 is controlled to supply the detergent stored in the detergent storage box 91 to the drum 20 (S13).

In doing so, as the detergent is evenly sprayed into the drum 20 overall by the detergent spray part 93, various kinds of filth are separated from the laundry by the detergent.

It can be controlled that the detergent keeps being sprayed during the execution of the dry-cleaning operation. And, it can be also controlled that the detergent stops being sprayed in case of starting to provide the steam within the drum 20.

After completion of supplying the detergent, water is supplied to the water storage part 81 and power is applied to the heating part 82 to evaporate the water. Hence, the steam is generated (S14).

In doing so, the water level sensor 85 and the water supply valve 17 closing/opening the water supply pipe, i.e., service pipe, interoperate with the controller to maintain a constant level of the water stored within the water storage part 81.

For instance, if the water level sensed by the water level sensor 85 is lower than a reference water level, the water supply valve is turned on to enable the corresponding water supply.

And, the steam generated from the above process flows via the steam supply pipe 84 to be supplied to the drum 20 via the steam spray part 83.

Hence, the steam having been supplied to the drum 20 activates the detergent involved in the laundry to separate the filth from the laundry, whereby the laundry is refreshed.

In doing so, the fragrance included in the detergent adsorbs to the laundry to remove odors of the laundry and solvent.

In the course of performing the above process, since the drum 20 is being rotated by the driven motor 17 to keep agitating the laundry within the drum 20, the filth transfer cloth 50 is moved by the rotation of the drum 20 to have the filth, which was separated from the laundry, transferred thereto as well as the overall laundry can be evenly refreshed Hence, it is able to prevent the laundry from being contaminated again by the filth separated from the laundry.

After completion of the dry cleaning through a series of the aforesaid processes, the controller turns off the water supply valve 17 as well as cuts off the power supplied to the heating part 82 (S16).

In doing so, the steam remaining within the drum 20 is discharged outside the drum 20 to protect the user from danger such as a burn caused by the high-temperature steam, which can be done by driving the blower fan 34.

Namely, the blower fan 34 is driven to rotate so that the steam within the drum 20 can be discharged outside the body 10 via the hot air discharge pipe 32.

In doing so, it is preferable to control the drying heater 33 not to generate heat. Yet, the dry-cleaned laundry can be dried by generating heat from the drying heater 33.

Once the drum 20 stops operating after completion of a series of the aforesaid processes, the laundry is pulled out and the used filth transfer cloths 50 are detached from the drum 20. Thus, the dry cleaning is completed.

Of course, in case of intending to keep performing dry cleaning on another laundry, new filth transfer cloths 50 are loaded in the drum 20, respectively to execute a series of the aforesaid processes.

Meanwhile, the washing apparatus according to the fourth embodiment of the present invention is applicable to other kinds of apparatuses as well as the laundry dryer.

Namely, the washing apparatus according to the fourth embodiment of the present invention is applicable to a washer/dryer, a general drum type washing machine, and the like.

A fifth embodiment of the present invention is characterized in applying the configuration of the fourth embodiment of the present invention to a dryer/washer.

Figure 13:
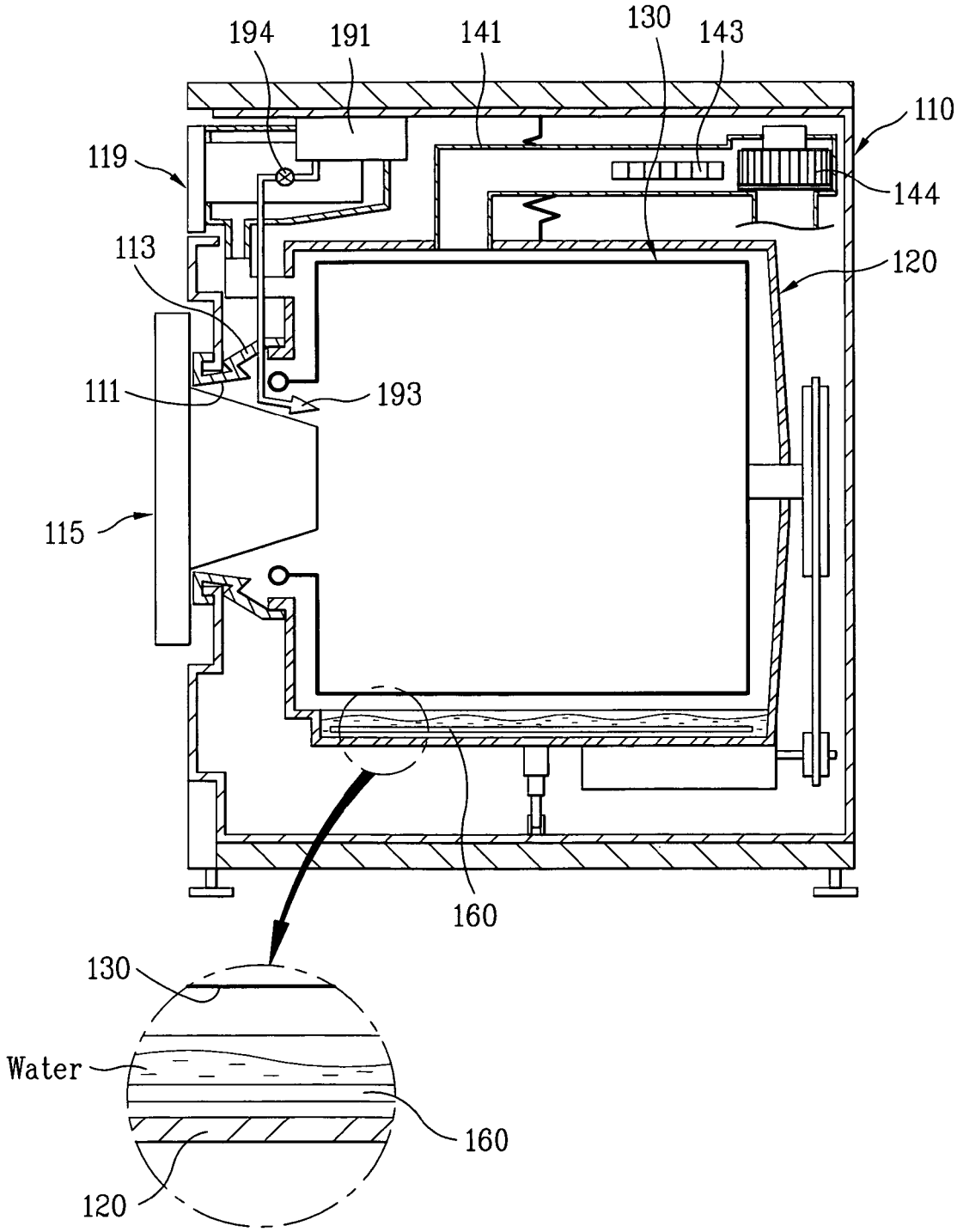
FIG. 13 is a cross-sectional diagram of a washing apparatus according to a fifth embodiment of the present invention.
Figure 14:
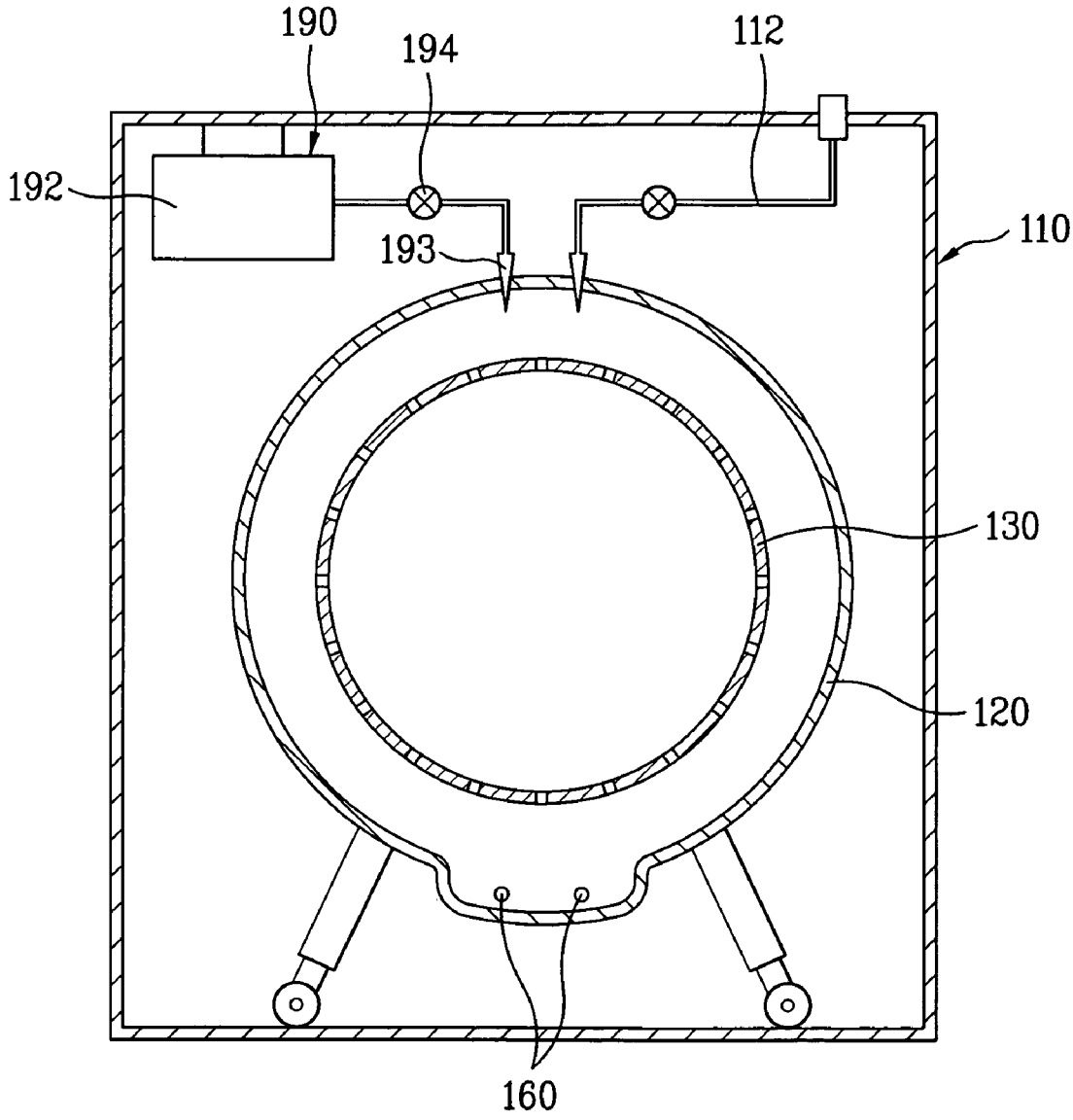
FIG. 14 is a schematic cross-sectional diagram of an interior of a washing apparatus according to a fifth embodiment of the present invention.

This is explained in detail with reference to FIG. 13 and FIG. 14 as follows.

First of all, a washing apparatus according to a fifth embodiment of the present invention includes a body 110, an outer tub 120, a drum 130, a waster supply pipe 112, and a detergent supplying unit 190.

The body 110 forms an exterior of a washer/dryer. An entrance 111 is provided to a front side of the body 110. And, the entrance 111 is open/closed by a door 115.

A rim 113 is provided to an inner circumference of the entrance 111 for seal-up between the door 115 and the entrance 111.

Within the body 110, provided are the outer tub 120 and a drying unit providing heated air to an inside of the outer tub 120.

The drying unit includes a drying duct 141, a drying heater 143 provided to a pipe of the drying duct 141, and a blower fan 144 for forcible air circulation.

An air inlet of the drying duct 141 is connected to a lateral side of the outer tub 120 and an air outlet of the drying duct 141 is connected to a topside of the outer tub 120.

The drum 130 is rotatably provided within the outer tub 120.

The water supply pipe 112 is configured to supply water to the outer tub 120. One end of the water supply pipe 112 is exposed outside the body 110 to be connected to a service pipe (not shown in the drawing).

In this case, it is preferable that a detergent box 119 storing various detergents necessary for washing is provided to the pipe path of the water supply pipe 112.

And, the detergent supplying unit 190 is configured to spray a dry-cleaning detergent into the drum 130.

The detergent supplying unit 190 includes a detergent storage box 191 for storing the dry-cleaning detergent therein and a detergent spray part 193 for spraying the detergent stored in the detergent storage box 191 in a vaporized state.

Preferably, a detergent outlet of the detergent spray part 193 is perforated into the rim 113 to be exposed to the inside of the drum 130.

The detergent spray part 193 can be connected to a pump or the like to enable to forcibly spray the detergent stored in the detergent storage box 191 into the drum 130. Preferably, the detergent spray part 193, as shown in the drawing, can employ a simple valve configuration to optionally spray the detergent via a separate valve 194.

Besides, the detergent storage box 191 and the detergent box 119 provided to the pipe path of the water supply pipe 112 can be separately provided. Alternatively, it is preferable that they are formed in one body to enhance efficiency of an overall installation space.

And, the detergent stored in the detergent storage box 191 includes a solvent mixed with a petroleum solvent. Preferably, fragrance is further added to the detergent to be given to the laundry.

Preferably, the washing apparatus according to the fifth embodiment of the present invention further includes a water heater 160.

The water heater 160 is provided to a bottom part within the outer tub 120 to generate steam by heating water.

Figure 15:
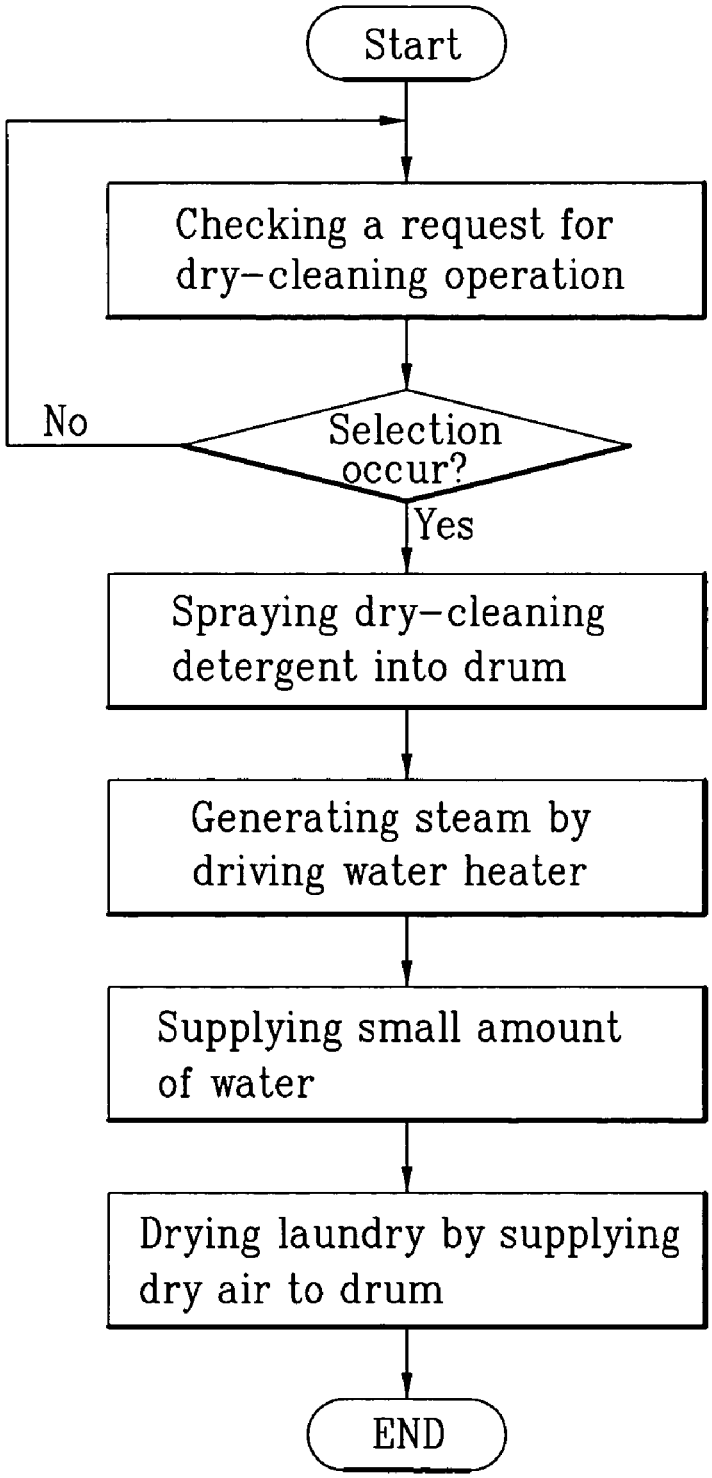
FIG. 15 is a flowchart of a method of controlling a washing apparatus according to a fifth embodiment of the present invention.
Figure 16:
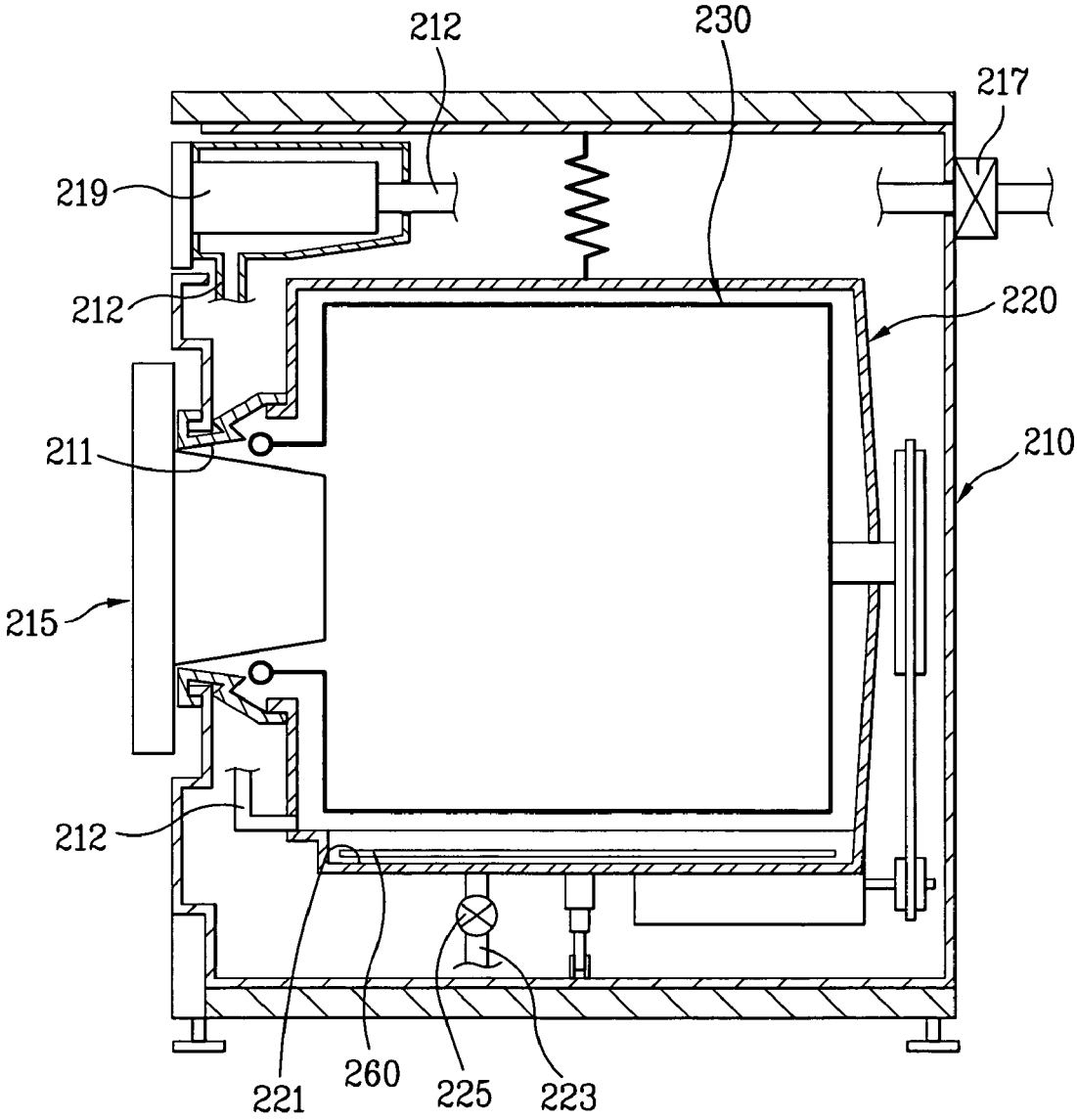
FIG. 16 is a cross-sectional diagram of a washing apparatus according to a sixth embodiment of the present invention.

A method of controlling a washing apparatus according to the fifth embodiment of the present invention is explained with reference to a flowchart in FIG. 15 as follows.

First of all, once a request for an operation of dry cleaning occurs, an input of the laundry to be dry-cleaned is requested.

After completion of inputting the laundry, a dry-cleaning operation starts.

Of course, it can be set up that the request for the dry-cleaning operation is made after completion of inputting the laundry.

Once the dry cleaning is executed, the detergent supplying unit 190 sprays the dry-cleaning detergent onto the laundry inputted to the drum 130.

Preferably, an amount of the detergent sprayed into the drum 130 is set up not to soak the laundry therein.

Preferably, by controlling the drum 130 to rotate on spraying the dry-cleaning detergent, the dry-cleaning detergent is evenly coated on the laundry overall.

In doing so, the drum 130 may keep being rotated in one rotational direction. Preferably, it is controlled to alternately repeat to rotate the drum 130, clockwise and counter clockwise.

And, various kinds of filth are separated from the laundry by chemical reaction of the dry-cleaning detergent coated on the laundry.

During the above process, the water heater 160 generates heat.

Accordingly, the water collected in the bottom part of the outer tub 120 is evaporated to generate the steam within the drum 130.

In doing so, it is preferable that the water remains in a state of being supplied prior to inputting the laundry to the drum 130. Preferably, the water was supplied at the water level not to flood the bottom part of the drum 130.

The above-generated steam activates the detergent infiltrated into the laundry to enable smooth separation of the filth.

Of course, it is preferable that a time sufficient for enabling the smooth separation of the filth from the laundry is provided after completion of the dry-cleaning detergent spray and the steam supply.

After completion of a series of the aforesaid processes, water is injected into the drum 130 via the water supply pipe 112 to remove the filth separated from the laundry.

This is to prevent the filth, which was separated from the laundry, from contaminating the laundry again.

In doing so, an amount of the water injected into the drum 130 is preferably set small not to soak the laundry.

After completion of the above process, power is supplied to the drying heater 143 and the blower fan 144 is driven, whereby hot drying air is supplied to the drum 130 via the drying duct 141 to dry the laundry.

After completion of drying the laundry, the operation for the dry-cleaning mode is terminated.

Meanwhile, since the above-explained washing apparatus according to the fifth embodiment of the present invention generated the steam by evaporating the water supplied to the bottom part within the outer tub 120, the level of the water should be maintained constant.

If the level of the water is excessively high, it is not preferable that the laundry within the drum 130 is soaked. If the level of the water is too low, it is difficult to generate the steam.

To overcome such problems, a configuration and control method for maintaining a constant level of the water supplied to the bottom part of the outer tub are provided by embodiments of the present invention, which are explained with reference to FIGS. 16 to 19 as follows.

First of all, a washing apparatus according to a sixth embodiment of the present invention includes a body 210, an outer tub 220, a drum 230, a water heater 260, and a water supply pipe 212.

The body 210 forms an exterior of the washing apparatus. An entrance 211 is provided to a front side of the body 210. And, the entrance 211 is open/closed by a door 215.

The outer tub 220 is provided within the body 210, and the drum 230 is rotatably provided within the outer tub 220.

A multitude of perforated holes 231 are formed in a circumference of the drum 230 to allow water and steam to flow into the drum 230.

The water heater 260 is provided to a bottom part within the outer tub 220 to heat the water supplied to the outer tub 220.

In doing so, a part (herein after called loading part) 221, where the water heater 260 is loaded, is provided by a concave portion of the outer tub 220 and is connected to a drainpipe 223 for draining the water after completion of washing. And, a drain valve 225 is provided to the drainpipe 223.

Specifically, the water heater 260 enables steam generation as well as operates to heat the water.

Namely, in the embodiment of the present invention, the steam for refreshing the laundry is generated using the water heater 260 instead of using a separate steam generator.

The water supply pipe 212 is a pipe path through which the water flows. The water supply pipe 212 guides to supply the water provided from the service pipe or the like via the water supply valve 217 to an inside of the outer tub 220.

In this case, a detergent box 219 for storing a detergent is provided to the pipe path of the water supply pipe 212 so that the detergent can be included in the water flowing into the outer tub 220.

The detergent box 219 is provided to an upper space within the body 210 to enable a detergent input.

In the related art, a water outlet of the water supply pipe 212 for supplying the water to a part provided with the water heater 260 is connected to the upper part of the outer tub 220, whereby the laundry to be dry-cleaned could be soaked in the supplied water. Such a problem needs to be solved.

Preferably, the water supply pipe 212 is connected to the outer tub 220 in the vicinity of the part provided with the water heater 260, i.e., the loading part 221.

Figure 17:
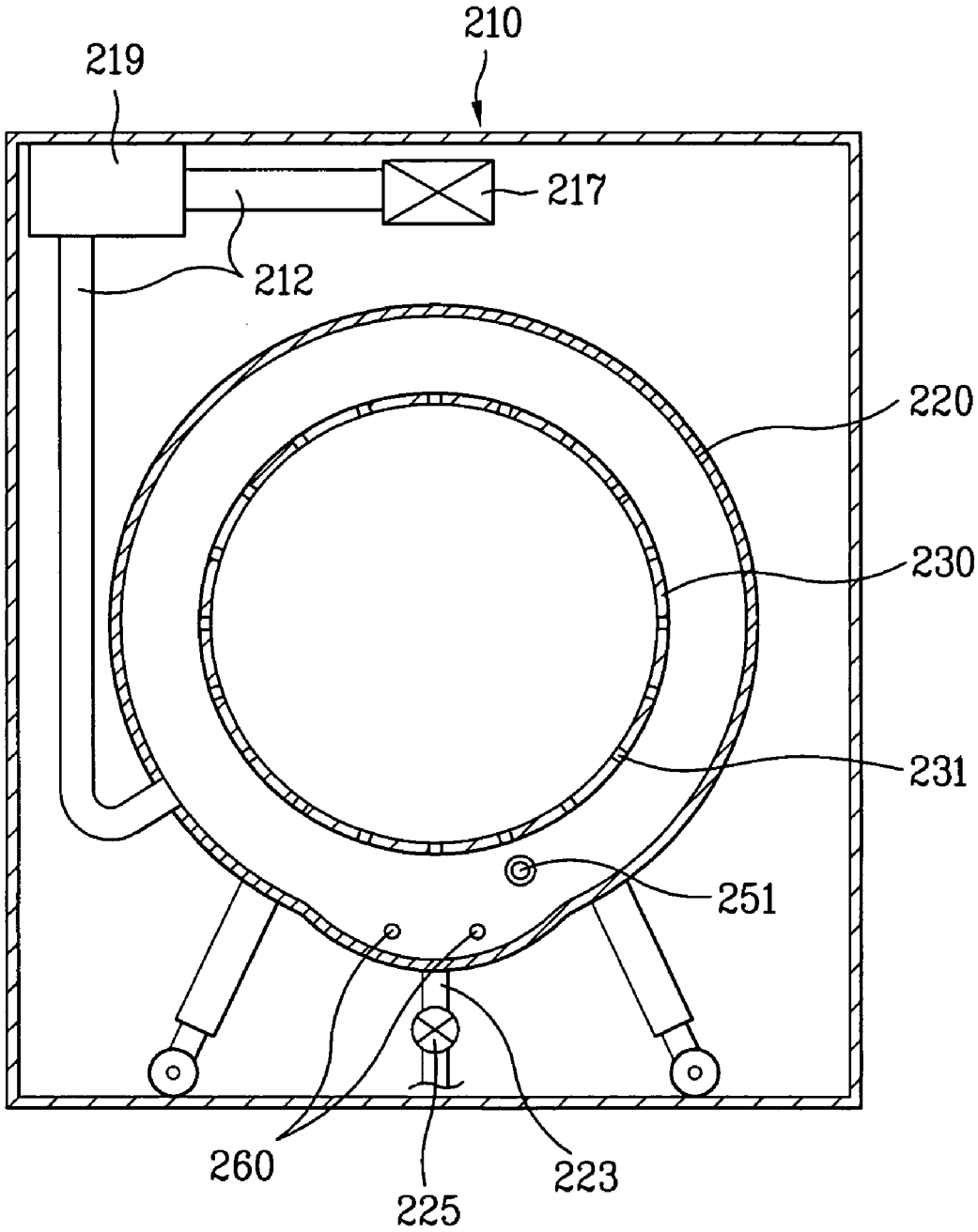
FIG. 17 and FIG. 18 are schematic cross-sectional diagrams of an interior of a washing apparatus according to a sixth embodiment of the present invention.

In this case, the water outlet of the water supply pipe 221, as shown in FIG. 17, is preferably connected to a circumference of the bottom part of the outer tub 220.

This is to prevent the water from being splashed on the circumference of the drum 230 while the water is supplied to the outer tub 220 via the water supply pipe 212.

Preferably, the water outlet of the water supply pipe 212, as shown in the drawing, is bent upward from a bottom part thereof to prevent the splash of the water.

Preferably, a level of the water supplied to the loading part 221 within the outer tub 220 is set up not to exceed a bottom of the drum 230.

If the water level exceeds the bottom of the drum 230, the water may flow in the drum 230 via the perforated holes formed on the outer circumference of the drum 230 to soak the laundry.

Preferably, a series of configurations are further provided to sense the level of the water supplied to the outer tub 220.

The present invention is characterized in further including a water level sensing unit provided to a bottom space within the outer tub 220.

The water level sensing unit senses the water level within the loading part 221 to control the water supply valve 217 and the water heater 260, whereby the water level can be maintained uniform within the loading part.

The water level sensing unit may include a pressure sensor generally used in water level detection. Yet, considering that an amount of the water for the dry-cleaning operation is extremely smaller than a water amount necessary for washing, it is disadvantageous to use the pressure sensor having a relatively great deviation of a water supply amount.

Preferably, the sensing unit includes a temperature sensor 251 checking whether to supply the water by sensing a peripheral temperature.

In doing so, it is preferable that the temperature sensor 251 is located higher than the water heater 260 as well as lower than the bottom of the drum 230.

By enabling the water heater 260 to generate heat only if submerged under the water, it is able to prevent excessive heat generation of the water heater 260.

Preferably, the temperature sensor 251 is placed between the water heater 260 and the bottom of the drum 230 to leave a maximum distance from the water heater 260.

Such a configuration is provided to minimize the problem that the temperature sensor 251 may fail in sensing a temperature precisely due to the heat generation of the water heater 260.

Figure 19:
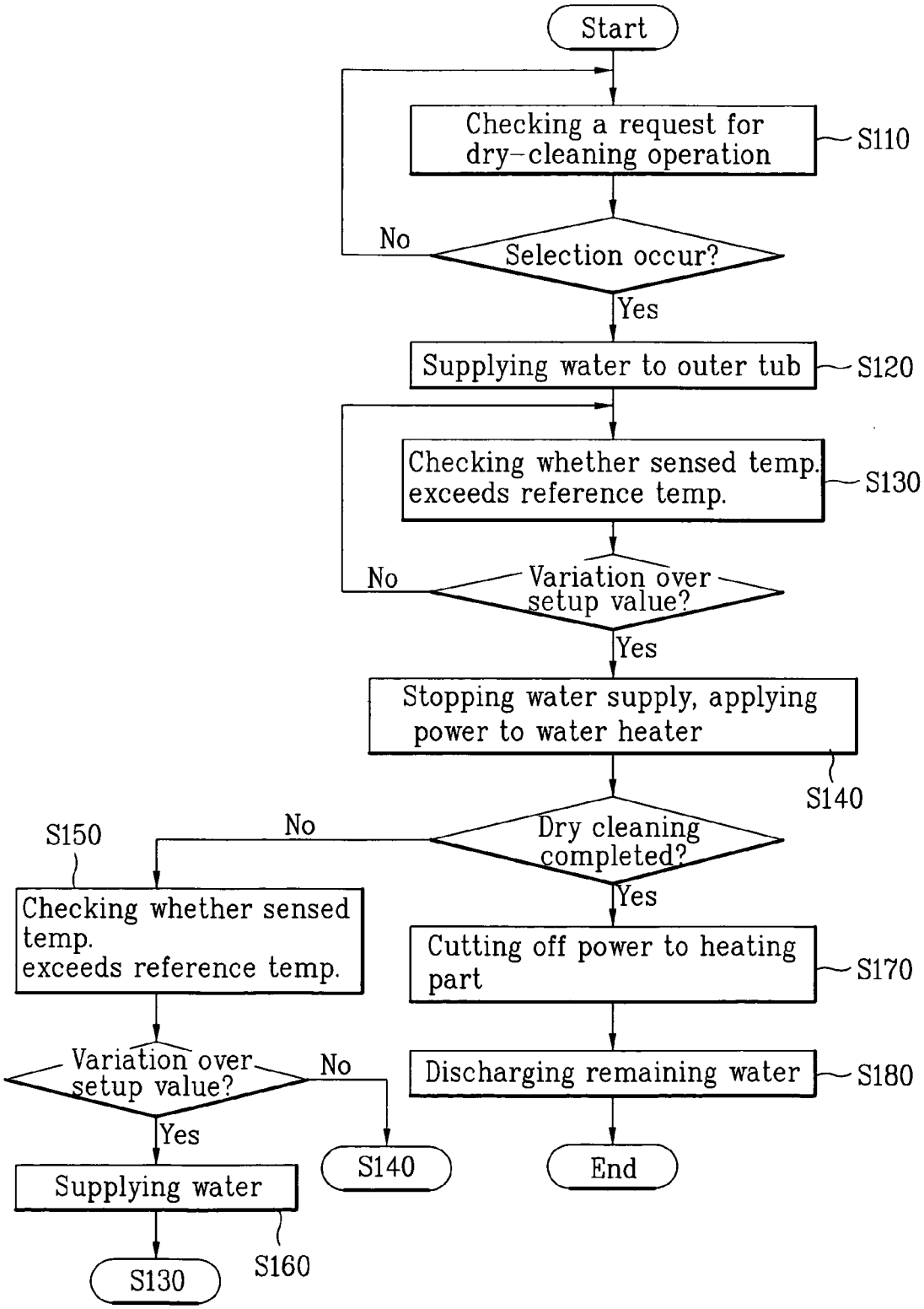
FIG. 19 is a flowchart of a method of controlling a washing apparatus according to a sixth embodiment of the present invention.

A method of controlling the above-explained washing apparatus according to the sixth embodiment of the present invention is explained with reference to a flowchart in FIG. 19 as follows.

First of all, a controller (not shown in the drawing) controlling an operation of a drum type washing machine keeps checking a presence or non-presence of a request for a dry-cleaning operation (S110).

Namely, when an operation control of the drum type washing machine is requested by a user, the controller decides whether the operation selected by the user is for the dry cleaning or a general laundry washing. Hence, the controller detects the presence of the request for dry cleaning.

In doing so, in case of the presence of the request for the dry-cleaning operation, the controller requests an input of the laundry to be dry-cleaned.

In such a case, the user inputs the laundry to be dry-cleaned to the drum 230, closes the door 215, and then selects a continuous execution of the dry-cleaning operation.

Of course, after completion of inputting the laundry, the user may request the dry-cleaning operation so that the controller can immediately control the various elements for the dry-cleaning operation.

Subsequently, once the dry cleaning is ready to be executed by a series of the aforesaid procedures, the controller (not shown in the drawing) controls the water supply valve 217 to enable a water supply to the water supply pipe 212 (S120).

Hence, the water is introduced into the outer tub 220 via the water supply pipe 212. In doing so, since the water outlet of the water supply pipe 212 is located under the outer tub 220, it is able to prevent the water from being directly injected to an outside of the drum 230. Thus, it is able to prevent the laundry from being wet as well.

As mentioned in the foregoing description, the water supplied to the outer tub 220 is introduced into the loading part 221 provided with the water heater 260 to gradually rise from the initial state in FIG. 17 toward an upper part of the loading part 221. In doing so, the pipe path of the drainpipe 223 connected to the loading part 221 is cut off.

While the water supply is in progress, the controller keeps receiving the sensing signals for the temperature variation from the temperature sensor 251 to check whether the sensed temperature is instantly varies over a reference temperature value (S130).

In this case, the reference temperature value is a value resulting from an instant and abrupt temperature variation instead of a uniform variation of a temperature increase that varies in proportion to a temperature increase. The reference temperature value can be set to ±2° C. and the like.

For instance, Considering that the temperature of the water is about 15° C. and that the temperature sensor 251 performs its temperature sensing under an environment at about 30° C., if the water is supplied to reach the temperature sensor 25i, the temperature 251 detects a temperature drop on measuring the temperature of the water. In such a manner, a current level of the water can be detected.

Figure 18:
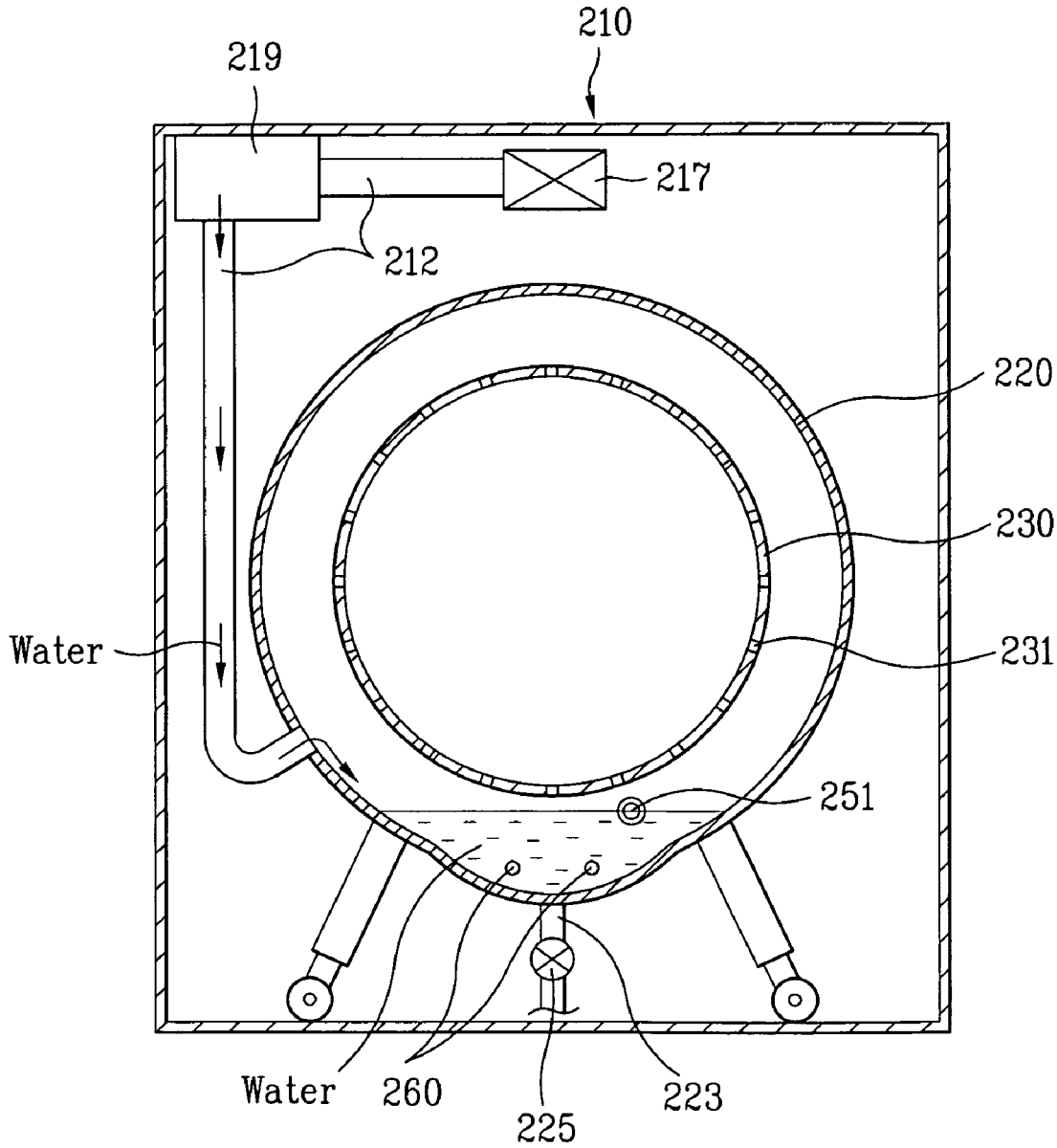

Once it is detected that the water level reaches a required water level, the controller controls the water supply valve 217 to stop supplying the water. A corresponding state is shown in FIG. 18.

Thus, it is able to prevent the water from flowing in the drum 230.

Subsequently, power is supplied to the water heater 260 (S140) and the hot steam for the dry cleaning is then produced from heat generated from the water heater 260.

Namely, the heat generation of the water heater 260 evaporates the water within the outer tub 220. The generated steam by the evaporation is introduced into the drum 230 via the perforated holes 231 to refresh the laundry within the drum 230.

In doing so, the drum 230 is being rotated to agitate the laundry within the drum 230, which helps the laundry refreshed more smoothly.

And, the steam generation according to the above process keeps occurring during a dry-cleaning setup time. If the dry-cleaning time is set longer than the time taken for the water in the bottom part within the outer tub 220 to be entirely evaporated, shortage of the water takes place to rapidly raise the temperature of the portion provided with the water heater 260.

Of course, the dry-cleaning time can be set shorter than the evaporation time of the water. In such a case, an amount of the steam supplied for the dry cleaning may become in short to lower dry-cleaning performance. It is also able to increase a water storage amount by modifying a shape of the loading part 221 within the outer tub 120. In such a case, the shape modification needs to redesign other elements.

Accordingly, in the embodiment of the present invention, overheating occurrence is checked by sensing the temperature continuously using the temperature sensor 251 in the same manner of an early stage of the water supply while the steam is generated (S150).

Namely, in case that the temperature is abruptly raised in the middle of checking the temperature variation using the temperature sensor 251, it is decided that the water is in short. Hence, an additional water supply to the loading part 221 provided with the water heater 260 within the outer tub 220 is performed (S160).

Of course, it is preferable that a timing point of stopping the water supply is decided by sensing the temperature variation in the course of re-executing the water supply to prevent the laundry from being wet by the oversupply of the water.

If the amount of the steam supplied for the dry cleaning is decided as sufficient in the course of performing a series of the aforesaid processes, the power applied to the water heater 260 is cut off (S170).

In doing so, a generated steam amount according to the heat generation time of the water heater 260 is previously acquired through a test and the like and the acquired value is previously set up, by which it is able to decide the steam amount through such a simple process as a process of counting the heat generation time of the water heater 260 and the like.

Namely, if the setup time arrives via the time counting, the power applied to the water heater 260 is cut off.

Of course, a humidity sensor (not shown in the drawing) for checking the amount of the steam within the outer tub 220 is further provided to an inner space of the outer tub 220, whereby the power applied to the water heater 260 is cut off if the humidity sensed by the humidity sensor reaches a predefined humidity.

After completion of the dry cleaning through the aforesaid processes, the drain valve 225 is controlled to open the drainpipe 223 so that the remaining water within the loading part 221 is discharged (S180). Thus, the operation for the dry cleaning is terminated.

Meanwhile, a washing apparatus according to a seventh embodiment of the present invention is characterized in using an electrode sensor instead of the temperature sensor of the sixth embodiment of the present invention, which is explained in detail as follows.

Figure 20:
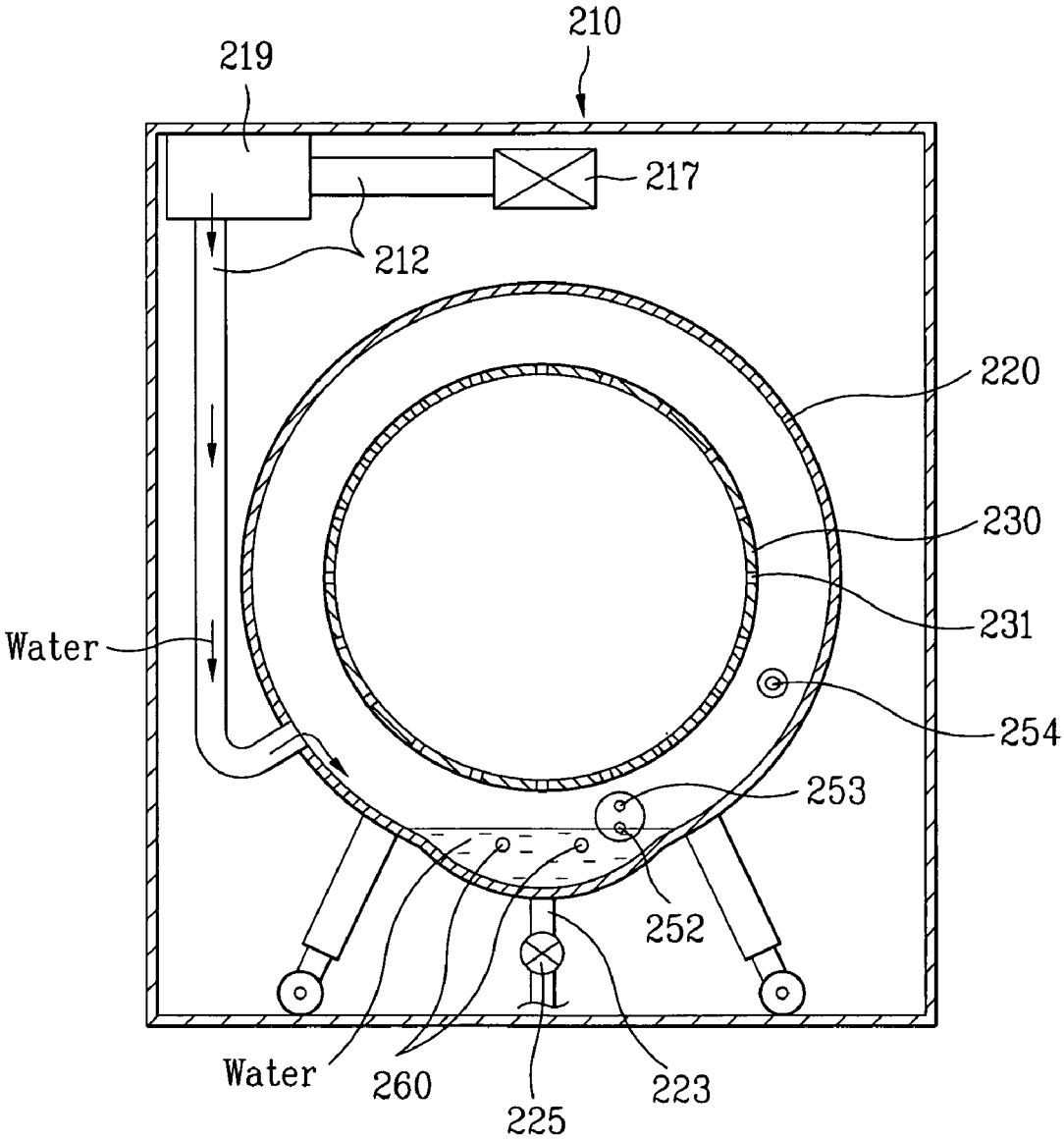
FIG. 20 and FIG. 21 are schematic cross-sectional diagrams of an interior of a washing apparatus according to a seventh embodiment of the present invention.
Figure 21:
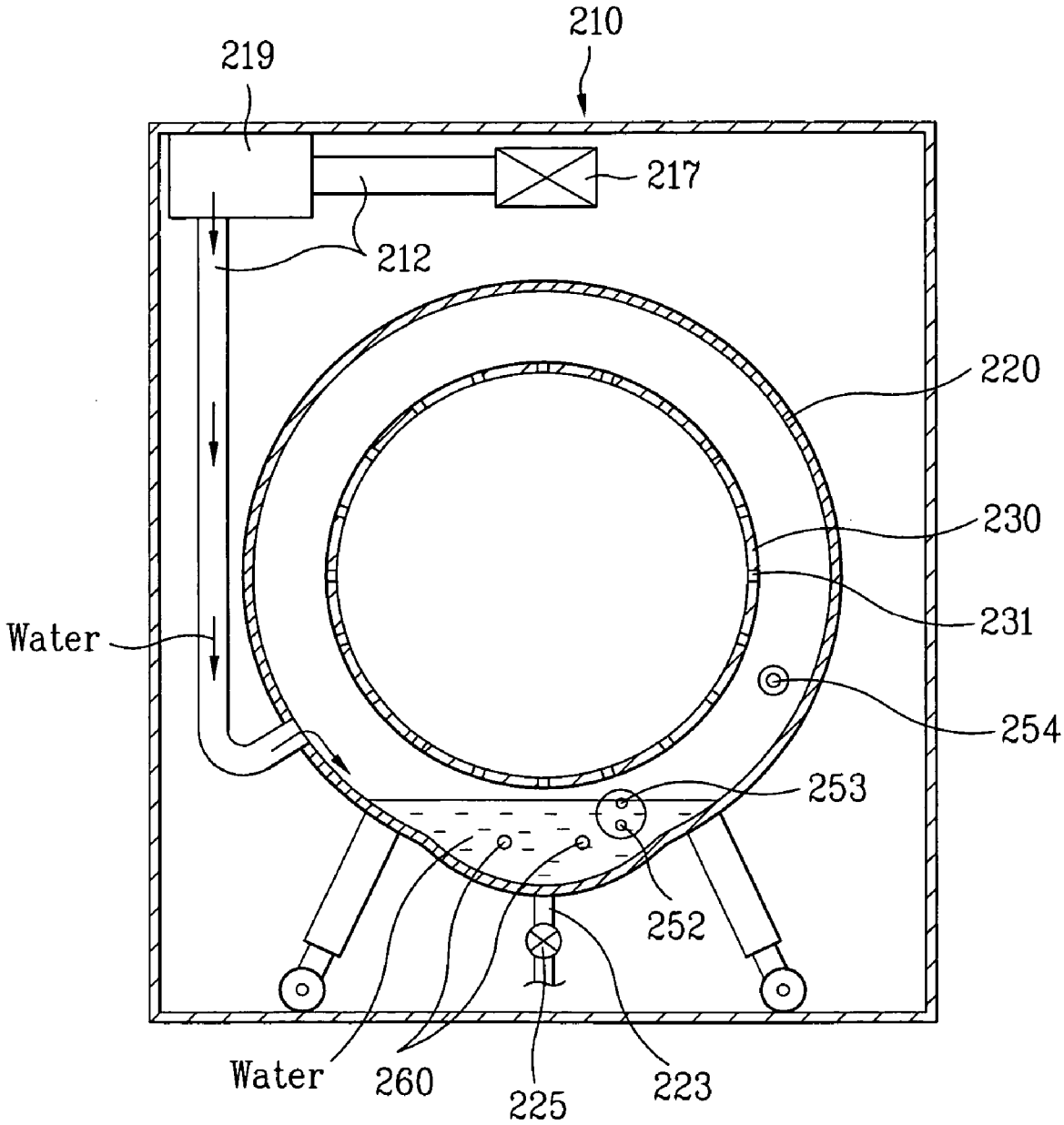

First of all, a washing apparatus according to a seventh embodiment of the present invention, as sown in FIG. 20 and FIG. 21, includes a body 210, an outer tub 220, a drum 230, a water heater 260, a water supply pipe 212, an electrode sensor, and a controller.

In this case, the body 210, outer tub 220, drum 230, water heater 260, and water supply pipe 212 have the same configurations of the sixth embodiment of the present invention.

The electrode sensor includes a first electrode 252 and a second electrode 253.

The first and second electrodes 252 and 253 play a role in sensing that the level of the water supplied to the bottom part within the outer tub 200 avoids exceeding the bottom of the drum 230 and are placed between the water heater 260 and the drum 230.

Namely, the first electrode 252 is located in the vicinity of the water heater 260 and the second electrode 253 is located above the first electrode. 252. Hence, in case that the level of the water exceeds a setup water level, an electric current is turned on between the first and second electrodes 252 and 253.

Preferably, controls of the water supply valve 225 and the water heater 260 are executed in case that electric current is turned on between the first and second electrodes 252 and 253.

Specifically, the first electrode 252 is preferably located above the water heater 260 and the second electrode is preferably located below the bottom of the drum 230.

The electrode sensor is provided to one site opposite to the other site connected to the water outlet of the water supply pipe 212 in the space having the water heater 260 provided thereto. Hence, it is able to prevent a malfunction of driving the water heater 260 to generate heat when the electrodes 252 and 253 are shorted by the splashed water prior to the completion of supplying the water to the predefined water level.

Namely, by enabling the water heater 260 to generate heat only if the water heater is fully submerged under the water, it is able to prevent the overheating of the water heater 260.

The controller (not shown in the drawing) plays a role in controlling the heat generation of the water heater 260 by checking the presence or non-presence of the short circuit between the electrodes 252 and 253 optionally.

The embodiment of the present invention further includes a humidity sensor 254 in the inner space of the outer tub 220.

The humidity sensor 254 checks an amount of the generated stream within the outer tub 220 to enable the control of the water heater 260, thereby enhancing refresh performance on the laundry through appropriate humidity maintenance.

Figure 22:
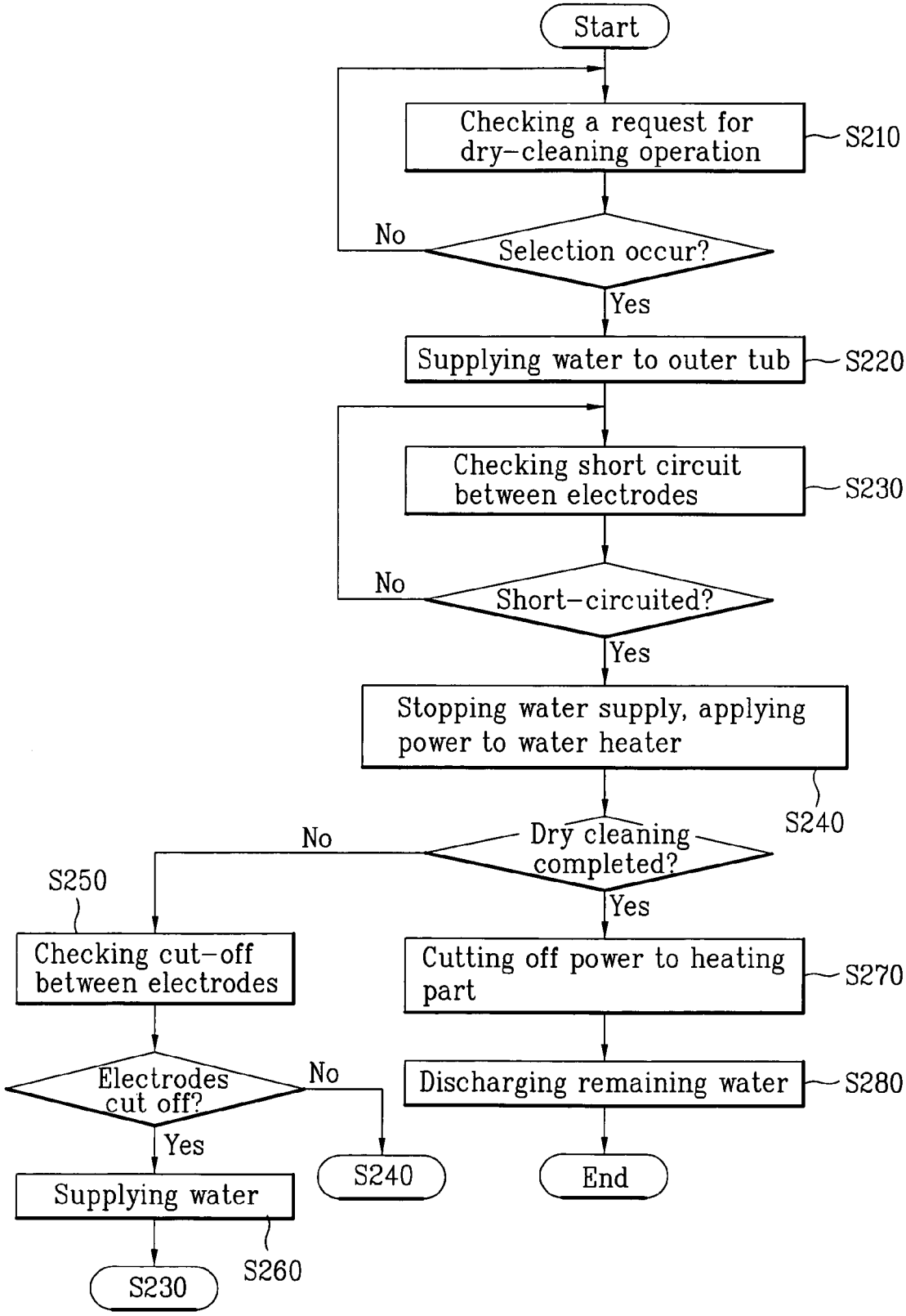
FIG. 22 is a flowchart of a method of controlling a washing apparatus according to a seventh embodiment of the present invention.

A method of controlling the above-explained washing apparatus according to the seventh embodiment of the present invention is explained with reference to a flowchart in FIG. 22 as follows.

First of all, a controller (not shown in the drawing) controlling an operation of a drum type washing machine keeps checking a presence or non-presence of a request for a dry-cleaning operation (S210).

Namely, when an operation control of the drum type washing machine is requested by a user, the controller decides whether the operation selected by the user is for the dry cleaning or a general laundry washing. Hence, the controller detects the presence of the request for dry cleaning.

In case of the presence of the request for the dry-cleaning operation, the controller requests an input of the laundry to be dry-cleaned.

In such a case, the user inputs the laundry to be dry-cleaned to the drum 230, closes the door 215, and then selects a continuous execution of the dry-cleaning operation.

Of course, after completion of inputting the laundry, the user may request the dry-cleaning operation so that the controller can immediately control the various elements for the dry-cleaning operation.

Subsequently, once the dry cleaning is ready to be executed by a series of the aforesaid procedures, the controller controls the water supply valve 217 to enable a water supply to the water supply pipe 212 (S220).

Hence, the water is introduced into the outer tub 220 via the water supply pipe 212. In doing so, since the water outlet of the water supply pipe 212 is located under the outer tub 220, it is able to prevent the water from being directly injected to an outside of the drum 230. Thus, it is able to prevent the laundry from being wet as well.

As mentioned in the foregoing description, the water supplied to the outer tub 220 is introduced into the loading part 221 provided with the water heater 260 to gradually rise toward an upper part of the loading part 221. In doing so, the pipe path of the drainpipe 223 connected to the loading part 221 is cut off.

While the water supply is in progress, the controller keeps checking a presence or non-presence of short circuit between the electrodes 252 and 253 (S230).

In doing so, as the level of the supplied water gradually rises, the water level, as shown in FIG. 20, reaches the first electrode 252. As the water keeps being supplied, so the water level exceeds the first electrode 252 to reach the second electrode 253.

If so, the first and second electrodes 252 and 253 are short-circuited. Hence, the controller decides that the level of the water has reached the necessary water level and then controls the water supply valve 217 to stop supplying the water.

Thus, it is able to prevent the water from flowing in the drum 230.

Subsequently, the controller allows power to be supplied to the water heater 260 (S240) so that the hot steam for the dry cleaning can be produced by the heat generated from the water heater 260.

Namely, the heat generation of the water heater 260 evaporates the water within the outer tub 220. The generated steam by the evaporation is introduced into the drum 230 via the perforated holes 231 of the drum 230 to refresh the laundry within the drum 230.

In doing so, the drum 230 is being rotated to agitate the laundry within the drum 230, which enhances a refreshing effect of the laundry.

And, the steam generation according to the above process keeps occurring during a dry-cleaning setup time. If the dry-cleaning time is set longer than the time taken for the water in the bottom part within the outer tub 220 to be entirely evaporated, shortage of the water takes place to rapidly raise the temperature of the portion provided with the water heater 260.

Of course, the dry-cleaning time can be set shorter than the evaporation time of the water. In such a case, an amount of the steam supplied for the dry cleaning may become in short to lower dry-cleaning performance. It is also able to increase a water storage amount by modifying a shape of the loading part 221 within the outer tub 220. In such a case, the shape modification needs to redesign other elements.

Accordingly, it is preferable that the presence or non-presence of the short circuit between the electrodes keeps being checked in the same manner of an early stage of the water supply while the steam is generated (S250).

Namely, in case of the presence of the short circuit between the electrodes, it is decided that the water is in short. Hence, an additional water supply to the loading part 221 provided with the water heater 260 within the outer tub 220 is performed (S260).

Of course, it is preferable that a timing point of stopping the water supply is decided by keeping checking the presence or non-presence of the short circuit between the electrodes in the course of re-executing the water supply to prevent the laundry from being wet by the oversupply of the water.

If the amount of the steam supplied for the dry cleaning is decided as sufficient in the course of performing a series of the aforesaid processes, the power applied to the water heater 260 is cut off (S270).

In doing so, the steam amount can be confirmed through a sensing value of the humidity sensor 254 provided within the outer tub 220.

Namely, in keeping checking the humidity within the outer tub 220, if the humidity reaches a predefined humidity, the power applied to the water heater 260 is cut off.

In this case, the predefined humidity means a steam amount most appropriate for refreshing the laundry, which can be acquired by a test value on which no limitation is put.

Alternatively, a generated steam amount according to the heat generation time of the water heater 260 can be previously acquired through a test and the like and the acquired value is previously set up, by which it is able to decide the steam amount through such a simple process as a process of counting the heat generation time of the water heater 260 and the like.

Namely, if the setup time arrives via the time counting, the power applied to the water heater 260 is cut off.

After completion of the dry cleaning through the aforesaid processes, the drain valve 225 is controlled to open the drainpipe 223 so that the remaining water within the loading part 221 can be discharged (S280). Thus, the operation for the dry cleaning is terminated.

Meanwhile, since the water for the use of the steam generation is preferentially supplied to the water supply pipe in the fifth to seventh embodiments of the present invention, it is difficult to maintain a precise water level.

Namely, the water supplement is supposed to amount to a small quantity. Yet, the water supplement could be excessively made.

To overcome such a problem, a washing apparatus according to an eighth embodiment of the present invention is characterized in maintaining a precise level of water supplied for steam generation, which is explained in detail as follows.

Figure 23:
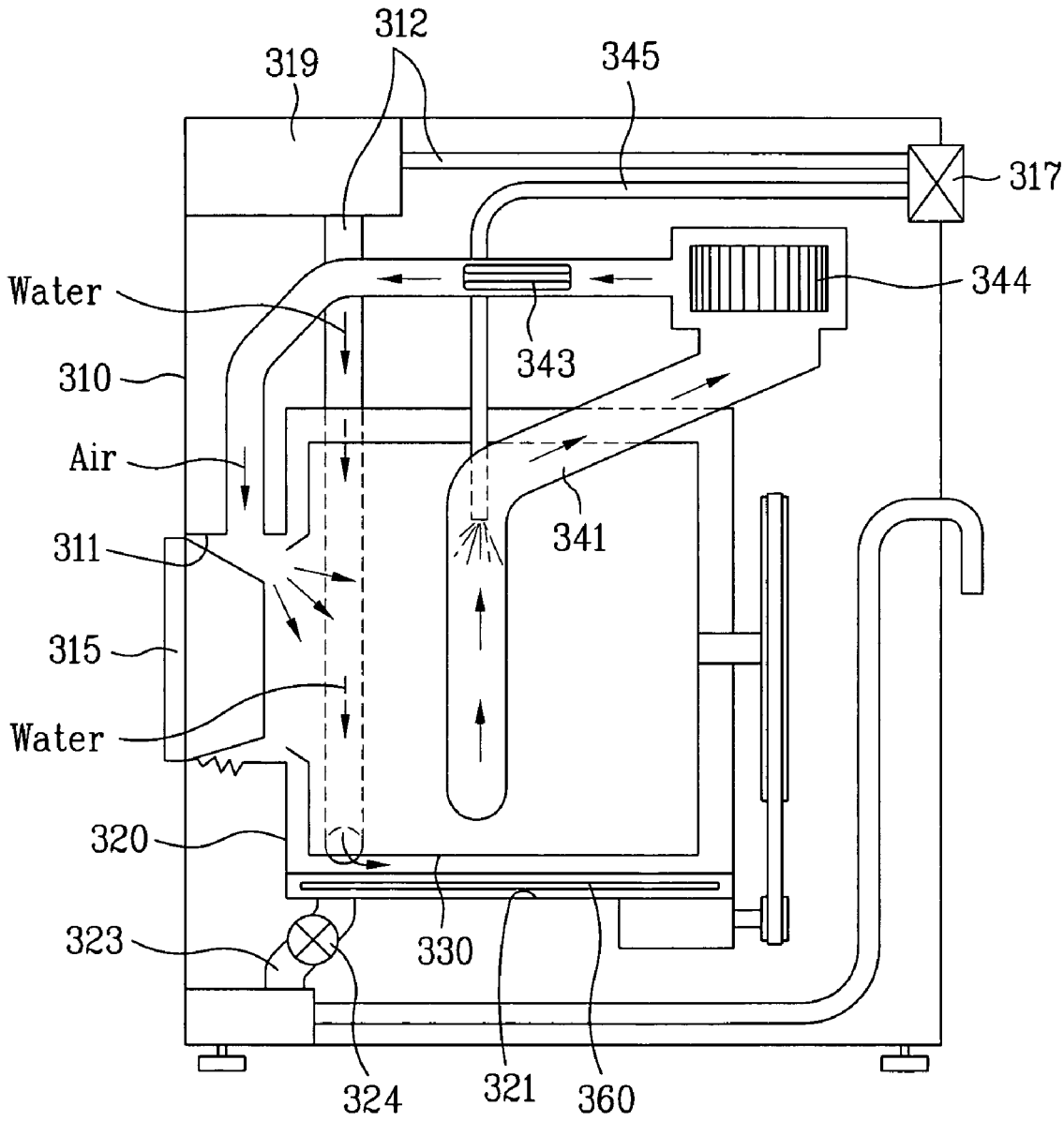
FIG. 23 is a cross-sectional diagram of a washing apparatus according to an eighth embodiment of the present invention.
Figure 24:
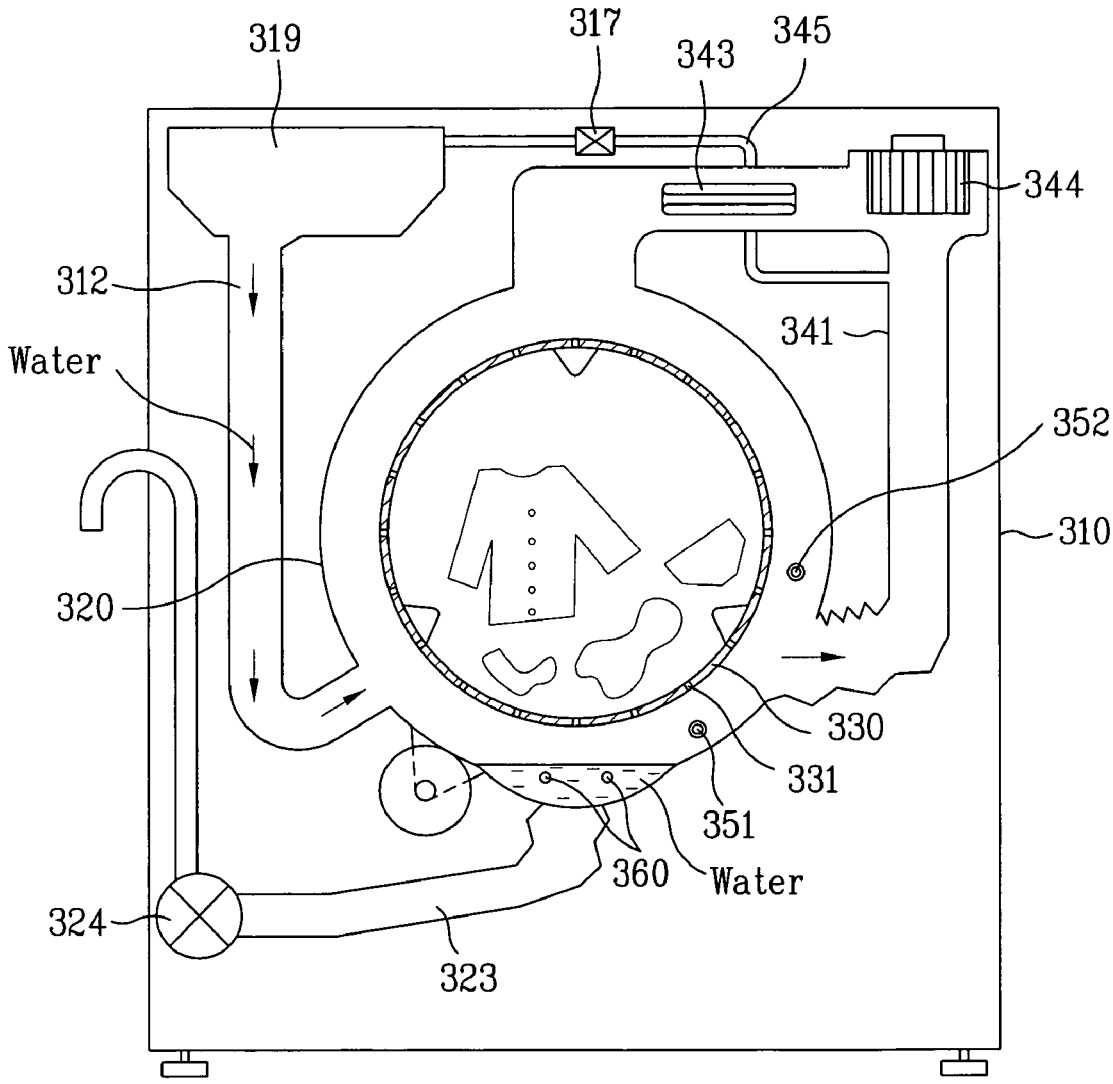
FIG. 24 and FIG. 25 are schematic cross-sectional diagrams of an interior of a washing apparatus according to an eighth embodiment of the present invention.
Figure 25:
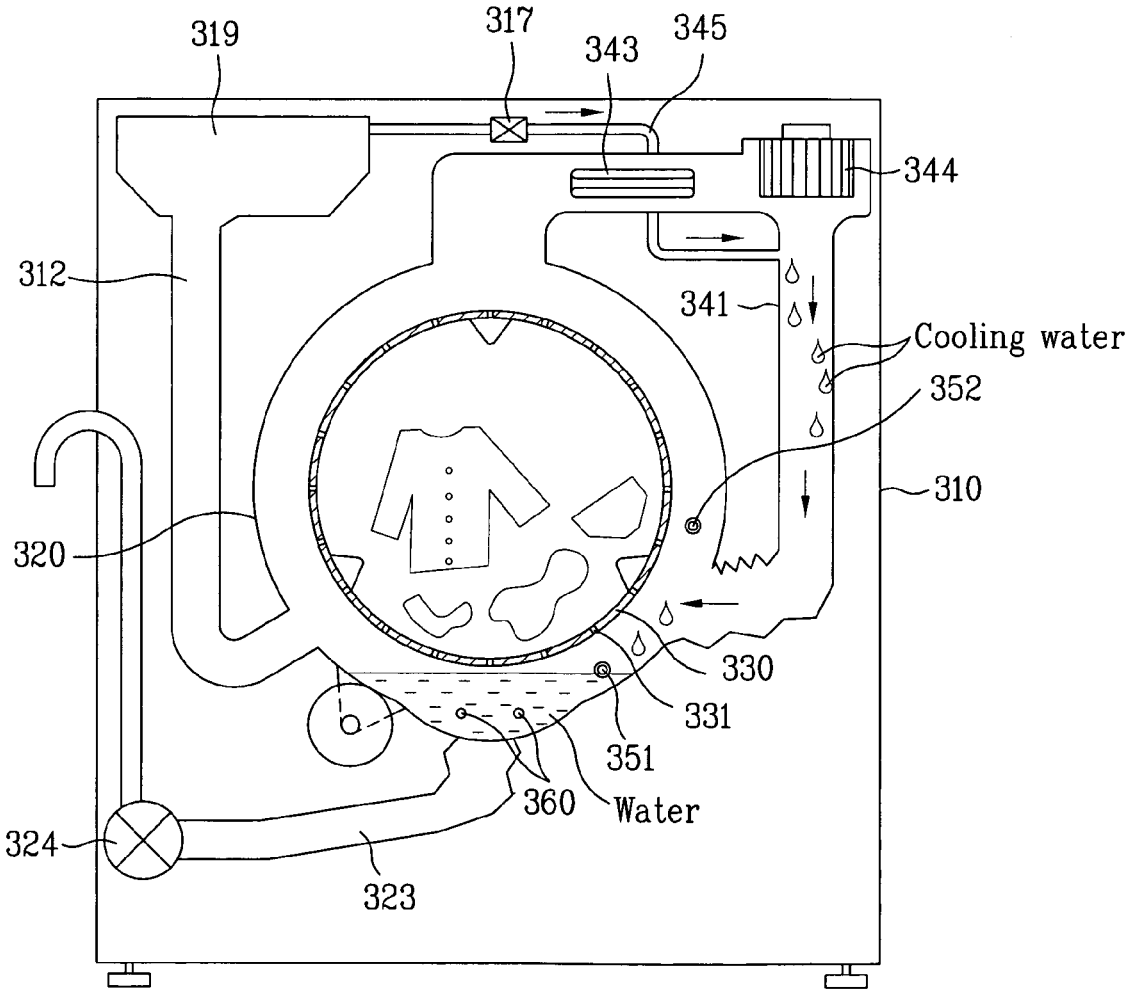

First of all, a washing apparatus according to an eighth embodiment of the present invention, as shown in FIGS. 23 to 25, includes a body 310, an outer tub 320, a drum 330, a water heater 360, a water supply pipe 312, a drying duct 341, and a cooling water supply pipe 345.

The body 310 forms an exterior of the washing apparatus. An entrance 311 is provided to a front side of the body 210. And, the entrance 311 is open/closed by a door 315.

The outer tub 320 is provided within the body 310, and the drum 330 is rotatably provided within the outer tub 320.

A multitude of perforated holes 331 are formed in a circumference of the drum 330 to allow water and steam to flow into the drum 330.

The water heater 360 is provided to a bottom part within the outer tub 320 to heat the water supplied to the outer tub 320.

In doing so, a part (herein after called loading part) 321, where the water heater 360 is loaded, is provided by a concave portion of the outer tub 320 and is connected to a drainpipe 323 for draining the water after completion of washing. And, a drain valve 324 opening/closing a pipe path of the drainpipe 323 is provided to the drainpipe 323.

Specifically, the water heater 260 enables steam generation as well as operates to heat the water.

Namely, in the embodiment of the present invention, the steam for refreshing the laundry is generated using the water heater 360 instead of using a separate steam generator.

The water supply pipe 312 is a pipe path through which the water flows. The water supply pipe 312 guides to supply the water provided from the service pipe or the like via the water supply valve 317 to an inside of the outer tub 320.

In this case, a detergent box 319 storing a detergent is provided to the pipe path of the water supply pipe 312 so that the detergent can be added to the water flowing into the outer tub 320.

The detergent box 319 is provided to an upper space within the body 310 to enable a detergent input. And, fragrance used in dry cleaning can be included in the detergent supplied via the detergent box 319.

In the related art, a water outlet of the water supply pipe 312 for supplying the water to a part provided with the water heater 360 is connected to the upper part of the outer tub 320, whereby the laundry to be dry-cleaned could be soaked in the supplied water. Such a problem needs to be solved.

Preferably, the water supply pipe 312 is connected to the outer tub 320 in the vicinity of the part provided with the water heater 360, i.e., the loading part 321.

In this case, the water outlet of the water supply pipe 321 is preferably connected to a circumference of the bottom part of the outer tub 320.

This is to prevent the water from being splashed on the circumference of the drum 330 while the water is supplied to the outer tub 320 via the water supply pipe 312.

Preferably, the water outlet of the water supply pipe 312 is bent upward from a bottom part thereof to prevent the splash of the water.

The drying duct 341 is configured to provide hot air to the outer tub 320. An air inlet of the drying duct 341 is connected to a lower circumference of the outer tub 320 and an air outlet of the drying duct 341 is connected to an upper circumference of the outer tub 320.

A drying heater 343 for heating flowing air and a blower fan 344 forcibly blowing to move the air are provided to a pipe path within the drying duct 341.

And, the cooling water supply pipe 345 is connected to the pipe path of the drying duct 341 and is configured to provide a small amount of cooling water.

Preferably, the cooling water supply pipe 345 is connected to a location enabling the cooling water to be directly provided to the bottom part of the outer tub 320, i.e., the air inlet of the drying duct 341.

The cooling water supply pipe 345 can be configured to be connected to the service pipe via a separate pipe path. Preferably, the cooling water supply pipe 345 is connected to the water supply valve 318 to enable the water supply by a control of the water supply valve 317.

Meanwhile, the water heater 360 generates heat if a level of the water supplied to the outer tub 320 does not exceed the bottom of the drum 330 and is enough for the water heater 360 to be submerged.

In case the water is supplied to exceed a height of the bottom of the drum 330, the water is introduced into the drum 330 via the perforated holes 331 of the drum 330 to wet the laundry. In case of generating heat from the water heater 360 even if the water fails to reach a sufficient water level, the excessive heat generation from the water heater 360 can transform the drum 330, outer tub 320 and other various electric/electronic parts.

Hence, it is preferable that the level of the supplied water is accurately known to adjust the water supply appropriately. For this, the embodiment of the present invention further includes a water level sensor 351 installed in a lower space of the outer tub 320 provided with the water heater 360 to sense the level of the water supplied to the loading part 321.

In this case, the water level sensor 351 may be a temperature sensor enabling a water level measurement according to a temperature variation within the loading part 321, an electrode sensor enabling a water level measurement through a confirmation of a short-circuited or cut-off state between a pair of electrodes respectively located in different heights, or a pressure sensor enabling a water level measurement through a confirmation of a pressure of the water.

Moreover, the embodiment of the present invention further includes a humidity sensor 352 provided to an inner space of the outer tub 320.

The humidity sensor 352 checks an amount of the generated steam within the outer tub 320 to enable a control of the water heater 360, thereby enhancing refreshing performance of the laundry thorough appropriate humidity maintenance.

Figure 26:
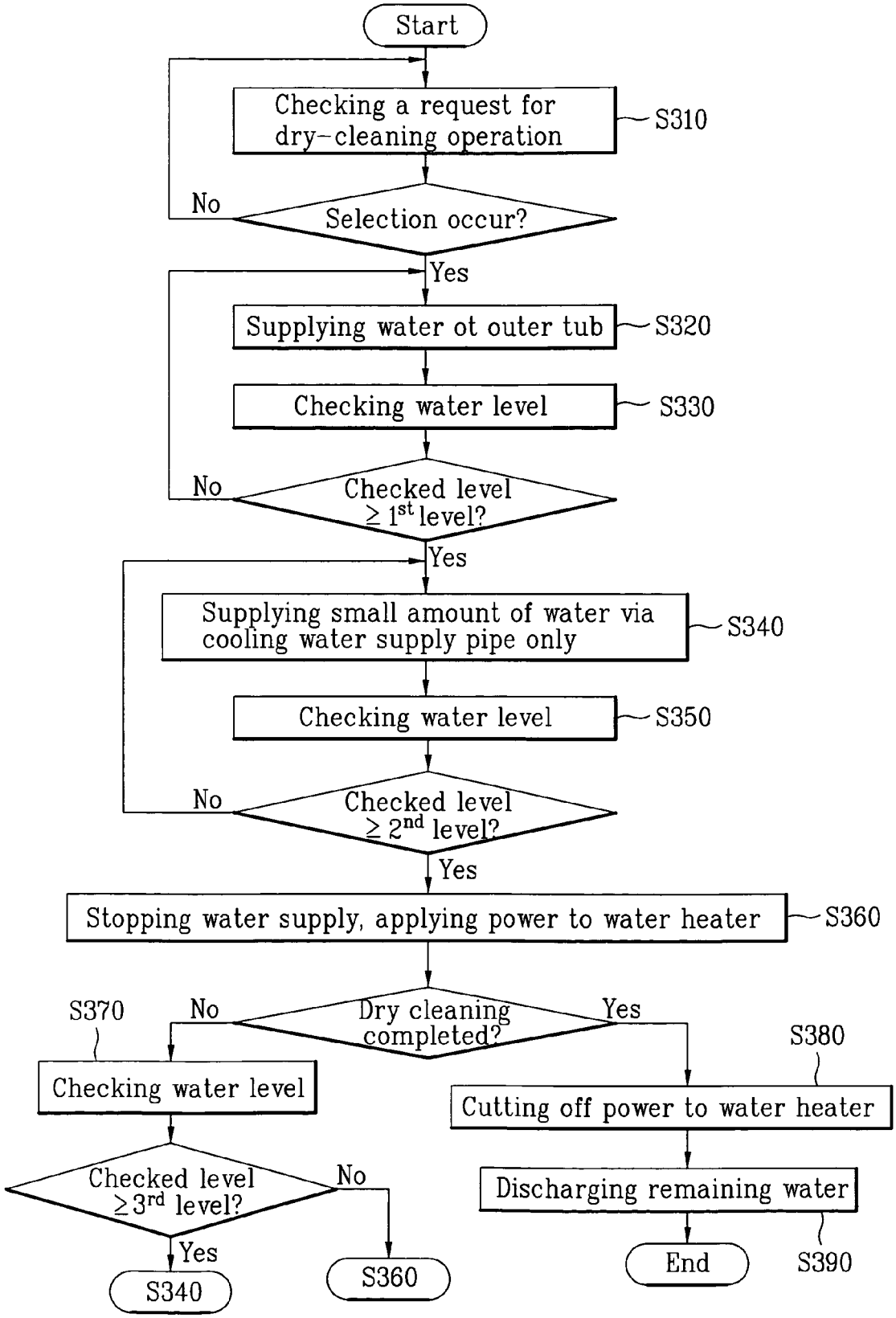
FIG. 26 is a flowchart of a method of controlling a washing apparatus according to an eighth embodiment of the present invention.
Figure 27:
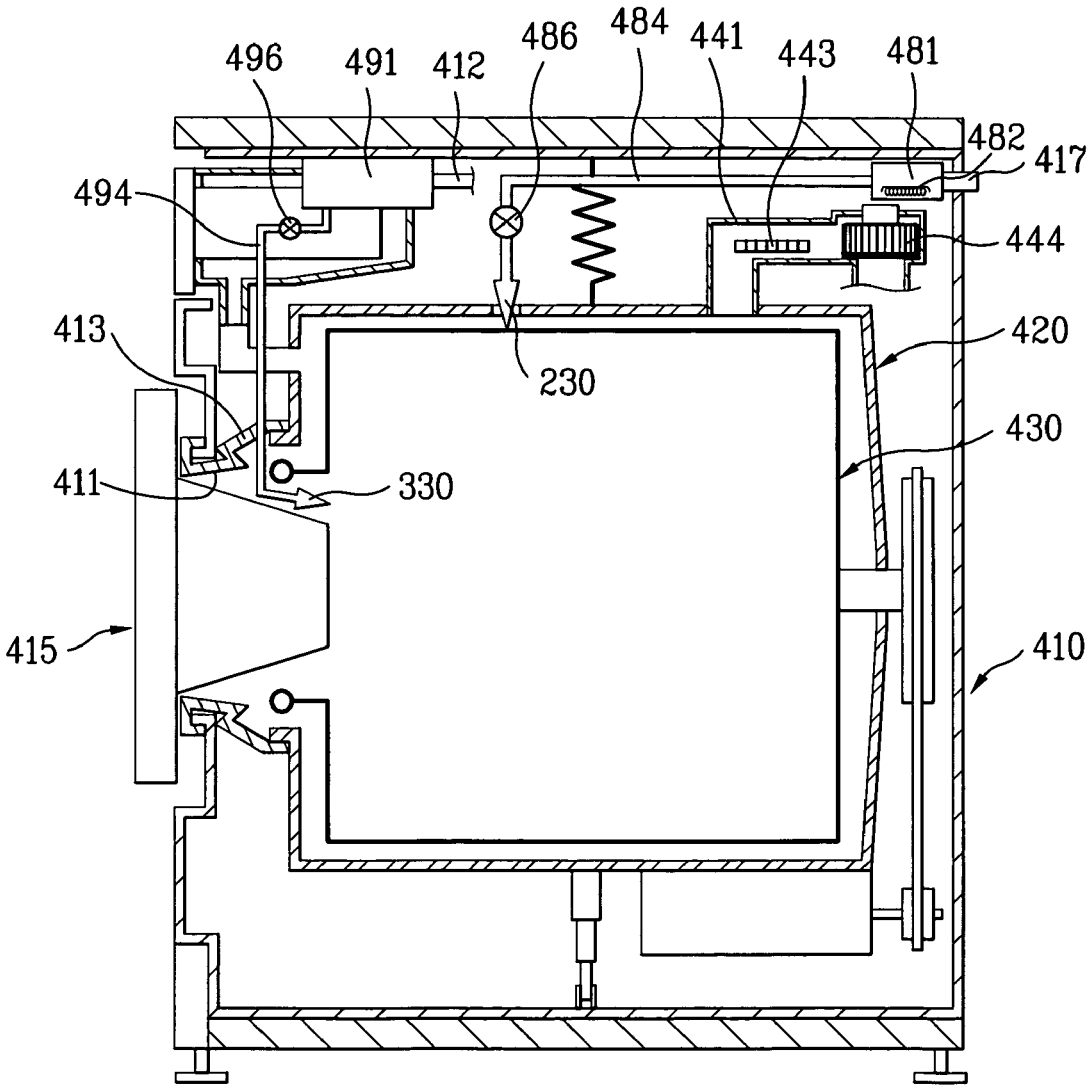
FIG. 27 is a cross-sectional diagram of a washing apparatus according to a ninth embodiment of the present invention.
Figure 28:
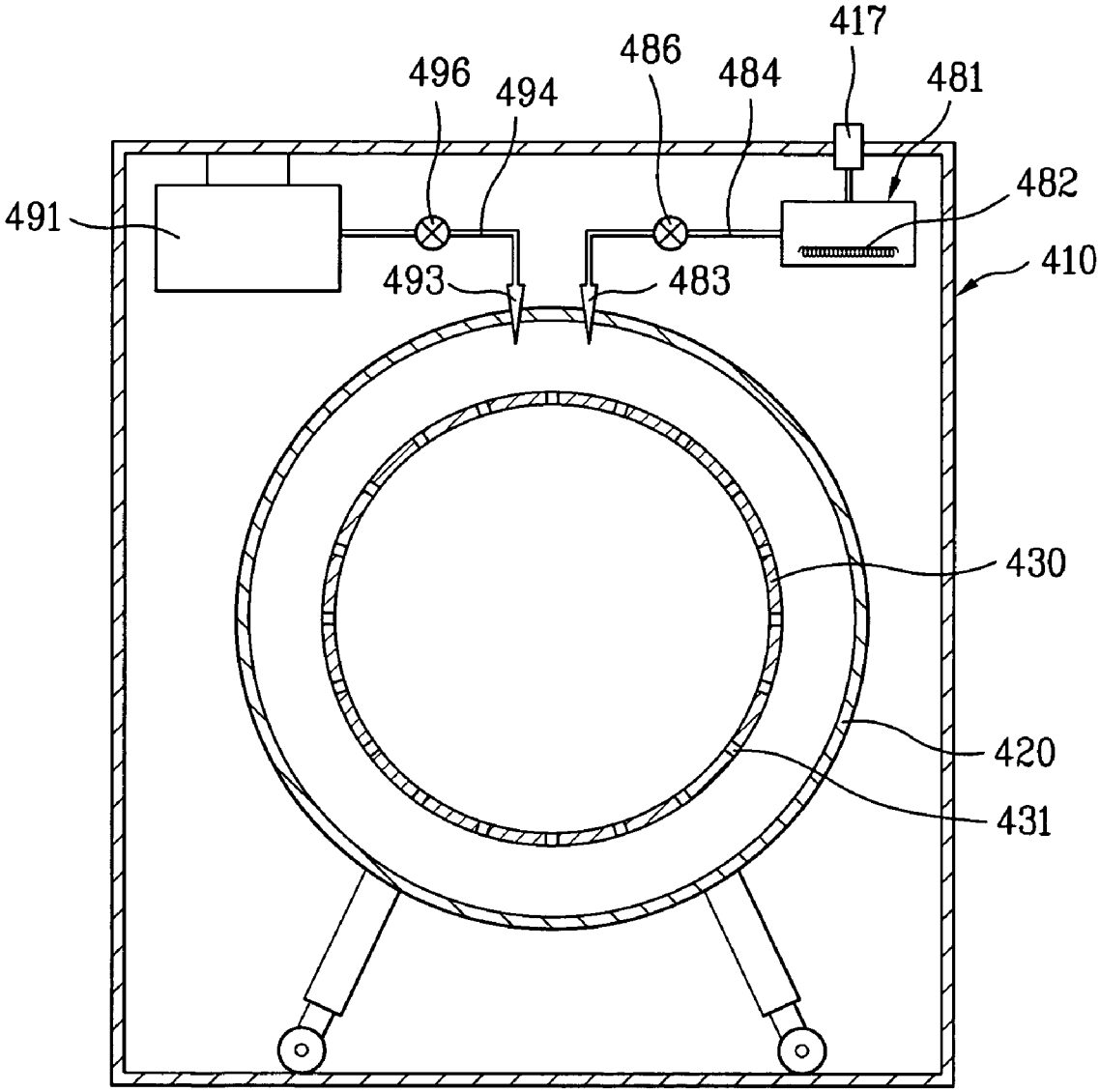
FIG. 28 is a schematic cross-sectional diagram of an interior of a washing apparatus according to a ninth embodiment of the present invention.

A method of controlling the above-explained washing apparatus according to the eighth embodiment of the present invention is explained with reference to a flowchart in FIG. 26 as follows.

First of all, a controller controlling an operation of the washing apparatus keeps checking a presence or non-presence of a request for a dry-cleaning operation (S310).

Namely, when an operation control of the drum type washing machine is requested by a user, the controller decides whether the operation selected by the user is for the dry cleaning or a general laundry washing. Hence, the controller detects the presence of the request for dry cleaning.

In doing so, in case of the presence of the request for the dry-cleaning operation, the controller requests an input of the laundry to be dry-cleaned.

In such a case, the user inputs the laundry to be dry-cleaned to the drum 330, closes the door 315, and then selects a continuous execution of the dry-cleaning operation.

Of course, after completion of inputting the laundry, the user may request the dry-cleaning operation so that the controller can immediately control the various elements for the dry-cleaning operation.

Subsequently, once the dry cleaning is ready to be executed by a series of the aforesaid procedures, the controller controls the water supply valve 317 to enable a water supply to the water supply pipe 312 (S320).

In doing so, it can be also controlled that the water supply can be performed using both of the water supply pipe 312 and the cooling water supply pipe 345.

Hence, the water is introduced into the outer tub 320 via the water supply pipe 312. In doing so, since the water outlet of the water supply pipe 312 is located under the outer tub 320, it is able to prevent the water from being directly injected to an outside of the drum 330. Thus, it is able to prevent the laundry from being wet as well.

As mentioned in the foregoing description, the water supplied to the outer tub 320 is introduced into the loading part 321 provided with the water heater 360 to gradually rise toward an upper part of the loading part 321. In doing so, the pipe path of the drainpipe 323 connected to the loading part 321 is cut off.

While the water supply is in progress, the controller keeps checking a presence or non-presence of the level of the supplied water using the water level sensor 351.

In doing so, if it is checked that the level of the supplied water, as shown in FIG. 24, has reached a predefined first level, the controller controls the water supply valve 317 to stop supplying the water via the water supply pipe 312 but enables a small amount of water to be supplied via the cooling water supply pipe 345 only (S340).

In this case, the predefined first water level corresponds to an installation height of the water heater 360.

Once the water supply is performed via the cooling water supply pipe 345, the water flowing through the cooling water supply pipe 345 is introduced into the drying duct 341 to flow in the bottom part within the outer tub 320 along the drying duct 341 and keeps being supplied to the loading part 321.

During such a process, the water level keeps being checked by the water level sensor 351 (S350). If it is confirmed that the water level, as shown in FIG. 25, reaches a predefined second water level, the controller controls the water supply valve 317 to stop supplying the water via the cooling water supply pipe 345.

In this case, the predefined second water level means a water level enabling the water heater to be fully submerged under the water but failing to reach the bottom of the drum 330.

Specifically, since a supply amount (e.g., about 0.05 l/min) of the water flowing via the cooling water supply pipe 345 is very small, the water level gradually rises to minimize a water level deviation.

Hence, since the water is supplied enough not to reach the bottom of the drum 330, it is able to prevent the laundry from being wet. And, the water heater 360 can be prevented from generating excessive heat according to water shortage since the water supply corresponding to a maximum amount is enabled.

After completion of the water supply for the stream generation, power is supplied to the water heater 360 (S360) so that the hot steam for the dry cleaning can be produced by the heat generated from the water heater 360.

Namely, the heat generation of the water heater 360 evaporates the water within the outer tub 320. The generated steam by the evaporation is introduced into the drum 330 via the perforated holes 331 of the drum 330 to refresh the laundry within the drum 330.

In doing so, the drying heater 343 and the blower fan 344 provided within the drying duct 341 are maintained to stop operating, whereby the steam can be smoothly supplied to the drum 330.

Moreover, in doing so, the drum 330 is being rotated to agitate the laundry within the drum 330, which enhances refreshing performance on the laundry.

And, the steam generation according to the above process keeps occurring during a dry-cleaning setup time. If the dry-cleaning time is set longer than the time taken for the water in the bottom part within the outer tub 320 to be entirely evaporated, shortage of the water takes place to rapidly raise the temperature of the portion provided with the water heater 360.

Of course, the dry-cleaning time can be set shorter than the evaporation time of the water. In such a case, an amount of the steam supplied for the dry cleaning may become in short to lower dry-cleaning performance. It is also able to increase a water storage amount by modifying a shape of the loading part 321 within the outer tub 320. In such a case, the shape modification needs to redesign other elements.

Accordingly, the embodiment of the present invention further proposes that the water level keeps being checked using the water level sensor 351 in the same manner of an early stage of the water supply while the steam is generated (S370).

Namely, if the water level confirmed by the water level sensor 351 is lower than a predefined third water level, it is decided that the water is in short. Hence, an additional water supply to the loading part 321 provided with the water heater 360 within the outer tub 320 is performed.

In doing so, the water is set up to be supplied via the cooling water supply pipe 345. And, it is preferable that a timing point of stopping the water supply is decided by keeping checking whether the level of the water reaches the second water level using the water level sensor 351 in the course of re-executing the water supply to prevent the laundry from being wet by the oversupply of the water.

If the amount of the steam supplied for the dry cleaning is decided as sufficient in the course of performing a series of the aforesaid processes, the power applied to the water heater 360 is cut off (S380).

In doing so, the steam amount can be confirmed through a sensing value of the humidity sensor 352 provided within the outer tub 320.

Namely, in keeping checking the humidity within the outer tub 320, if the humidity reaches a predefined humidity, the power applied to the water heater 360 is cut off.

In this case, the predefined humidity means a steam amount most appropriate for refreshing the laundry, which can be acquired by a test value on which no limitation is put.

Alternatively, a generated steam amount according to the heat generation time of the water heater 360 can be previously acquired through a test and the like and the acquired value is previously set up, by which it is able to decide the steam amount through such a simple process as a process of counting the heat generation time of the water heater 360 and the like.

Namely, if the setup time arrives via the time counting, the power applied to the water heater 360 is cut off.

After completion of the dry cleaning through the aforesaid processes, the drain valve 324 is controlled to open the drain-pipe 323 so that the remaining water within the loading part 321 can be discharged (S390). Thus, the operation for the dry cleaning is terminated.

Meanwhile, a ninth embodiment of the present invention is characterized in applying the configuration of the washing apparatus according to the fourth embodiment of the present invention to a dryer/washer configured different from that of the fifth embodiment of the present invention, which is explained in detail with reference to FIGS. 27 to 30 as follows.

First of all, a washing apparatus according to a ninth embodiment of the present invention includes a body 410, an outer tub 420, a drum 430, and a steam providing unit 480.

The body 410 forms an exterior of the washing apparatus. An entrance 411 is provided to a front side of the body 410. And, the entrance 411 is open/closed by a door 415.

A rim 413 is provided to an inner circumference of the entrance 411 for seal-up between the door 415 and the entrance 411.

The outer tub 420 is provided within the body 410, and the drum 430 is rotatably provided within the outer tub 420.

A multitude of perforated holes 431 are formed in a circumference of the drum 430 to allow water and steam to flow into the drum 430.

And, the steam providing unit 480 is configured to diffuse a prescribed amount of steam into the drum 430 for dry cleaning. And, at least one or more steam providing units 480 are provided.

In this case, the dry cleaning means not only a series of processes for refreshing the laundry but also a series of processes for removing various kinds of filth from the laundry.

Figure 29:
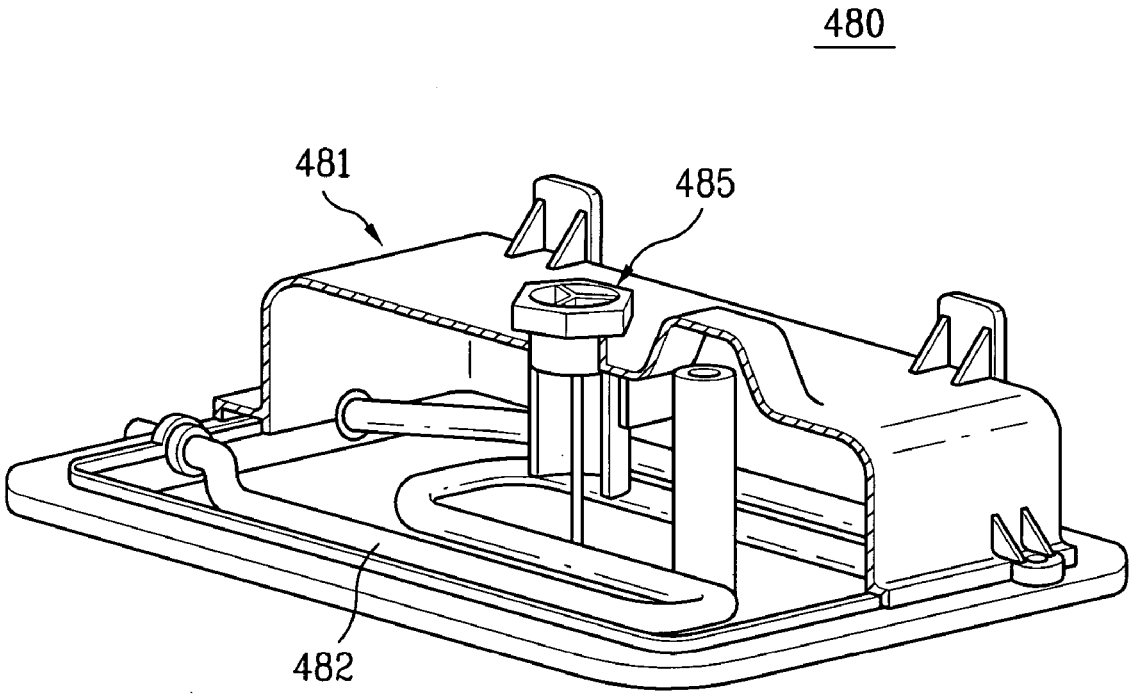
FIG. 29 is a perspective diagram of a steam providing unit of a washing apparatus according to a ninth embodiment of the present invention.
Figure 30:
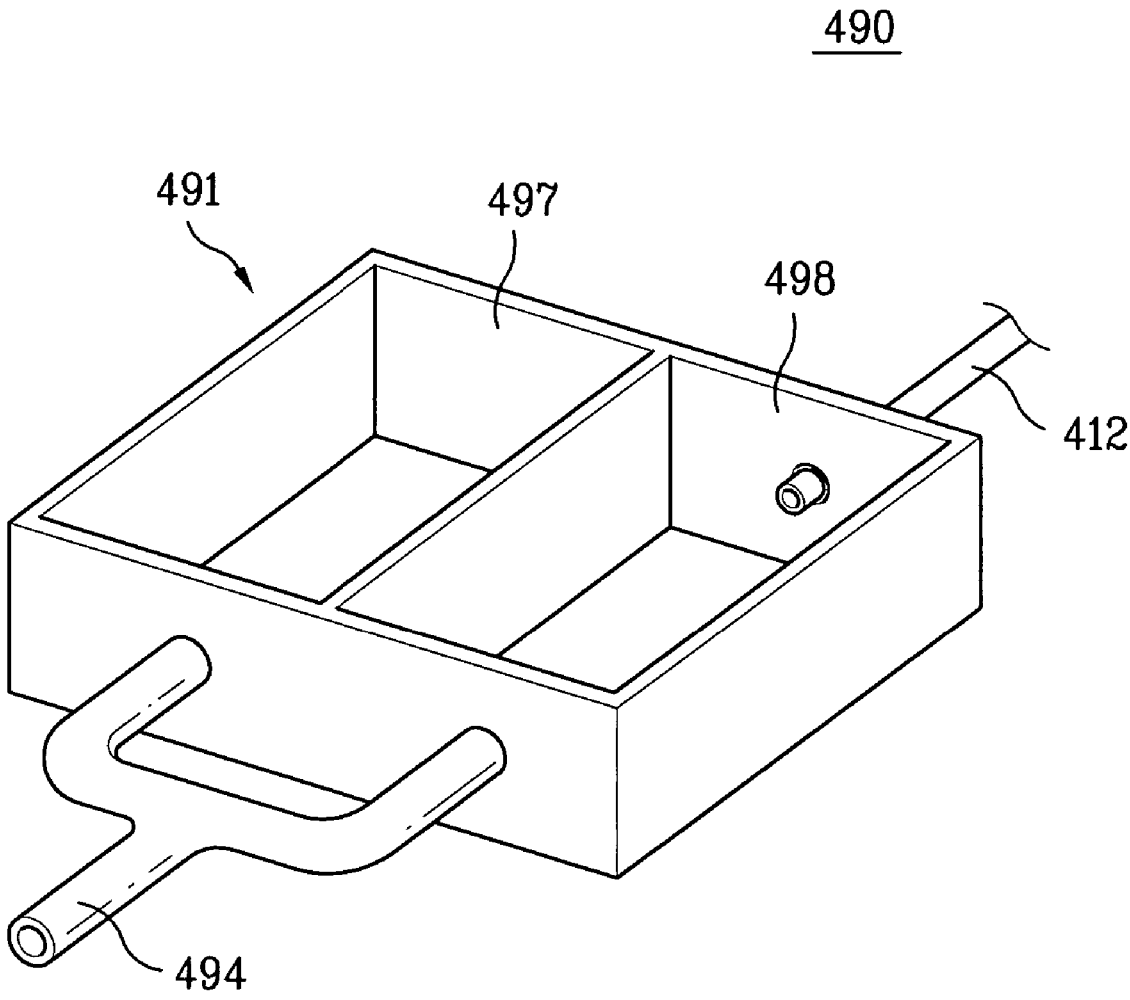
FIG. 30 is a perspective diagram of a detergent supplying unit of a washing apparatus according to a ninth embodiment of the present invention.

The steam providing unit 480, as shown in FIG. 29, includes a heating part 482 for generating steam from evaporating water by heat at high temperature.

The steam providing unit 480 includes a steam supply pipe 484 for a flow of the steam generated from the evaporation by the heating part 482.

And, the steam providing unit 480 includes a steam spray part 483 for diffusing the steam flowing via the steam supply pipe 484 into the drum 430.

The steam spray part 483 has a nozzle shape to enable smooth spray of the steam, and a steam outlet is provided within the drum 430. Preferably, the steam outlet of the steam spray part 483 is perforated into the rim 413 to be exposed to an inner space of the drum 430.

And, the steam spray part 483 can be connected to a pump or the like to enable the steam, which is generated from evaporating the water flowing through the steam supply pipe 484, to be forcibly sprayed into the drum 430. Preferably, the steam spray part 483 further includes a first open/close valve 486 provided to the steam supply pipe 484 opening/closing a pipe path of the steam supply pipe 484 to spray the steam selectively.

And, the steam providing unit 480 includes a water storage part 481 for storing a prescribed amount of water therein to supply the water to the steam supply pipe 484.

An inlet of the water storage part 481 is connected to a water supply valve 417 connected to a service pipe or the like and an outlet of the water storage part 481 is connected to the steam supply pipe 484.

The heating part 482 may include a coil heater enclosing the steam supply pipe 484. Alternatively, the heating part 482 preferably includes a sheath heater provided within the water storage part 481 to directly heat to evaporate the water stored in the water storage part 481.

In case of providing the heating part 482 within the water storage part 481, it is preferable that the steam providing unit 480 further includes a water level sensor 485 for sensing a level of the water stored in the water storage part 481.

If the amount of the water stored in the water storage part 481 is insufficient, the heating part 482 may excessively generate the heat. If the amount of the water stored in the water storage part 481 is excessively sufficient, it takes a long time to evaporate the water for the steam generation. Hence, the water level sensor 485 enables to maintain a uniform level of the water stored in the water storage part 481. In this case, the uniform level is enough for the smooth steam generation.

Namely, if the water level measured by the water level sensor 485 is higher than a reference value, water supply to the water storage part 481 is cut off. If the water level measured by the water level sensor 485 is lower than the reference value, supplementary water supply to the water storage part 481 is enabled.

Preferably, the washing apparatus according to the ninth embodiment of the present invention further includes a detergent supplying unit 490 to enhance the dry cleaning effect.

This is because efficiency of dry cleaning without using a detergent is too low.

Namely, by providing the detergent to the laundry, it is able to enhance dry-cleaning performance due to chemical reaction.

In this case, the detergent is a solvent mixed with a petroleum solvent.

Preferably, fragrance is further added to the detergent to be given to the laundry to be dry-cleaned.

Namely, the dry cleaning not only refreshes the laundry but also provides the fragrance to the laundry, thereby enhancing user's satisfaction.

Of course, the detergent supplied via the detergent supplying unit 490 may include the fragrance only without the petroleum-based solvent.

Namely, although not shown in the drawings, the detergent supplying unit 490 may include at least one fragrance spray part providing the fragrance.

Besides, although not shown in the drawing, the detergent supplying unit 490 and the fragrance spray part can be separately provided.

The detergent supplying unit 490 includes a detergent storage box 491 storing the dry-cleaning detergent therein.

The detergent storage box 491 is provided within the body 410 to enable detergent supplement.

And, the detergent supplying unit 490 includes a detergent spray part 493 for spraying the detergent stored in the detergent storage box 491 into the drum 430 and a detergent supply pipe 494 for guiding the detergent within the detergent storage box 491 to the detergent spray part 493.

Preferably, a detergent outlet of the detergent spray part 493 is exposed to the inside of the drum 430.

More preferably, a detergent outlet of the detergent spray part 493 is perforated into the rim 413 to be exposed to the inside of the drum 430.

The detergent spray part 493 can be connected to a pump or the like to enable to forcibly spray the detergent stored in the detergent storage box 491 into the drum 430. Preferably, the detergent spray part 493 further includes a second open/close valve 496 for opening/closing the pipe path of the detergent supply pipe 494 so that the detergent can be selectively sprayed.

Alternatively, the detergent spray part 493 and the steam spray part 483 can be built in one body.

Besides, the detergent storage box 491 enables to store a washing detergent as well.

Namely, the detergent storage box 491, as shown in FIG. 29, includes a first storage part 497 storing the dry-cleaning detergent and a second storage part 498 storing the washing detergent.

Preferably, the second storage part 498 is connected to the water supply pipe 412 so that a small amount of the water is sprayed into the drum 430 via the detergent spray part 493.

Of course, a configuration storing the washing detergent only and the detergent storage box 491 can be separately provided.

Preferably, the washing apparatus according to the present invention further includes a drying unit.

The drying unit includes a drying duct 441 for providing hot and dry air to the drum 430 and a drying heater 443 for heating the air flowing through the drying duct 441.

In this case, a blower fan 444 forcibly blowing the air within the drying duct 441 is further provided to a pipe path of the drying duct 441.

Figure 31:
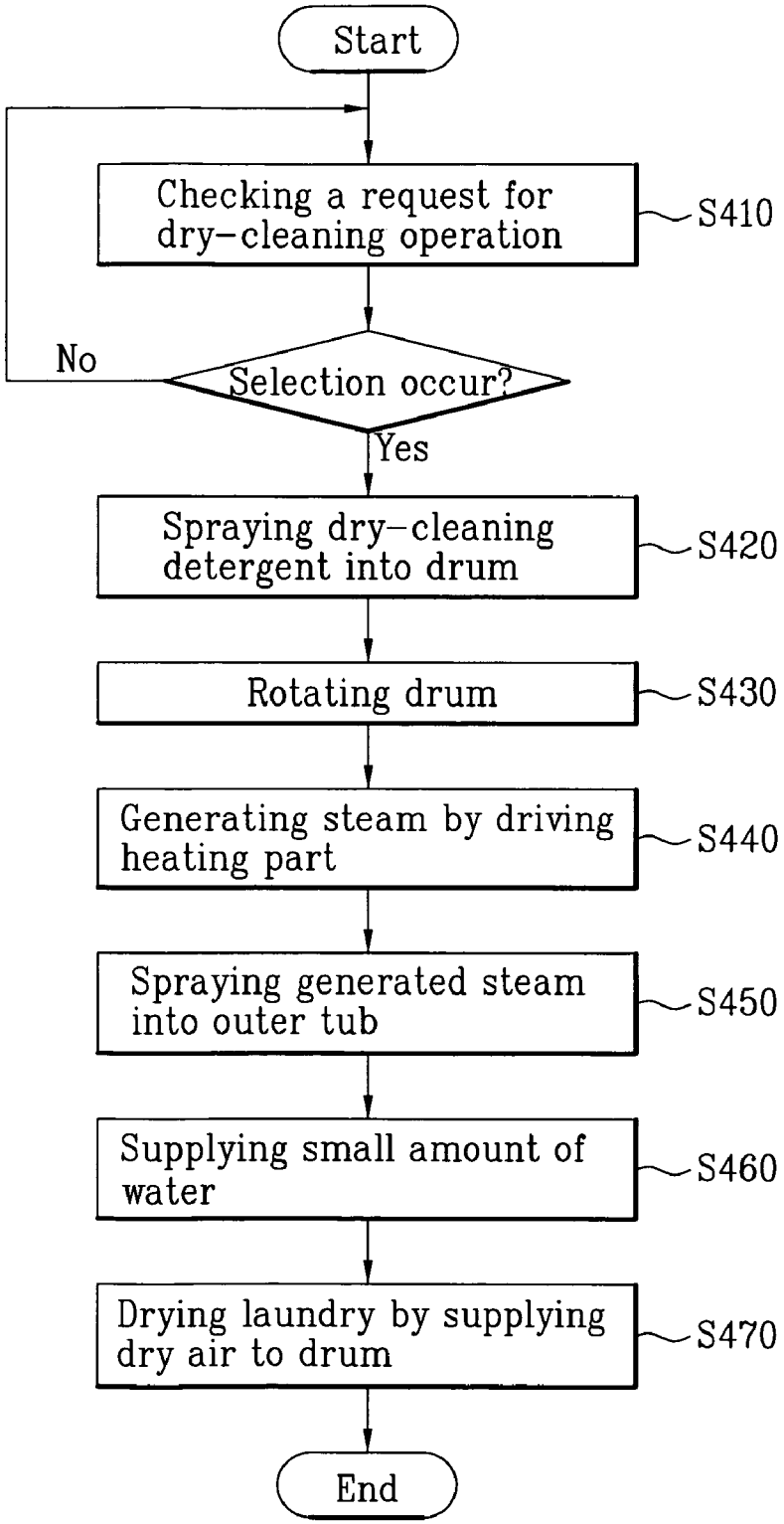
FIG. 31 is a flowchart of a method of controlling a washing apparatus according to a ninth embodiment of the present invention.

A method of controlling the above-explained washing apparatus according to the ninth embodiment of the present invention is explained with reference to a flowchart in FIG. 31 as follows.

First of all, a controller controlling an operation of the washing apparatus keeps checking a presence or non-presence of a request for a dry-cleaning operation (S410).

Namely, when an operation control of the drum type washing machine is requested by a user, the controller decides whether the operation selected by the user is for the dry cleaning or a general laundry washing. Hence, the controller detects the presence of the request for dry cleaning.

In doing so, in case of the presence of the request for the dry-cleaning operation, the controller requests an input of the laundry to be dry-cleaned.

In such a case, the user inputs the laundry to be dry-cleaned to the drum 430, closes the door 415, and then selects a continuous execution of the dry-cleaning operation.

Of course, after completion of inputting the laundry, the user may request the dry-cleaning operation so that the controller can immediately control the various elements for the dry-cleaning operation.

Subsequently, once the dry cleaning is ready to be executed by a series of the aforesaid procedures, the second open/close valve 496 is controller to spray the dry-cleaning detergent into the laundry inputted to the drum 430.

A method of controlling the above-explained washing apparatus according to the eighth embodiment of the present invention is explained with reference to a flowchart in FIG. 26 as follows.

First of all, a controller controlling an operation of the washing apparatus keeps checking a presence or non-presence of a request for a dry-cleaning operation (S310).

Namely, when an operation control of the drum type washing machine is requested by a user, the controller decides whether the operation selected by the user is for the dry cleaning or a general laundry washing. Hence, the controller detects the presence of the request for dry cleaning.

In doing so, in case of the presence of the request for the dry-cleaning operation, the controller requests an input of the laundry to be dry-cleaned.

In such a case, the user inputs the laundry to be dry-cleaned to the drum 330, closes the door 315, and then selects a continuous execution of the dry-cleaning operation.

Of course, after completion of inputting the laundry, the user may request the dry-cleaning operation so that the controller can immediately control the various elements for the dry-cleaning operation.

Subsequently, once the dry cleaning is ready to be executed by a series of the aforesaid procedures, an amount of the detergent sprayed into the drum 430 is set up not to soak the laundry therein. In doing so, the detergent includes the solvent and the fragrance.

Preferably, by rotating the drum 430 on spraying the dry-cleaning detergent, the dry-cleaning detergent is evenly coated on the laundry overall.

In doing so, the drum 430 may keep being rotated in one rotational direction. Preferably, it is controlled to alternately repeat to rotate the drum 430, clockwise and counter clockwise.

Hence, various kinds of filth are separated from the laundry by the dry-cleaning detergent sprayed by the detergent spray part 493.

During the above process, the water heater 160 is activated to generate the steam (S440) and the generated steam is sprayed into the outer tub (S450).

Namely, the water introduced into the water storage part 481 is evaporated by the generated heat of the heating part 482 and the evaporated water in a steam state is then guided by the steam supply pipe 484 to be sprayed into the space within the outer tub 420.

In doing so, the first open/close valve 486 is turned on.

Moreover, the steam sprayed into the outer tub 420 is introduced into the drum 430 via the perforated holes 431 of the drum 430 and then keeps being supplied to the laundry to refresh.

Specifically, the above-generated steam activates the detergent infiltrated into the laundry to enable smooth separation of the filth.

Of course, a next process is preferably carried out after a time sufficient for enabling the smooth separation of the filth from the laundry has passed after completion of the dry-cleaning detergent spray and the steam supply.

After completion of a series of the aforesaid processes, a small amount of water is injected into the drum 430 via the steam spray part 483 or the detergent spray part 493 to remove the filth separated from the laundry.

This is to prevent the filth, which was separated from the laundry, from contaminating the laundry again.

Since detergent the spray part 493 is configured to face the inside of the drum 430, a series of the process spraying the water into the drum 430 is preferably performed via the detergent spray part 493.

Of course, in doing so, the water is supplied to the second storage part 498 of the detergent storage box 491 so that the water sprayed into the drum 430 does not include the dry-cleaning detergent.

Specifically, an amount of the water injected into the drum 130 is preferably set small not to soak the laundry.

Moreover, a series of the process of spraying the water can be carried out prior to supplying the steam to the drum 430.

In this case, the steam plays a role in refreshing the laundry rather than induces the activation of the detergent.

After completion of the above process, dry and hot air is provided to the outer tub 420 (S470) so that the laundry can be dried by the dry air.

In doing so, the dry air is provided by the heat generation of the drying heater 443 and is then supplied to the outer tub 420 by the driven blower fan 444.

After completion of drying the laundry, the operation for the dry-cleaning mode is terminated.

Of course, the operation for the dry-cleaning mode can be completed in a manner of discharging the steam from the drum 430 not by providing the dry air but by driving the blower fan 444.

Meanwhile, the above-described configurations according to the first to ninth embodiments of the present invention have difficulty in evenly providing the steam and fragrance to the raveled laundries since the laundries within the drum are moved according to the rotation of the drum.

Accordingly, a washing apparatus according to a tenth or eleventh embodiment of the present invention provides a configuration for refreshing the laundry smoothly, which is explained in detail as follows.

Figure 32:
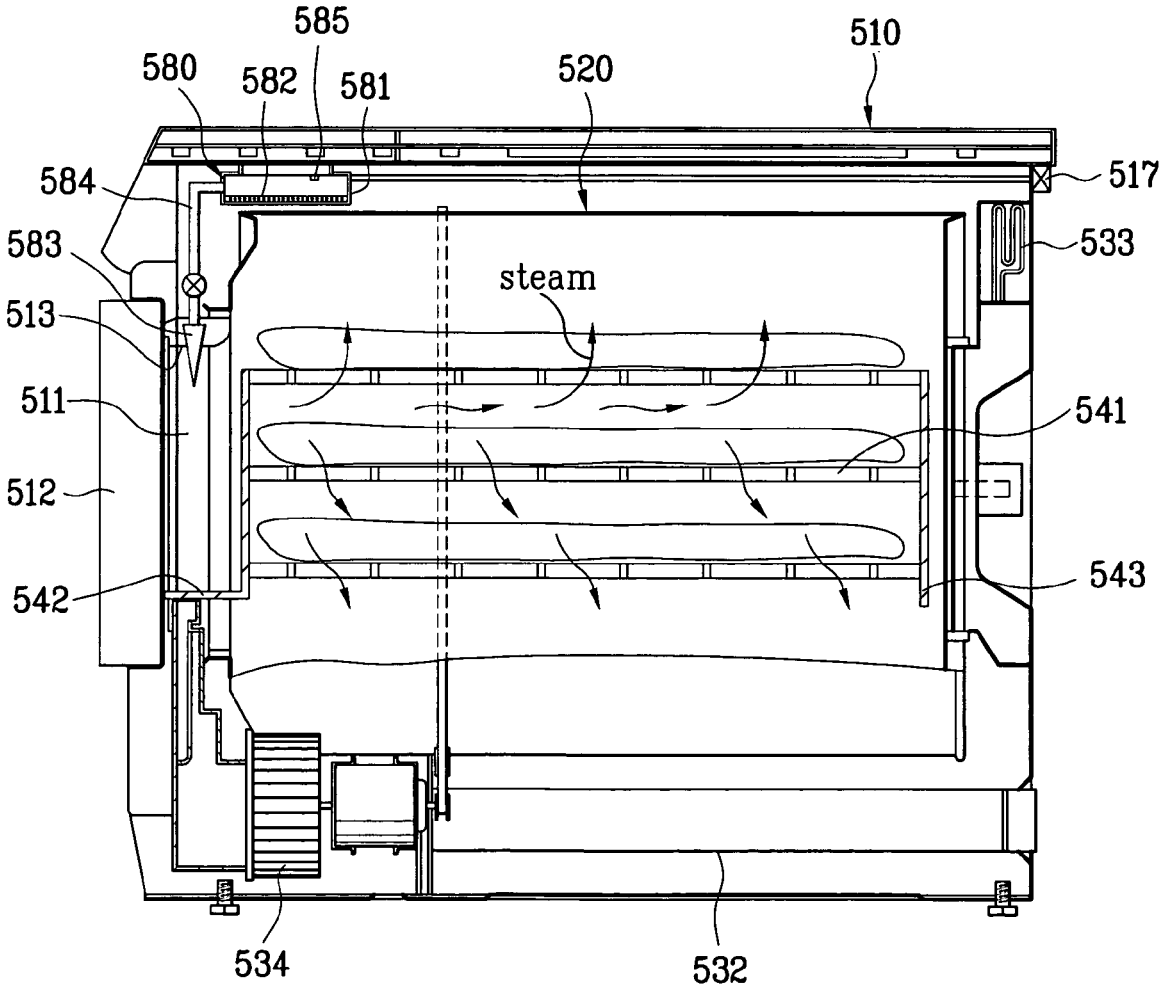
FIG. 32 is a cross-sectional diagram of a washing apparatus according to a tenth embodiment of the present invention.
Figure 33:
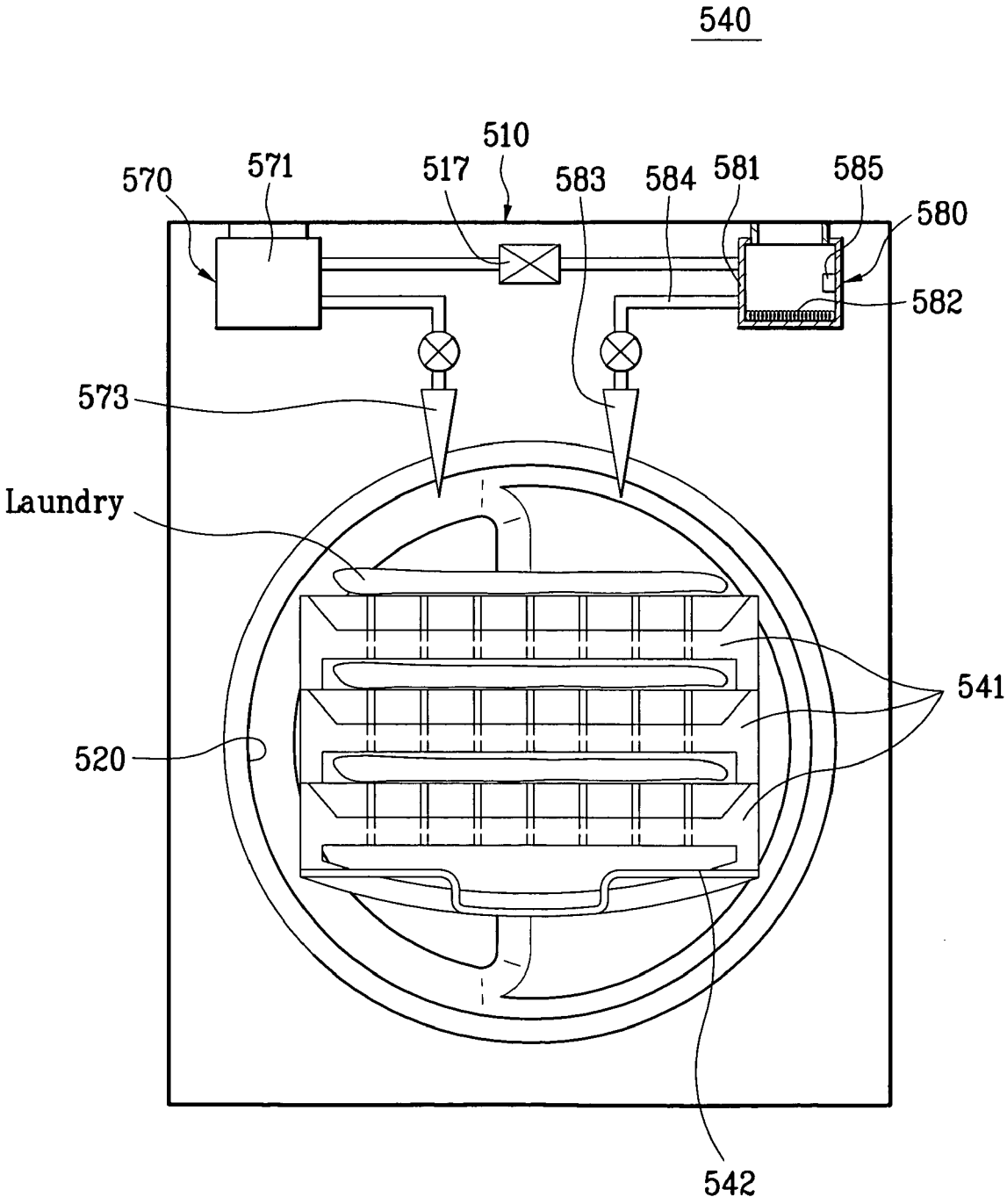
FIG. 33 is a front diagram of an interior of a washing apparatus according to a tenth embodiment of the present invention.
Figure 34:
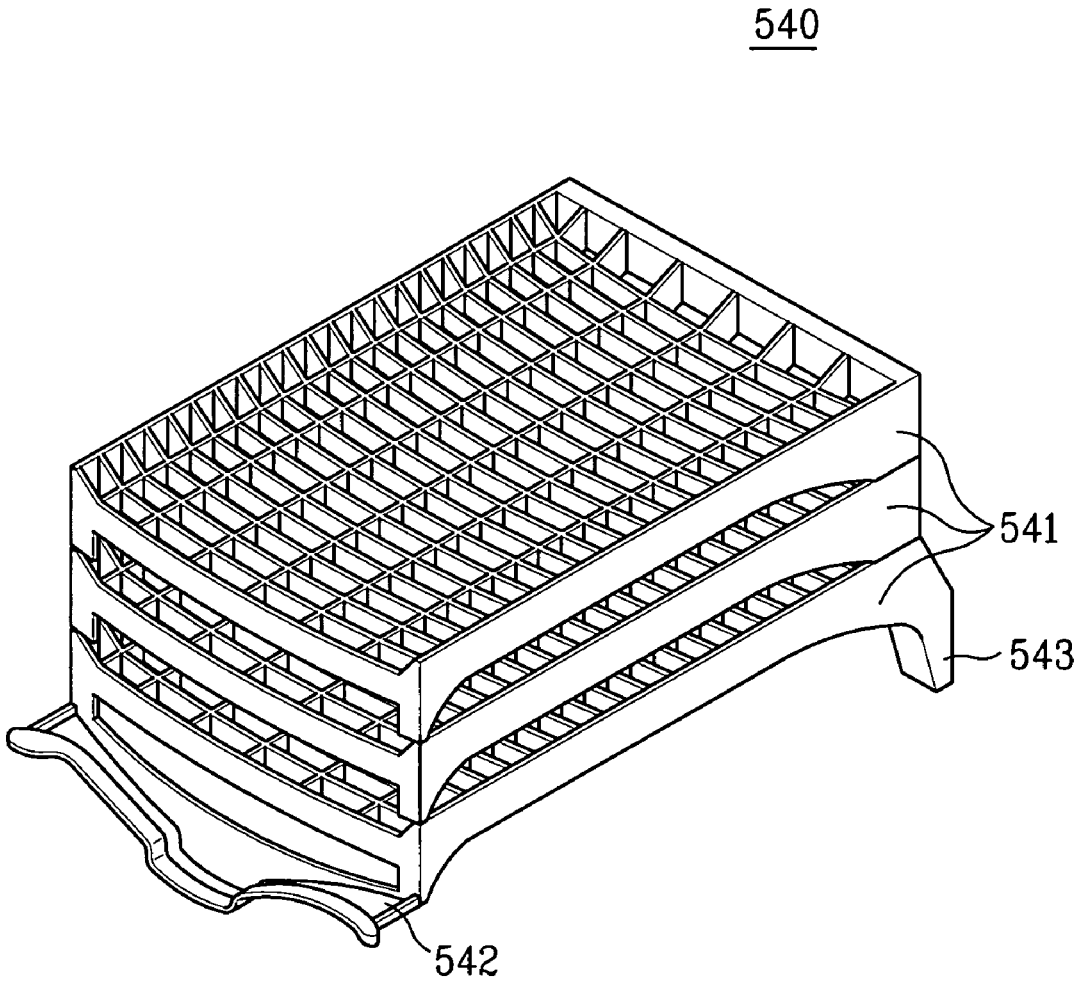
FIG. 34 is a perspective diagram of a laundry rack of a washing apparatus according to a tenth embodiment of the present invention.

FIGS. 32 to 34 show the configuration according to a tenth embodiment of the present invention.

First of all, a washing apparatus according to a tenth embodiment of the present invention includes a body 510, a drum 520, a steam providing unit 580, and a laundry rack 540. In this case, the washing apparatus is a laundry dryer.

Preferably, the washing apparatus further includes a fragrance spraying unit 570.

The steam providing unit 580 is configured to diffuse a prescribed amount of steam into the drum 510.

The steam providing unit 580 includes a heating part 582 for generating steam from evaporating water by heat at high temperature, a steam supply pipe 584 for a flow of the steam generated from the evaporation by the heating part 582, and a steam spray part 583 for diffusing the steam flowing via the steam supply pipe 584 into the drum 530.

The steam spray part 583 has a nozzle shape to enable smooth spray of the steam, and a steam outlet is provided within the drum 530. Preferably, the steam outlet of the steam spray part 583 is perforated into the rim 513 to be exposed to an inner space of the drum 530.

And, the steam spray part 583 can be connected to a pump or the like to enable the steam, which is generated from evaporating the water flowing through the steam supply pipe 584, to be forcibly sprayed into the drum 530. Preferably, the steam spray part 483 further includes a valve configuration, as shown in the drawings, to spray the steam by selectively opening/closing a pipe path thereof.

And, the steam providing unit 580 further includes a water storage part 581 for storing a prescribed amount of water therein to supply the water to the steam supply pipe 584. Preferably, the water storage part 581 is connected to a water supply valve 517 connected to a service pipe or the like.

The heating part 582 preferably includes a sheath heater provided within the water storage part 581 to directly heat to evaporate the water stored in the water storage part 581. Alternatively, the heating part 582 may include a coil heater enclosing the steam supply pipe 584.

In case of providing the heating part 582 within the water storage part t81, it is preferable that the steam providing unit 580 further includes a water level sensor 585 for sensing a level of the water stored in the water storage part 581.

Preferably, the water level sensor 585 maintains a uniform level of the water stored in the water storage part 581. In this case, the uniform level is enough for the smooth steam generation. If the amount of the water stored in the water storage part 581 is insufficient, the heating part 482 may excessively generate the heat. If the amount of the water stored in the water storage part 581 is excessively sufficient, it takes a long time to evaporate the water for the steam generation.

Namely, if the water level measured by the water level sensor 585 is higher than a reference value, water supply to the water storage part 581 is cut off. If the water level measured by the water level sensor 585 is lower than the reference value, supplementary water supply to the water storage part 581 is enabled.

And, the laundry rack 540, as shown in FIG. 34, is preferably configured to enable the laundry to be spread thereon.

Namely, the laundry can be spread on the laundry rack 540 to enhance dry-cleaning performance.

Preferably, the laundry rack 540 is detachably provided within the drum 520. Namely, the laundry rack 540 can be optionally used in a dry-cleaning mode.

The laundry rack 540 includes a rack frame 541 having a laundry placed thereon, a front supporter 542 provided to a front side of the rack frame 541 to load the rack frame 541 in the drum 520, and a rear supporter 543 provided to a rear side of the rack frame 541 to load the rack frame 541 in the drum 520 together with the front supporter 542. And, the front and rear supporters 542 and 543 are built in one body of the rack frame 541.

In this case, the rack frame 541 approximately has a flat panel shape so that the spread laundry can be placed thereon.

Preferably, at least two rack frames 541 are provided to enable a multitude of laundries to be placed thereon. The at lest two rack frames 541 are stacked one by one to configure a multi-floor shape. And, the at least two rack frames 541 are built in one body. Alternatively, the at least two rack frames 541 are separable.

Specifically, even if the laundry is spread to be put on each of the rack frames 541, each of the rack frames 541 has a configuration enabling air to flow upward and downward through it. Preferably, each of the rack frames 541 has a lattice shape.

The front supporter 542 is configured to be placed on a part of the body 510 where the entrance 511 is formed. Yet, the front supporter 542 is configured not to close an air inlet of a hot air discharge pipe 532.

And, the rear supporter 543 is configured to be loaded on a rear inside of the drum 520.

Moreover, the fragrance spraying unit 570 is configured to additionally provide a prescribed amount of fragrance to the laundry for dry cleaning.

The fragrance spraying unit 570 includes a fragrance storage box 571 for storing fragrance therein and a nozzle type fragrance spray part 573 for spraying the fragrance stored in the fragrance storage box 571 into the drum 520.

Preferably, a fragrance outlet of the fragrance spray part 573 is configured to be exposed to an inner space of the drum 520.

More preferably, the fragrance outlet of the fragrance spray part 573 is perforated into the rim 513 to be exposed to the inner space of the drum 520 together with the steam spray part 583.

The fragrance spray part 573 may be connected to a pump or the like to forcibly jet the fragrance stored in the fragrance storage box 571 into the drum 520. Instead, the fragrance spray part 573, as shown in FIG. 6, employs a valve configuration to spray the fragrance by turning on/off a pipe path thereof.

And, the fragrance provided by the fragrance spraying unit 570 may further include a petroleum-based solvent added detergent to enhance dry-cleaning performance.

Although not shown in the drawing, a device for spraying such a detergent as a solvent and the like may be further provided apart from the fragrance spraying unit 570.

A method of controlling a washing apparatus according to the tenth embodiment of the present invention is explained as follows.

First of all, the laundry rack 540 is loaded in the drum 520. A multitude of laundries to be dry-cleaned are then put on the rack frames 541 of the laundry rack 540.

In doing so, the rear supporter 543 is placed on the inside of the drum 520 and the front supporter 542 is placed on the entrance side of the body 510.

Preferably, each topside of the rack frames 541 is leveled.

Once an operation of a dry-cleaning mode is executed, heat is generated from the heating part 582 to evaporate the water stored in the water storage part 581. Hence, a great quantity of steam is generated.

The generated steam flows along the steam supply pipe 584 to be sprayed into the drum 520 via the steam spray part 583.

In doing so, the water level sensor 585 and the water supply valve 517 are controlled to maintain a constant level of the water stored in the water storage part 581.

Hence, the laundries put on the rack frames 541 are refreshed by the steam supplied to the drum 520.

Since each of the rack frame 541 has the lattice shape enabling air ventilation, the steam supplied inside the drum 520 freely travels the entire space within the drum 520 to refresh the laundries.

Simultaneously, the fragrance spraying unit 570 operates to spray the fragrance stored in the fragrance storage box 571 into the drum 520 via the fragrance spray part 573.

In doing so, the fragrance adsorbs to the laundries to remove odor of the laundry.

After completion of the dry cleaning through a series of the processes, power applied to the heating part 582 is cut off.

Thereafter, the blower fan 534 is driven to externally discharge the steam remaining within the drum 520, thereby enabling to protect the user from danger such as a burn caused by the high-temperature steam.

Optionally, by driving the drying heater 533 prior to execute the steam discharge using the blower fan 534, it is able to dry the dry-cleaned laundries.

Meanwhile, the configuration of the washing apparatus according to the tenth embodiment of the present invention is applicable to other apparatuses as well as the laundry dryer.

Namely, the configuration of the washing apparatus according to the tenth embodiment of the present invention is applicable to a drum type washer/dryer, a general drum type washing machine, and the like.

Figure 35:
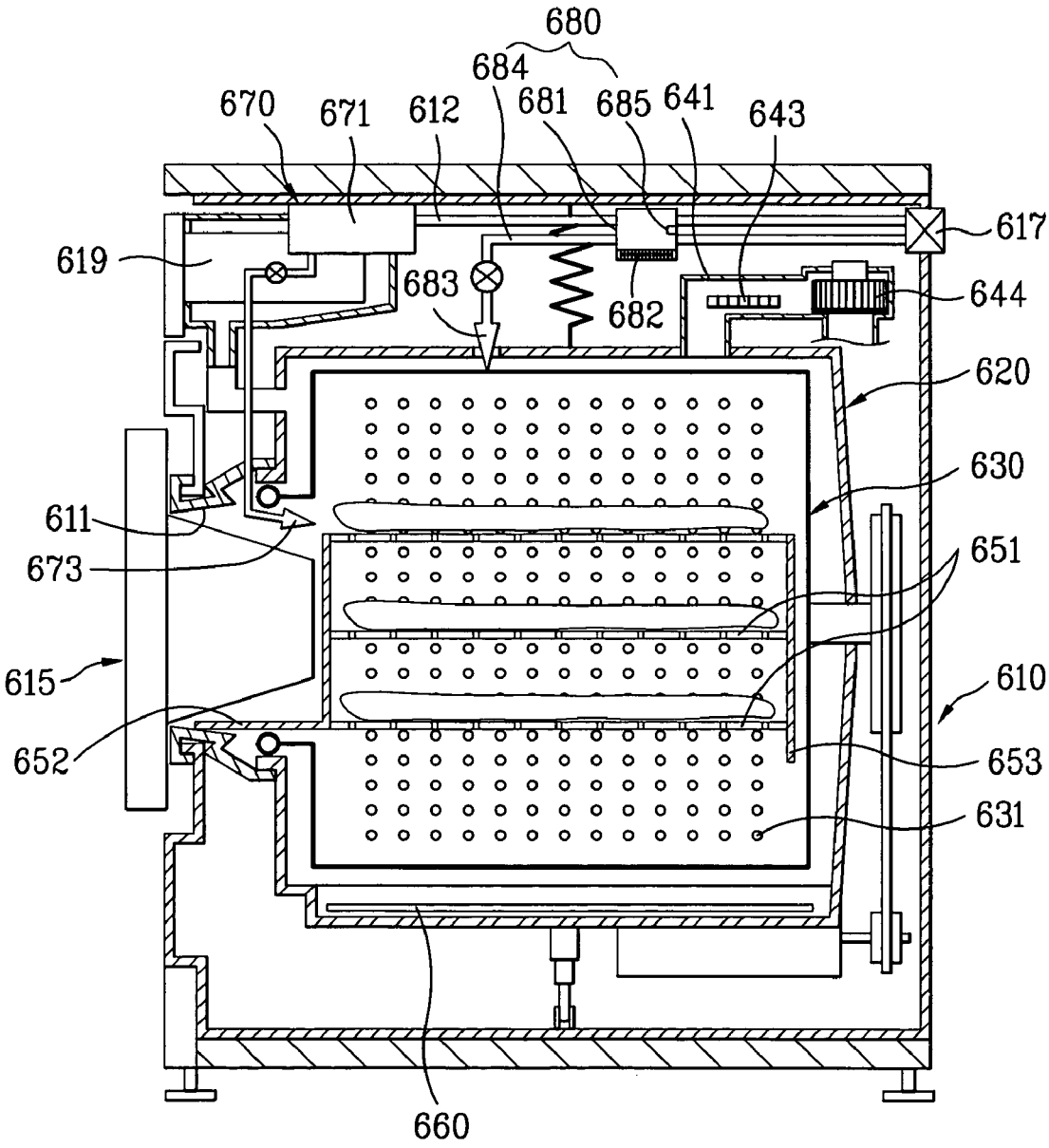
FIG. 35 is a cross-sectional diagram of a washing apparatus according to an eleventh embodiment of the present invention.
Figure 36:
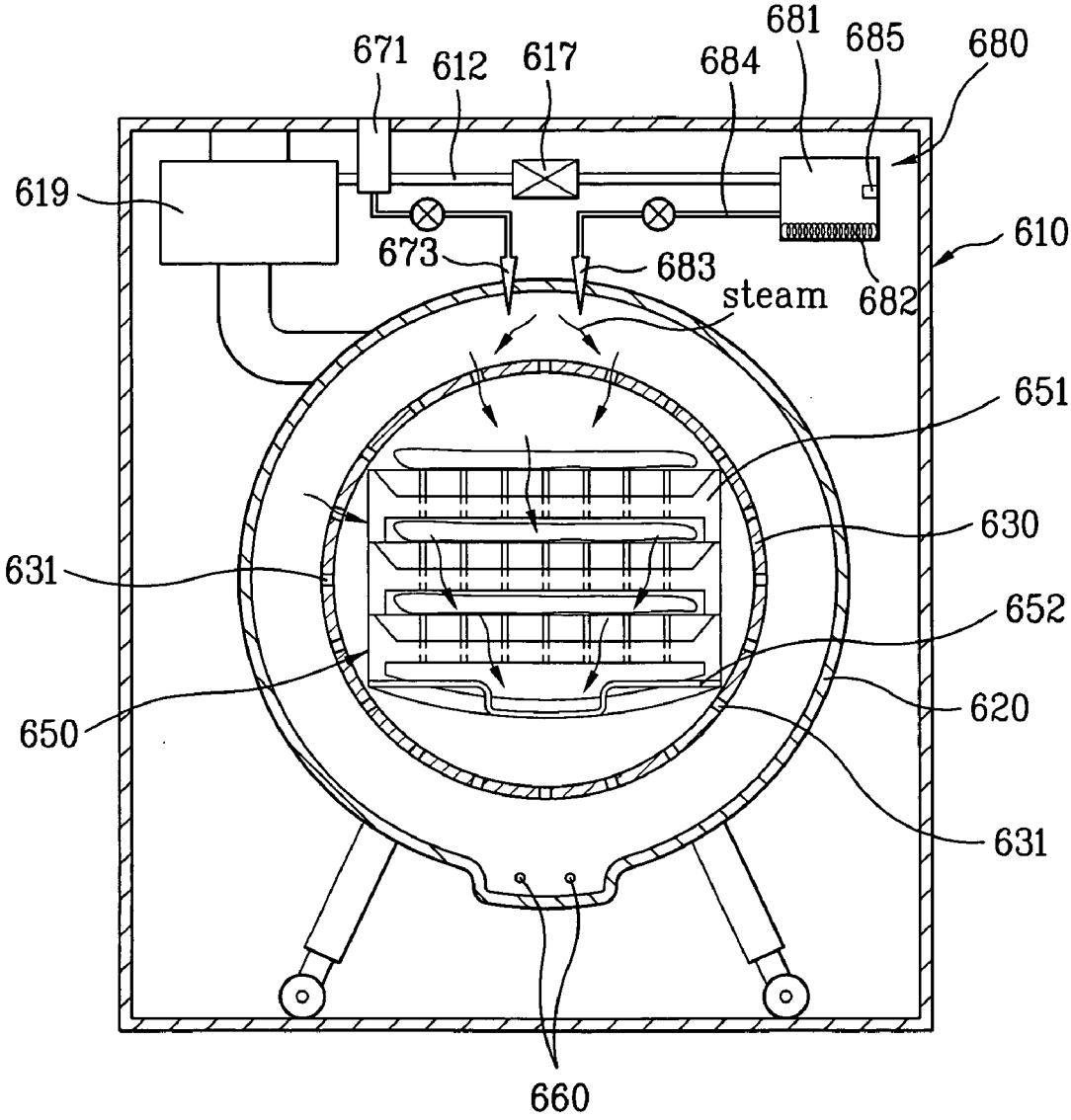
FIG. 36 is a schematic cross-sectional of an interior of a washing apparatus according to an eleventh embodiment of the present invention.

An eleventh embodiment of the present invention is characterized in applying the configuration of the tenth embodiment of the present invention to a drum type washer/dryer, which is explained in detail with reference to FIG. 35 and FIG. 36 as follows.

First of all, a washing apparatus according to an eleventh embodiment of the present invention includes a body 610, an outer tub 620, a drum 630, a steam providing unit 680, and a laundry rack 640.

The body 610 forms an exterior of a drum type washer/dryer.

An entrance 611 for a laundry input is provided to a front side of the body 610. And, the entrance 611 is open/closed by a door 615.

In the body 610, provided are the outer tub 620, a water supply pipe 612 guiding a flow of water supply, and a drying unit providing heated air to an inside of the outer tub 620.

The drying unit includes a drying duct 641 for an air flow, a drying heater 643 provided to a pipe path of the drying duct 641, and a blower fan 644 for forcible air circulation.

An air inlet of the drying duct 641 is connected to a lateral side of the outer tub 620 and an air outlet of the drying duct 641 is connected to a topside of the outer tub 620.

The drum 630 is rotatably provided within the outer tub 620.

A multitude of perforated holes 631 for water communication are provided to a circumference of the drum 630.

The steam providing unit 680 includes a heating part 682 for generating steam from evaporating water by heat at high temperature, a steam supply pipe 684 for a flow of the steam generated from the evaporation by the heating part 682, a steam spray part 683 for diffusing the steam flowing via the steam supply pipe 684 into the drum 630, and a water storage part 681 provided to a pipe path of the water supply pipe 612.

Preferably, a water level sensor 685 is further provided within the water storage part 681.

Considering that the water supply from outside is performed via the water supply valve 617, the steam providing unit 680 needs no separate pipe path for supplying water to the water storage part 681.

Namely, the water storage part 681 is just provided to the pipe path of the water supply pipe 612 connected to the water supply valve 617.

In this case, a separate pipe valve (snot shown in the drawing) enabling a selective water supply to the water storage part 681 or detergent box 619 is preferably provided to the pipe path of the water supply pipe 612.

Figure 37:
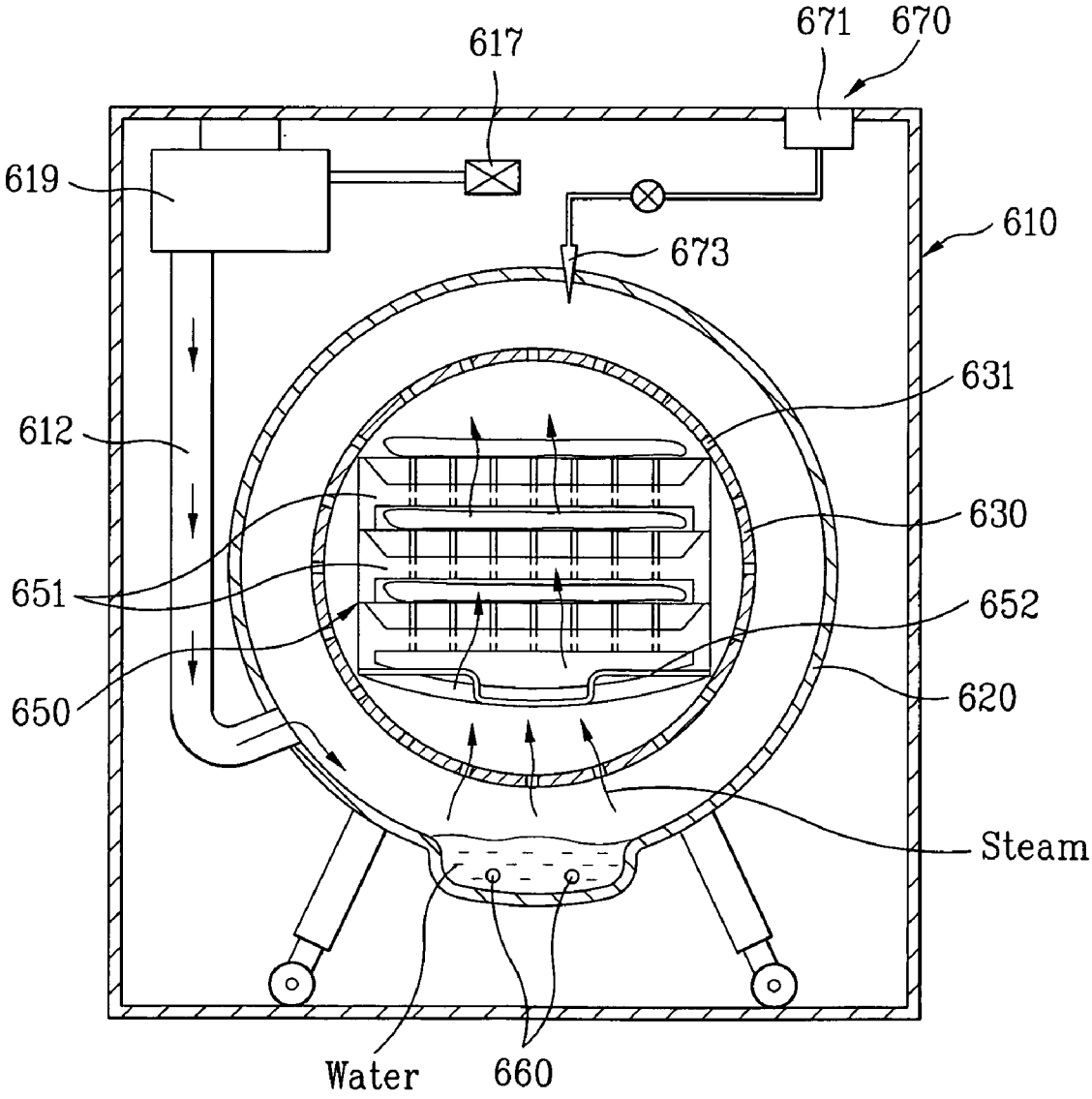
FIG. 37 is a schematic cross-sectional diagram of another example of the interior in FIG. 36.

Moreover, instead of using the heating part 682 of the steam providing unit 680, it is able to use a water heater 660, as shown in FIG. 37, provided to a bottom part within the outer tub 620 to adjust a water temperature.

In this case, the water supply pipe 612 is connected to the bottom part of the outer tub 620. This is to prevent the supplied water from being splashed on the laundry within the drum 630 during the water supply.

And, the steam spray part 683 of the steam providing unit 680 is configured to be exposed to the inside of the outer tub 620 only.

In doing so, the steam spray part 683 is not exposed to the inside of the drum 630 because the steam having been provided to the inside of the outer tub 620 only can be supplied to the inside of the drum 630 via a multitude of the perforated holes 631 provided to the circumference of the drum 630.

And, the laundry rack 650 has the same configuration of the laundry rack of the tenth embodiment of the present invention.

Namely, a plurality of rack frames 651 are built in one body to construct a multi-floor shape. a front supporter 652 is configured to be placed on a part of the body 610 where the entrance 611 is formed. And, a front supporter 652 is configured to be loaded on a rear inside of the drum 630.

Preferably, the washing apparatus according to the eleventh embodiment of the present invention further includes a fragrance spraying unit 670.

The fragrance spraying unit 670 includes a fragrance storage box 671 storing fragrance therein and a fragrance spray part 673 spraying the fragrance.

Of course, the fragrance storage box 671 can be replaced by the detergent box 619 as well.

A method of controlling a washing apparatus according to the eleventh embodiment of the present invention is explained as follows.

First of all, the laundry rack 650 is loaded in the drum 630. A multitude of laundries to be dry-cleaned are then put on the rack frames 651 of the laundry rack 650.

In doing so, the rear supporter 653 is placed on the inside of the drum 630 and the front supporter 652 is placed on the entrance side of the body 610.

Preferably, each topside of the rack frames 651 is leveled.

Once an operation of a dry-cleaning mode is executed, heat is generated from the heating part 682 to evaporate the water stored in the water storage part 681. Hence, a great quantity of steam is generated.

In doing so, the water is supplied to the water storage part 681 according to the control of the water supply valve 617 and the water level sensor 685 and the water supply valve 617 are controlled to maintain a constant level of the water stored in the water storage part 681.

Moreover, the generated steam flows along the steam supply pipe t84 to be sprayed into the outer tub drum 620 via the steam spray part 683.

The steam having been sprayed into the outer tub 620 is passed through the perforated holes 631 of the drum 630 to refresh the laundries put on the rack frames 651.

Simultaneously, the operation of the fragrance spraying unit 670 is controlled to spray the fragrance stored in the fragrance storage box 671 into the drum 630 via the fragrance spray part 673.

In doing so, the fragrance adsorbs to the laundries to remove odor of the laundries.

After completion of the dry cleaning through a series of the processes, powers applied to the heating part 682 and the water supply valve 617 are cut off.

Thereafter, the blower fan 644 within the drying duct 641 is driven to externally discharge the steam remaining within the drum 630, whereby a temperature within the drum 630 is lowered.

Preferably, the drying heater 643 is controlled not to generate heat, thereby enhancing efficiency of cooling down the steam.

Accordingly, the present invention provides the following effects or advantages.

First of all, in the first to third embodiments of the present invention, a plurality of the wet pad cloths for dry cleaning are provided within the drum, whereby a great quantity of laundries can be dry-cleaned.

Specifically, a plurality of the wet pad cloths are rotated together with the drum to provide the fragrance and steam to the respective laundries evenly, whereby the dry-cleaning performance can be more enhanced.

Moreover, the supplementary fragrance and steam can be additionally provided even if the amount of fragrance and steam is in short, whereby the dry-cleaning performance can be more enhanced.

Secondly, in the fourth, fifth, and ninth embodiments of the present invention, the washing apparatus enables the dry cleaning of the laundry without the wet pad cloth.

Specifically, the dry cleaning works on the entire area within the drum, whereby a great quantity of laundries can be dry-cleaned.

Moreover, the dry-cleaning detergent is evenly distributed over the respective laundries within the drum, whereby the dry-cleaning performance can be more enhanced.

Specifically, the detergent includes the fragrance therein, whereby user's satisfaction can be enhanced.

Thirdly, in the sixth and seventh embodiments of the present invention, the washing apparatus previously prevents the water from coming contact with the laundries in the course of being supplied for steam generation, thereby enabling to enhance performance of refreshing the laundries.

Fourthly, in the eight embodiment of the present invention, the washing apparatus enables to accurately maintain the level of the water supplied for steam generation.

Specifically, the water supply deviation can be minimized by supplying the water via the water supply pipe for performing the water supply relatively fast on the early stage of the water supply and by supplying the water via the cooling water supply pipe only after a prescribed progress of the water supply.

Finally, in the tenth and eleventh embodiments of the present invention, the washing apparatus enables to settle the difficulty in evenly providing the steam, fragrance, and detergent to the raveled laundries during the dry cleaning.

Namely, the dry cleaning can be evenly carried out on the laundries overall.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing apparatus comprising:

a body forming an exterior of the washing apparatus;

a drum provided within the body;

a water storage part located between the body and the drum;

at least one steam supply pipe, wherein the steam supply pipe is between the water storage part and the drum;

a water supply valve in fluid connection with the water storage part to control water flow to the water storage part;

a heating part, wherein the heating part is located outside of the steam supply pipe, the heating part evaporating water into steam; and a controller configured to turn on the valve to allow water to flow to the steam supply pipe and operating the heating part at least while the valve is turned on.

2. The washing apparatus of claim 1, wherein the heating part comprises a coil heater enclosing a portion of the steam supply pipe.

3. The washing apparatus of claim 1, wherein water in the water storage part flows out of an outlet of the water storage part when the water exceeds an outlet level of the water storage part.

4. The washing apparatus of claim 1, further comprising a steam spray part configured to diffuse steam flowing from the steam supply pipe to an inward direction of the drum.

5. The washing apparatus of claim 4, wherein a steam outlet of the steam spray part is exposed to an inside of the drum.

6. The washing apparatus of claim 5, wherein the steam outlet of the steam spray part is passed through a laundry inlet of the drum to face the inside of the drum.

7. The washing apparatus of claim 1, further comprising:

an outer tub provided within the body, wherein the drum is rotatably provided within the outer tub.

8. The laundry machine of claim 1, wherein the drum is configured to rotate about a horizontal axis and provided within the body.

9. The washing apparatus of claim 1, wherein the controller is configured to turn off the valve and to turn off the heating part at least while the valve is turned off.

10. The washing apparatus of claim 1, wherein the controller is configured to rotate the drum at least while the valve and the heating part is turned on.

11. The washing apparatus of claim 10, wherein the controller is configured to rotate the drum is a clockwise and counter clockwise direction.

12. The washing apparatus of claim 1, wherein the washing apparatus includes a dryer.

13. A washing apparatus comprising:

a body forming an exterior of the washing apparatus;

an outer tub provided within the body;

a drum configured to rotate about a horizontal axis, provided within the outer tub and having a multitude of perforated holes on a circumference;

at least one steam providing unit to provide steam from an upper portion of the outer tub, wherein the steam providing unit comprises:

a water storage part including an outlet located between the body and the outer tub, wherein water in the water storage part flows out of the outlet when the water exceeds an outlet level of the water storage part, a heating part, wherein the heating part is located at a portion of a steam supply pipe and outside of the steam supply pipe to evaporate water into steam, and the steam supply pipe is between the water storage part and the tub;

a water supply valve in fluid connection with the water storage part to control water flow to the water storage part; and a controller configured to turn on the valve to allow water to flow to the water storage part and operating the heating part at least while the valve is turned on.

14. The washing apparatus of claim 13, wherein the water storage part stores a prescribed amount of water.

15. The washing apparatus of claim 13, wherein the water storage part is between a pipe path for a water supply and the steam supply pipe.

16. The washing apparatus of claim 13, further comprising a spray part coupled to the steam providing unit, wherein a steam outlet of the spray part is exposed to the inside of the drum.

17. The washing apparatus of claim 13, wherein a steam outlet of the steam providing unit passes through upper portion of the outer tub to provide the steam flowing from the steam supply Pipe to the drum in a downwards direction.

18. The washing apparatus of claim 13, further comprising a steam spray part configured to diffuse steam flowing from the steam supply pipe to an inward direction of the drum.

19. The washing apparatus of claim 13, wherein the controller is configured to turn off the valve and to turn off the heating part at least while the valve is turned off.

20. The washing apparatus of claim 13, wherein the controller is configured to rotate the drum at least while the valve and the heating part is turned on.

21. The washing apparatus of claim 20, wherein the controller is configured to rotate the drum is a clockwise and counter clockwise direction.

22. The washing apparatus of claim 13, wherein the washing apparatus includes a dryer.

23. A washing apparatus comprising:

a body forming an exterior of the washing apparatus;

a drum configured to rotate about a horizontal axis and provided within the body; and at least one steam providing unit to supply steam into the drum, wherein the steam providing unit comprises:

a water storage part to contain water therein and provided between the body and the drum, wherein the water storage part is configured to allow the water in the water storage part to overflow from the water storage part when the water exceeds a prescribed amount of water that can be held by the water storage part;

a heating part located outside of a steam supply pipe, the heating part evaporating water into steam, and the steam supply pipe is between the water storage part and the drum;

a water supply valve in fluid connection with the water storage part to control water flow to the water storage part; and a controller configured to turn on the valve to allow water to flow to the water storage part and operating the heating part at least while the valve is turned on.

24. The laundry machine of claim 23, wherein the flow path is connected to the water storage part at a side surface thereof.

25. The laundry machine of claim 23, wherein the flow path is connected to the water storage part at a portion higher than a bottom thereof.

26. The laundry machine of claim 23, wherein the flow path is connected to the water storage part horizontally.

27. The laundry machine of claim 23, wherein the flow path is connected horizontally to the water storage part at a portion higher than a bottom thereof.

28. The laundry machine of claim 23, wherein the heating part is arranged around the steam supply pipe.

29. The laundry machine of claim 23, wherein the heating part is so arranged as to evaporate the water flowing through the steam supply pipe without directly contacting the water.

30. The washing apparatus of claim 23, wherein the controller is configured to turn off the valve and to turn off the heating part at least while the valve is turned off.

31. The washing apparatus of claim 23, wherein the controller is configured to rotate the drum at least while the valve and the heating part is turned on.

32. The washing apparatus of claim 31, wherein the controller is configured to rotate the drum is a clockwise and counter clockwise direction.

33. The washing apparatus of claim 23, wherein the washing apparatus includes a dryer.

* * * * *